US006749999B2

(12) United States Patent
Yabuki et al.

(10) Patent No.: US 6,749,999 B2
(45) Date of Patent: Jun. 15, 2004

(54) PHOTOTHERMOGRAPHIC MATERIAL AND IMAGE FORMATION METHOD UTILIZING THE SAME

(75) Inventors: Yoshiharu Yabuki, Minami-ashigara (JP); Katsutoshi Yamane, Minami-ashigara (JP); Ryo Suzuki, Minami-ashigara (JP); Rikio Inoue, Minami-ashigara (JP)

(73) Assignee: Fuji Photo Film Co., Ltd., Minami-ashigara (JP)

( * ) Notice: Subject to any disclaimer, the term of this patent is extended or adjusted under 35 U.S.C. 154(b) by 0 days.

(21) Appl. No.: 10/292,701

(22) Filed: Nov. 13, 2002

(65) Prior Publication Data

US 2003/0219684 A1 Nov. 27, 2003

(30) Foreign Application Priority Data

Nov. 13, 2001 (JP) ..... 2001-346956

(51) Int. Cl.[7] ..... G03C 1/498; G03C 1/83; G03C 5/16

(52) U.S. Cl. ..... 430/353; 430/512; 430/517; 430/522; 430/617; 430/619

(58) Field of Search ..... 430/512, 517, 430/522, 617, 619, 353

(56) References Cited

U.S. PATENT DOCUMENTS

| | | | | |
|---|---|---|---|---|
| 5,998,126 A | | 12/1999 | Toya et al. | |
| 6,143,488 A | * | 11/2000 | Uytterhoeven et al. | 430/619 |
| 2003/0091347 A1 | * | 5/2003 | Goto et al. | 430/350 |

FOREIGN PATENT DOCUMENTS

| | | |
|---|---|---|
| EP | 1 276 006 A1 | 1/2003 |
| EP | 1 276 007 A1 | 1/2003 |
| GB | 1 422 057 A | 1/1976 |
| JP | 2000-305213 A | 11/2000 |

* cited by examiner

*Primary Examiner*—Richard L. Schilling
(74) *Attorney, Agent, or Firm*—Birch, Stewart, Kolasch & Birch, LLP

(57) ABSTRACT

Disclosed is a photothermographic material comprising a support, a photosensitive layer containing a silver halide having a silver iodide content of 10 mol % or more and a reducing agent and a non-photosensitive layer provided on the support, wherein at least one of the photosensitive layer and the non-photosensitive layer contains a dye showing an absorption maximum in a wavelength range of 350 nm to 430 nm. The photothermographic material exhibits high image quality, superior color tone and superior image stability after development.

23 Claims, No Drawings

PHOTOTHERMOGRAPHIC MATERIAL AND IMAGE FORMATION METHOD UTILIZING THE SAME

TECHNICAL FIELD

The present invention relates to a photothermographic material exhibiting superior image storability and sharpness as well as little residual color after development and an image formation method utilizing the same.

RELATED ART

Photothermographic materials have been proposed since old days and described in, for example, U.S. Pat. Nos. 3,152,904 3,457,075 and B. Shely, "Thermally Processed Silver Systems" in Imaging Processes and Materials, Neblette, 8th Ed., Ed. by Sturge, V. Walworth and A. Shepp, page 2, 1969.

Photothermographic materials generally have a photosensitive layer containing a catalytic amount of photocatalyst (e.g., silver halide), a reducing agent, a reducible silver salt (e.g., silver salt of an organic acid) and a toning agent for controlling silver color tone, which are dispersed in a binder matrix. After being exposed imagewise, photothermographic materials are heated at an elevated temperature (e.g., 80° C. or higher) and thereby an oxidation/reduction reaction is caused between the silver halide or the reducible silver salt (functioning as an oxidizing agent) and the reducing agent to form a black silver image. The oxidation/reduction reaction is promoted by the catalytic action of a latent image of silver halide produced by the exposure. Therefore, the black silver image is formed in the exposed area.

Heat development does not require processing solutions as used in the wet development processing and has an advantage of easy and quick processing. However, the heat development suffers from unsolved problems that never occur with the wet development.

One of the problems is the problem concerning image storability. That is, since image formation systems based on heat development utilizing a silver salt of an organic acid do not require a fixation process, image storability after development, especially degradation of print out by irradiation with light, constitutes a serious problem. As means for improving the print out, methods of using AgI formed by conversion of a silver salt of an organic acid are disclosed in U.S. Pat. No. 6,143,488 and EP922,995. However, the methods of converting a silver salt of an organic acid with iodine as disclosed in those references cannot provide satisfactory sensitivity and thus cannot constitute actually usable systems.

In addition, photosensitive materials utilizing AgI are also described in International Patent Publications WO97/48014, WO97/48015, U.S. Pat. No. 6,165,705, Japanese Patent Laid-open Publication (Kokai, referred to as JP-A hereinafter) No. 8-297345, Japanese Patent No. 2,785,129 and so forth. However, any of these cannot achieve sensitivity and fog of sufficient levels, and they cannot be practically used as photosensitive materials for exposure with lasers. In general, it is essential to incorporate a dye into silver halide photosensitive materials for preventing halation or irradiation in order to improve image sharpness. Such a dye must function upon exposing imagewise, but must not impart any color to the formed images after it functions. Therefore, a dye used in photothermographic materials is required to have an optical function of absorbing light at a wavelength used for exposure of silver halide emulsion as well as a property that it is unlikely to be detected in the meaning of luminosity factor or a function of being removed from the photographic light-sensitive materials or being decolorized by development.

A photothermographic material for exposure with blue laser is disclosed in JP-A-2000-305213. However, satisfactory design is not disclosed against reduction of sharpness due to scattering of laser light, and the photosensitive material disclosed in this reference shows poor sharpness.

In order to improve image storability of photothermographic materials, various means for improving developing agents, additives, binders and so forth have been examined. However, any photothermographic material showing satisfactory image storability comparable to that of photosensitive materials of wet development type has not been developed so far. Further, while such functions as described above are required for dyes used in photothermographic materials, dyes having such functions, especially such dyes absorbing blue lights, have not been proposed yet thus far.

SUMMARY OF THE INVENTION

The present invention was accomplished in view of the aforementioned various problems, and its object is to provide a photothermographic material that exhibits high image storability and can form an image of superior sharpness and little residual color. Another object of the present invention is to provide an image formation method that can form an image of high image storability, superior sharpness and little residual color.

In order to achieve the aforementioned objects, the photothermographic material of the present invention is a photothermographic material comprising a support, a photosensitive layer containing a silver halide having a silver iodide content of 10 mol % or more and a reducing agent and a non-photosensitive layer provided on the support, wherein at least one of the photosensitive layer and the non-photosensitive layer contains a dye showing an absorption maximum in a wavelength range of 350 nm to 430 nm.

As preferred embodiments of the present invention, there are provided the aforementioned photothermographic material, wherein the silver iodide content of the silver halide is 40% or more; the aforementioned photothermographic material, which further contains a decolorizing agent in at least one of the photosensitive layer and the non-photosensitive layer; and the aforementioned photothermographic material, wherein the dye is in a state of solid microparticle dispersion or in an aggregated state.

As preferred embodiments of the present invention, there are also provided the aforementioned photothermographic material, wherein the dye has a polymethine chromophore; the aforementioned photothermographic material, wherein the dye is a polymethine dye of intramolecular cyclization type that is cyclized by an action of a base and thereby decolorized; and the aforementioned photothermographic material, wherein the dye is a polymethine dye having a polymethine group and a group that can form a nucleophilic moiety by an action of a base at a position where the group can form a 5- to 7-membered ring through a reaction with the polymethine group.

As a preferred embodiment of the present invention, there is further provided the aforementioned photothermographic material, wherein the dye is represented by the following formula (1) or (2).

Formula (1)

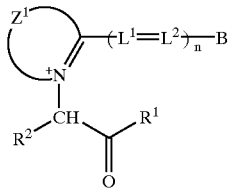

Formula (2)

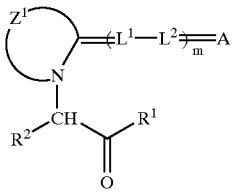

In the formulas, $R^1$ represents a hydrogen atom, an aliphatic group, an aromatic group, $—NR^{21}R^{26}$, $—OR^{21}$ or $—SR^{21}$, where $R^{21}$ and $R^{26}$ each independently represent a hydrogen atom, an aliphatic group or an aromatic group, or $R^{21}$ and $R^{26}$ bond to each other to form a nitrogen-containing heterocyclic ring. $R^2$ represents a hydrogen atom, an aliphatic group or an aromatic group, and $R^1$ and $R^2$ may bond to each other to form a 5- or 6-membered ring. $L^1$ and $L^2$ each independently represent a substituted or unsubstituted methine, and substituents of the methine may bond to each other to form an unsaturated aliphatic ring or unsaturated heterocyclic ring. $Z^1$ represents a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent. A represents an acidic nucleus, and B represents an aromatic group, an unsaturated heterocyclic ring group or a group of the following formula (3). n and m each represent 1, 2 or 3.

Formula (3)

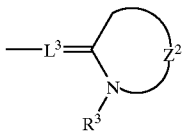

In the formula (3), $L^3$ represents a substituted or unsubstituted methine, and it may bond to $L^2$ to form an unsaturated aliphatic ring or an unsaturated heterocyclic ring. $R^3$ represents an aliphatic group or an aromatic group. $Z^2$ represents a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent.

Further, in order to achieve the aforementioned object, the image formation method of the present invention comprises exposing the photothermographic material of the present invention with a laser light having an emission peak at 350 nm to 430 nm to record an image.

According to the present invention, there can be provided a photothermographic material exhibiting high image quality, superior color tone and superior image stability after development and an image formation method utilizing the same.

BEST MODE FOR CARRYING OUT THE INVENTION

The photothermographic material of the present invention will be explained in detail hereafter.

The photothermographic material of the present invention contains a dye showing an absorption maximum at 350 nm to 430 nm in either of a photosensitive layer and a non-photosensitive layer. The dye shows an absorption maximum preferably at 380 nm to 420 nm, particularly preferably at 380 nm to 410 nm. The layer containing the dye showing an absorption maximum at 350 nm to 430 nm is preferably a photosensitive layer, a non-photosensitive layer on the support side relative to a photosensitive layer (this layer may be an antihalation layer) or a non-photosensitive layer on the side opposite to a photosensitive layer with respect to the support, i.e., on the back side.

In the photothermographic material of the present invention, type of the aforementioned dye is not particularly limited so long as it shows an absorption maximum at 350 nm to 430 nm. The absorption maximum shown at 350 nm to 430 nm may be main absorption or sub-absorption. Specific examples of the dye showing an absorption maximum at 350 nm to 430 nm include azo dyes, azomethine dyes, quinone type dyes (e.g., anthraquinone dyes, naphthoquinone dyes etc.), quinoline dyes (e.g., quinophthalone dyes etc.), methine dyes (e.g., cyanine dyes, melocyanine dyes, oxonol dyes, stilyl dyes, arylidene dyes, aminobutadiene dyes etc. including polymethine dyes), carbonium dyes (e.g., diphenylmethane dyes, triphenylmethane dyes, xanthene dyes and cationic dyes such as acridine dyes), azine dyes (e.g., cationic dyes such as thiazine dyes, oxazine dyes and phenazine dyes), aza[18] π-electron type dyes (e.g., porphin dyes, tetraazaporphin dyes, phthalocyanine dyes etc.), indigoid dyes (e.g., indigo dyes, thioindigo dyes etc.), squarilium dyes, croconium dyes, pyromethene dyes, nitro and nitroso dyes, benzotriazol type dyes, triazine type dyes and so forth. Preferred are azo dyes, azomethine dyes, quinone dyes, quinoline dyes, methine dyes, aza[18] π-electron type dyes, indigoid dyes and pyromethene dyes, more preferred are azo dyes, azomethine dyes and methine dyes, and particularly preferred are methine dyes. These dyes may be in a state of solid microparticle dispersion or an aggregated state (including liquid crystal state), and two or more kinds of dyes may be used in combination.

Use of a dye showing a strong absorption at a wavelength for the light exposure as the dye used for the photothermographic material is preferred, because such a dye can reduce the coating amount of the dye. Therefore, the dye used in the present invention is preferably a dye showing a sharp absorption spectrum peak with a narrow half width or preferably used in a state that provides such absorption. If the dye is used in a state of solid microparticle dispersion or in an aggregated state, the absorption favorably becomes stronger and the absorption spectrum peak favorably becomes sharper. In order to form aggregates of the dye, a dye having an ionic hydrophilic group is preferably used. The half width of the absorption of the dye is preferably 100 nm or less, more preferably 75 nm or less, still more preferably 50 nm or less.

In the photothermographic material of the present invention, the dye may be decolorized or may not be decolorized after image formation. When the dye is not decolorized (referred to as "non-decolorization" hereinafter), the dye is preferably unobservable in the meaning of luminosity factor, and a larger ratio calculated by dividing absorption at the light exposure wavelength with absorption at 425 nm is preferred. For example, when the light exposure recording is performed by using a semiconductor laser emitting a light with a wavelength of 405 nm, the absorption ratio of absorption at 405 nm/absorption at 425 nm is preferably 5 or more, more preferably 10 or more, particularly preferably 15 or more.

Examples of such a dye include aminobutadiene type dyes, melocyanine dyes in which an acidic nucleus and a basic nucleus are directly bonded, and polymethine dyes. If the dye of the non-decolorization type used for the present invention is water-soluble, it can be added as an aqueous solution.

It is also preferable to decolorize the dye in the course of the heat development. The following methods are known as the method for decolorization of dye, and any of these may be used.

(1) Methods of decolorizing a coloring agent (dye) consisting of an electron-donative coloring organic compound and an acidic color developer by reacting it with a particular decolorizing agent during heat development, as disclosed in JP-A-9-34077 and JP-A-2001-51371;

(2) Methods of decolorizing a decolorizing dye by using a combination of a compound generating a radical by light irradiation or heating and the decolorizing dye, as disclosed in JP-A-9-133984, JP-A-2000-29168, JP-A-2000-284403 and JP-A-2000-347341;

(3) Methods of decolorizing a decolorizing dye by using a combination of a compound generating a base or nucleophilic agent upon heating and the decolorizing dye, as disclosed in U.S. Pat. Nos. 5,135,842, 5,258,724, 5,314,795, 5,324,627, 5,384,237, JP-A-3-26765, JP-A-6-222504, JP-A-6-222505 and JP-A-7-36145;

(4) Methods of decolorizing a dye by intramolecular cyclization reaction of the dye caused by thermal degradation of the dye itself, as disclosed in U.S. Pat. No. 4,894,358, JP-A-2-289856 and JP-A-59-182436;

(5) Methods of decolorizing a decolorizing dye of intramolecular cyclization type showing extremely good decolorization property by using a combination of the dye and a base or base precursor, as disclosed in JP-A-6-82948, JP-A-11-231457, JP-A-2000-112058, JP-A-2000-281923 and Japanese Patent Application No. 2000-365080.

Among those mentioned above, a combination of a decolorizing agent (including radical generating agent, base precursor and nucleophilic agent-generating agent) and a decolorizing dye is preferred, since both of decolorization property during heat development and storage stability of undeveloped materials can be easily satisfied with such a combination. In particular, a combination of decolorizing dye of intramolecular cyclization type and a base precursor is more preferred, since the decolorization property and the stability can be satisfied at a higher order with such a combination.

Among the decolorizing dyes of intramolecular cyclization type, preferred are dyes having a polymethine chromophore, and more preferred are polymethine dyes having a group that can form a nucleophilic moiety by an action of a base at a position where the group can form a 5- to 7-membered ring through a reaction with a polymethine moiety. Particularly preferred are polymethine dyes having a group that can be converted into a nucleophilic group by dissociation at a position where the group can form a 5- to 7-membered ring, such as those dyes represented by the following formula (1) or (2).

In the present invention, it is preferable to use a dye represented by the following formula (1) or (2).

Formula (1)

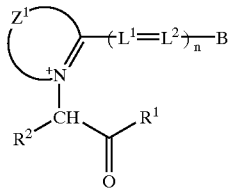

Formula (2)

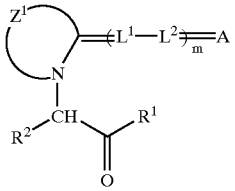

In the formulas (1) and (2), $R^1$ represents a hydrogen atom, an aliphatic group, an aromatic group, —$NR^{21}R^{26}$, —$OR^{21}$ or —$SR^{21}$, where $R^{21}$ and $R^{26}$ each independently represent a hydrogen atom, an aliphatic group or an aromatic group, or $R^{21}$ and $R^{26}$ bond to each other to form a nitrogen-containing heterocyclic ring. $R^2$ represents a hydrogen atom, an aliphatic group or an aromatic group, and $R^1$ and $R^2$ may bond to each other to form a 5- or 6-membered ring. $L^1$ and $L^2$ each independently represent a substituted or unsubstituted methine, and substituents of the methine may bond to each other to form an unsaturated aliphatic ring or unsaturated heterocyclic ring. $Z^1$ represents a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent. A represents an acidic nucleus, and B represents an aromatic group, an unsaturated heterocyclic ring group or a group of the following formula (3). n and m each represent an integer of 1–3. When n and m each represent 2 or more, two or more of $L^1$ and $L^2$ may be identical to or different from each other or one another, respectively.

Formula (3)

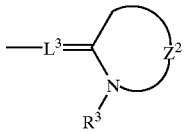

In the formula (3), $L^3$ represents a substituted or unsubstituted methine, and it may bond to $L^2$to form an unsaturated aliphatic ring or an unsaturated heterocyclic ring. $R^3$ represents an aliphatic group or an aromatic group. $Z^2$ represents a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent.

In the formulas, $R^1$ represents a hydrogen atom, an aliphatic group, an aromatic group, —$NR^{21}R^{26}$, —$OR^{21}$ or —$SR^{21}$, where $R^{21}$ and $R^{26}$ each independently represent a hydrogen atom, an aliphatic group or an aromatic group, or $R^{21}$ and $R^{26}$ bond to each other to form a nitrogen-containing heterocyclic ring. $R^1$ preferably represents —$NR^{21}R^{26}$, —$OR^{21}$ or —$SR^{21}$. $R^{21}$ preferably represents an aliphatic group or an aromatic group, more preferably an unsubstituted alkyl group, a substituted alkyl group, an unsubstituted aralkyl group, a substituted aralkyl group, an unsubstituted aryl group or a substituted aryl group. $R^{26}$ preferably represents a hydrogen atom or an aliphatic group, more preferably a hydrogen atom, an unsubstituted alkyl group or a substituted alkyl group. The nitrogen-containing heterocyclic group formed by $R^{21}$ and $R^{26}$ bonding to each other is preferably a 5- or 6-membered ring. The nitrogen-containing heterocyclic group may contain a hetero atom other than nitrogen (e.g., oxygen atom, sulfur atom).

In the present specification, the "aliphatic group" means an unsubstituted alkyl group, a substituted alkyl group, an unsubstituted alkenyl group, a substituted alkenyl group, an unsubstituted alkynyl group, a substituted alkynyl group, an unsubstituted aralkyl group or a substituted aralkyl group. In the present invention, an unsubstituted alkyl group, a substituted alkyl group, an unsubstituted alkenyl group, a substituted alkenyl group, an unsubstituted aralkyl group or a substituted aralkyl group is preferred, and an unsubstituted alkyl group, a substituted alkyl group, an unsubstituted aralkyl group or a substituted aralkyl group is more preferred. A chain-like aliphatic group is more preferred than a cyclic aliphatic group. The chain-like aliphatic group may be branched. The unsubstituted alkyl group has preferably 1–30 carbon atoms, more preferably 1–15 carbon atoms, still more preferably 1–10 carbon atoms, most preferably 1–8 carbon atoms. The preferred range of the alkyl moiety of the substituted alkyl group is the same as that of the unsubstituted alkyl group.

The unsubstituted alkenyl group and unsubstituted alkynyl group have preferably 2–30 carbon atoms, more preferably 2–15 carbon atoms, still more preferably 2–12 carbon atoms, most preferably 2–8 carbon atoms. The preferred ranges of the alkenyl moiety of the substituted alkenyl group and the alkynyl moiety of the substituted alkynyl group are the same as those of the unsubstituted alkenyl group and the unsubstituted alkynyl group, respectively. The unsubstituted aralkyl group has preferably 7–35 carbon atoms, more preferably 7–20 carbon atoms, still more preferably 7–15 carbon atoms, most preferably 7–10 carbon atoms. The preferred range of the aralkyl moiety of the substituted aralkyl group is the same as that of the unsubstituted aralkyl group.

Examples of the substituent of the aliphatic group (substituted alkyl group, substituted alkenyl group, substituted alkynyl group and substituted aralkyl group) include a halogen atom (fluorine atom, chlorine atom, bromine atom), a hydroxyl group, an alkoxy group, an aryloxy group, a silyloxy group, a hetelocyclyloxy group, an acyloxy group, a carbamoyloxy group, an alkoxycarbonyloxy group, an aryloxycarbonyloxy group, a nitro group, a sulfo group, a carboxyl group, an acyl group, an alkoxycarbonyl group, an aryloxycarbonyl group, a carbamoyl group, an alkylthiocarbonyl group, a heterocyclic group, a cyano group, an amino group (including an anilino group), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclylthio group, a sulfamoyl group, an alkyl- or arylsulfinyl group, an alkyl- or arylsulfonyl group, an alkoxycarbonyl group, an imido group, a phosphino group, a phosphinyl group, a phosphinyloxy group, a phosphinylamino group, a phosphono group and a silyl group. The carboxyl group, sulfo group and phosphono group may be in the form of salt. The cation forming a salt with the carboxyl group, phosphono group or sulfo group is preferably an ammonium ion or an alkali metal ion (e.g., lithium ion, sodium ion, potassium ion).

In the present specification, the "aromatic group" means an unsubstituted aryl group or a substituted aryl group. The unsubstituted aryl group has preferably 6–30 carbon atoms, more preferably 6–20 carbon atoms, still more preferably 6–15 carbon atoms, most preferably 6–12 carbon atoms. The preferred range of the aryl moiety of the substituted aryl group is the same as that of the unsubstituted aryl group. As examples of the substituent of the aromatic group (substituted aryl group), those mentioned as examples of the aliphatic group and the substituent of the aliphatic group can be mentioned.

In the aforementioned formulas (1) and (2), $R^2$ represents a hydrogen atom, an aliphatic group or an aromatic group, and $R^1$ and $R^2$ may bond to each other to form a 5- or 6-membered ring. The aliphatic group and the aromatic group have the same meanings as defined above. $R^2$ is preferably a hydrogen atom or an aliphatic group, more preferably a hydrogen atom or an alkyl group, still more preferably a hydrogen atom or an alkyl group having 1–15 carbon atoms, most preferably a hydrogen atom.

In the aforementioned formulas (1), (2) and (3), $L^1$, $L^2$ and $L^3$ each independently represent a substituted or unsubstituted methine, and substituents of the methine may bond to each other to form an unsaturated aliphatic ring or unsaturated heterocyclic ring. Examples of the substituent of the methine include a halogen atom, an aliphatic group and an aromatic group. The aliphatic group and aromatic group have the same meanings as defined above. Substituents of the methine may bond to each other to form an unsaturated aliphatic ring or unsaturated heterocyclic ring. An unsaturated aliphatic group is more preferred than an unsaturated heterocyclic group. The formed ring is preferably a 5- or 5-membered ring, more preferably a cyclopentene ring or cyclohexene ring. The methine is particularly preferably an unsubstituted methine or a methine substituted with an alkyl group or an aryl group at the meso position.

In the aforementioned formula (1), n represents an integer of 1–3, and it is preferably 1 or 2. When n is 2 or more, the repeating methines are identical to or different from each other or one another. In the aforementioned formula (2), m represents an integer of 1–3, and it is preferably 1 or 2. When m is 2 or more, the repeating methines are identical to or different from each other or one another.

In the aforementioned formulas (1) and (2), $Z^1$ represents a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent. Examples of the nitrogen-containing heterocyclic ring include oxazole ring, thiazole ring, selenazole ring, pyrrole ring, pyrroline ring, imidazole ring and pyridine ring. A 5-membered ring is more preferred than a 6-membered ring. An aromatic ring (benzene ring, naphthalene ring) may condense to the nitrogen-containing heterocyclic ring. The nitrogen-containing heterocyclic ring and the ring condensed thereto may have a substituent. Although examples of the substituent include the substituents of the aromatic group mentioned above, the substituent is preferably a halogen atom (fluorine atom, chlorine atom, bromine atom), a hydroxyl group, a nitro group, a carboxyl group, a sulfo group, an alkoxy group, an aryl group or an alkyl group. The carboxyl group and sulfo group may be in the form of salt. The cation forming a salt with the carboxyl group or sulfo group is preferably an ammonium ion or an alkali metal ion (e.g., sodium ion, potassium ion).

In the formula (1), B represents an aromatic group, an unsaturated heterocyclic ring group or a group of the following formula (3). The aromatic group has the same meaning as defined above. The aromatic group represented by B is preferably a substituted or unsubstituted phenyl group, and the substituent is preferably a halogen atom, an amino group, an acylamino group, an alkoxy group, an aryloxy group, an alkyl group, an alkylthio group or an aryl group, particularly preferably an amino group, an acylamino group, an alkoxy group or an alkyl group at the 4-position. The unsaturated heterocyclic group represented by B is preferably a 5- or 6-membered heterocyclic group constituted by atoms selected from carbon, oxygen, nitrogen and sulfur atoms. A 5-membered ring is particularly preferred. Preferred examples are pyrrole, indole, thiophene and furan, which may be substituted or unsubstituted.

In the aforementioned formula (3), $Z^2$ represents a group required to complete a 5- or 6-membered nitrogen-containing heterocyclic ring, and it may be identical to or different from $Z^1$. Examples of the nitrogen-containing heterocyclic ring are the same as those exemplified above for $Z^1$. In the aforementioned formula (3), $R^3$ represents an aliphatic group or an aromatic group, preferably an aliphatic group, most preferably —$CHR^2(COR^1)$ as a substituent on the nitrogen atom included in the aforementioned formula (1).

In the aforementioned formula (2), A represents an acidic nucleus. The acidic nucleus is preferably a group formed by eliminating one or more (usually 2) hydrogen atoms from a cyclic ketomethylene compound or a compound having a methylene group between electron-withdrawing groups. Examples of the cyclic ketomethylene compound include 2-pyrazolin-5-one, rhodanine, hydantoin, thiohydantoin, 2,4-oxazolidinedione, isoxazolone, barbituric acid, thiobarbituric acid, indanedione, dioxopyrazolo-pyridine, Meldrum's acid, hydroxypyridine, pyrazolidinedione, 2,5-dihydro-dihydrofrun-2-one and pyrrolin-2-one. These may have a substituent.

The compound having a methylene group between electron-withdrawing groups can be represented as $Z^aCH_2Z^b$. $Z^a$ and $Z^b$ each independently represent —CN, —$SO_2R^{a1}$, —$COR^{a1}$, —$COOR^{a2}$, —$CONHR^{a2}$, —$SO_2NHR^{a2}$, —$C[{=}C(CN)_2]R^{a1}$ or —$C[{=}C(CN)_2]NHR^{a1}$, where $R^{a1}$ represents an alkyl group, an aryl group or a heterocyclic group, $R^{a2}$ represents a hydrogen atom, an alkyl group, an aryl group or a heterocyclic group, and $R^{a1}$ and $R^{a2}$ each may have a substituent. Among these acidic nuclei, 2-pyrazolin-5-one, isoxazolone, barbituric acid, indanedione, hydroxypyridine, pyrazolidinedione and dioxopyrazolopyridine are more preferred.

The dye represented by the aforementioned formula (1) preferably forms a salt with an anion. When the dye represented by the aforementioned formula (1) has an anionic group such as carboxyl group or sulfo group as a substituent, the dye can form an intramolecular salt. Other than such a case, the dye preferably forms a salt with an extramolecular anion. The anion is preferably a monovalent or divalent anion, more preferably a monovalent anion. Examples of the anion include a halogen ion ($Cl^-$, $Br^-$, $I^-$), p-toluenesulfonate ion, ethylsulfate ion, 1,5-disulfonaphthalene dianion, $PF_6^-$, $BF_4^-$, and $ClO_4^-$.

Although the dyes represented by the aforementioned formula (1) or (2) may be used in a state of molecular dispersion, they are preferably used in a state of solid microparticle dispersion or an aggregated state. For the formation of aggregates of the dye, the dye preferably has an ionic hydrophilic group. Examples of the ionic hydrophilic group include a sulfo group, a carboxyl group, a phosphono group, a quaternary ammonium group and so forth. As the aforementioned ionic hydrophilic group, a carboxyl group, a phosphono group and a sulfo group are preferred, and a carboxyl group and a sulfo group are particularly preferred. The carboxyl group, phosphono group and sulfo group may be in the form of a salt, and examples of a counter ion forming the salt include an ammonium ion, an alkali metal ion (e.g., lithium ion, sodium ion, potassium ion) and an organic cation (e.g., tetramethylammonium ion, tetramethylguanidium ion, tetramethylphosphonium ion).

Formulas of aminobutadiene type dyes and melocyanine dyes preferably used for the present invention as the non-discolorization dyes are mentioned below.

Formula (4)

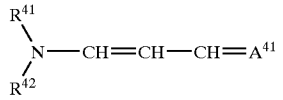

In the formula, $R^{41}$ and $R^{42}$ each independently represent a hydrogen atom, an aliphatic group, an aromatic group or a nonmetallic atom group required to form a 5- or 6-membered ring when they bond to each other. Further, either $R^{41}$ or $R^{42}$ may bond to a methine group adjacent to the nitrogen atom to form a 5- or 6-membered ring. $A^{41}$ represents an acidic nucleus.

Formula (5)

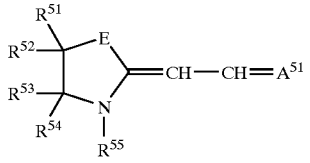

In the formula, $R^{51}$ to $R^{55}$ each independently represent a hydrogen atom, an aliphatic group or an aromatic group, and $R^{51}$ and $R^{54}$ may together form a double bond. When $R^{51}$ and $R^{54}$ together form a double bond, $R^{52}$ and $R^{53}$ may bond to each other to form a benzene ring or a naphthalene ring. $R^{55}$ represents an aliphatic group or an aromatic group, E represents an oxygen atom, a sulfur atom, an ethylene group, >N—$R^{56}$ or >$C(R^{57})(R^{58})$, where $R^{56}$ represents an aliphatic group or an aromatic group, and $R^{57}$ and $R^{58}$ each independently represent a hydrogen atom or an aliphatic group. $A^{51}$ represents an acidic nucleus.

Formula (6)

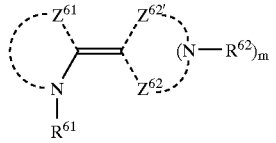

In the formula, $R^{61}$ represents a hydrogen atom, an aliphatic group or an aromatic group. $R^{62}$ represents a hydrogen atom, an aliphatic group or an aromatic group. $Z^{61}$ represents a group required to form a nitrogen-containing heterocyclic ring. $Z^{62}$ and $Z^{62'}$ represent a group required to form a heterocyclic ring or a non-cyclic acidic end group together with $(N—R^{62})_m$. A ring may condense to $Z^{61}$ or $Z^{62}$ and $Z^{62'}$. m represents 0 or 1.

Hereafter, the dyes represented by the formula (4), (5) or (6) will be explained in detail.

In the formulas (4), (5) and (6), the aliphatic group and aromatic group represented by $R^{41}$, $R^{42}$, $R^{51}$ to $R^{58}$, $R^{61}$ and $R^{62}$ have the same meanings as the aliphatic group and aromatic group represented by $R^1$, and examples of the substituent thereof include those similar to the examples of the substituent of $R^1$.

The acidic nucleus represented by $A^{41}$ or $A^{51}$ has the same meaning as the acidic nucleus represented by A in the formula (2), and it is preferably a group formed by eliminating one or more (usually 2) hydrogen atoms from a cyclic ketomethylene compound or a compound having a methylene group between electron-withdrawing groups. Examples of more preferred methylene compounds include those represented as $Z^aCH_2Z^b$ (the same as those mentioned in the explanation of A in the formula (2)), 2-pyrazolin-5-one, isoxazolone, barbituric acid, indanedione, Meldrum's acid, hydroxypyridine, pyrazolidinedione, dioxopyrazolopyridine and so forth. These may have a substituent.

Preferred examples of the 5- or 6-membered ring formed by $R^{41}$ and $R^{42}$ bonding to each other include pyrrolidine ring, piperidine ring, morpholine ring and so forth.

In the aforementioned formula (6), $Z^{61}$ is a group required to complete a 5- or 6-membered nitrogen-containing heterocyclic ring, an aromatic ring may condense to the nitrogen-containing heterocyclic ring, and the nitrogen-containing heterocyclic ring and a condensed ring thereof may have a substituent. Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, tellurazoline nucleus, tellurazole nucleus, benzotellurazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus, pyrimidine nucleus and so forth. Preferred are thiazoline nucleus, thiazole nucleus, benzothiazole nucleus, oxazoline nucleus, oxazole nucleus, benzoxazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus and 3-isoquinoline nucleus, more preferred are thiazoline nucleus, thiazole nucleus, benzothiazole nucleus, oxazoline nucleus, oxazole nucleus, benzoxazole nucleus, 3,3-dialkylindolenine nucleus (e.g., 3,3-dimethylindolenine), imidazoline nucleus, imidazole nucleus and benzimidazole nucleus, particularly preferred are thiazoline nucleus, thiazole nucleus, benzothiazole nucleus, oxazoline nucleus, oxazole nucleus and benzoxazole nucleus, and most preferred are thiazoline nucleus, oxazoline nucleus and benzoxazole nucleus. An aromatic ring (benzene ring, naphthalene ring) may condense to the nitrogen-containing heterocyclic ring. The nitrogen-containing heterocyclic ring and a ring condensed thereto may have a substituent. Examples of the substituent include the exemplary substituents of the aforementioned aromatic group, and preferred are a halogen atom (fluorine atom, chlorine atom, bromine atom), a hydroxyl group, a nitro group, a carboxyl group, a sulfo group, an alkoxy group, an aryl group and an alkyl group. The carboxyl group and sulfo group may be in the form of salt. The cation forming a salt with the carboxyl group or sulfo group is preferably an ammonium ion or an alkali metal ion (e.g., sodium ion, potassium ion).

$Z^{62}$ and $Z^{62'}$ represent a group required to form a heterocyclic ring or non-cyclic acidic end group together with $(N—R^{62})_m$. Although the heterocyclic ring may be any heterocyclic ring (preferably a 5- or 6-membered heterocyclic ring), it is preferably an acidic nucleus.

The acidic nucleus and non-cyclic acidic end group will be explained hereafter. The acidic nucleus and acidic end group may be an acid nucleus or acidic end group of any of ordinary melocyanine dyes. $Z^{62}$ is preferably a thiocarbonyl group, a carbonyl group, an ester group, an acyl group, a carbamoyl group, a cyano group or a sulfonyl group, more preferably a thiocarbonyl group or a carbonyl group. $Z^{62'}$ represents the reminder atomic group required to form the acid nucleus or non-cyclic acidic end group. When a non-cyclic acid end group is formed, it is preferably a thiocarbonyl group, a carbonyl group, an ester group, an acyl group, a carbamoyl group, a cyano group, a sulfonyl group or the like.

m is 0 or 1, preferably 1.

The acidic nucleus and non-cyclic acidic end group referred to herein are described in, for example, T. H. James, "The Theory of the Photographic Process, 4th Edition", Macmillan Publishing Co., Inc., 1977, pp.197–200. The non-cyclic acidic end group referred to herein means an acidic, i.e., electron-accepting type end group that does not form a ring.

The acidic nucleus and non-cyclic acidic end group are specifically described in U.S. Pat. Nos. 3,567,719, 3,575,869, 3,804,634, 3,837,862, 4,002,480, 4,925,777, JP-A-3-167546, U.S. Pat. Nos. 5,994,051, 5,747,236 and so forth.

The acidic nucleus is preferably a nitrogen-containing heterocyclic ring (preferably 5- or 6-membered nitrogen-containing heterocyclic ring) consisting of a carbon atom, a nitrogen atom and/or a chalcogen atom (typically an oxygen atom, a sulfur atom, a selenium atom and a tellurium atom), more preferably a 5- or 6-membered nitrogen-containing heterocyclic ring consisting of a carbon atom, a nitrogen atom and/or a chalcogen atom (typically an oxygen atom, a sulfur atom, a selenium atom and a tellurium atom) Specific examples thereof are nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxa-zolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo-[1,5-b]quinazolone, pyrazolo[1,5-a]benzimidazole, pyrazolopyridone, 1,2,3,4-tetrahydroquinoline-2,4-dione, 3-oxo-2,3-dihydro-benzo[d]thiophene-1,1-dioxide, 3-dicyanomethine-2,3-dihydro-benzo[d]thiophene-1,1-dioxide, a nucleus having an exo-methylene structure consisting of any of the foregoing nuclei in which a carbonyl or thiocarbonyl group constituting the nuclei substitutes at an active methylene site, a nucleus having an exo-methylene structure consisting of an active methylene compound having a structure of ketomethylene or cyanomethylene that serves as a starting material of the non-cyclic acidic end group which substitutes at an active methylene site, and a nucleus repeatedly comprising any of the foregoing nuclei.

Any of the substituents and rings mentioned above as examples of the substituent of the aforementioned aromatic group may substitute on or condense to these acidic nuclei or non-cyclic acidic end groups.

$Z^{62}$ and $Z^{62'}$ together with $(N—R^{62})_m$ preferably represent hydantoin, 2- or 4-thiohydantoin, 2-oxazolin-5-one, 2-thiooxazo-line-2,4-dione, thiazolidine-2,4-dione, rhodanine, thiazolidine-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid.

Particularly preferred are 2- or 4-thiohydantoin, 2-oxazolin-5-one and rhodanine.

When the dyes represented by the formulas (4) to (6) are water-soluble, they preferably have an ionic hydrophilic group. Examples and preferred examples of the ionic hydrophilic group are similar to those mentioned in the explanations of the formulas (1) and (2).

Specific examples of the dye preferably used for the present invention will be mentioned below. However, the dye used for the present invention is not limited to the following examples.

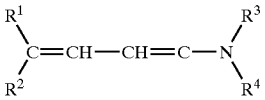

| No | —R¹ | —R² | —R³ | —R⁴ |
|---|---|---|---|---|
| 1 | —CN | —$CO_2CH_3$ | -$nC_4H_9$ | -$nC_4H_9$ |
| 2 | —CN | —CN | -$nC_6H_{13}$ | -$nC_6H_{13}$ |
| 3 | —CN | —$CO_2CH_2$— 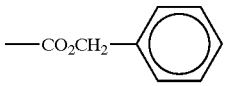 | 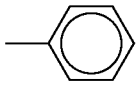 | -$nC_4H_9$ |
| 4 | —CN | —CN | 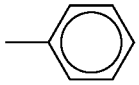 | -$nC_6H_{13}$ |
| 5 | —CN | —CN | 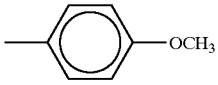 | —$C_2H_5$ |
| 6 | —$COCH_3$ | —$COCH_3$ | —$C_2H_5$ | —$C_2H_5$ |
| 7 | —$COCH_3$ | —$CO_2C_2H_5$ | —$C_2H_5$ | —$C_2H_5$ |
| 8 | —$COCH_3$ | —$CO_2C_2H_5$ | —$CH_2CH_2$—O—$CH_2CH_2$— | |
| 9 | —CO— 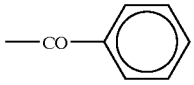 | —$CO_2C_2H_5$ | -$nC_6H_{13}$ | -$nC_6H_{13}$ |
| 10 | —$COCH_3$ | —$SO_2$— 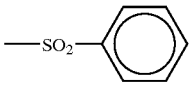 | —$C_2H_5$ | —$C_2H_5$ |
| 11 | —$COCH_3$ | —$SO_2$— 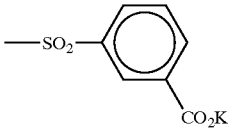 | —$CH_2CH_2SO_3K$ | —$CH_2CH_2SO_3K$ |
| 12 | —$COCH_3$ | —$SO_2$— 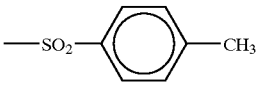 | —H | -$tC_4H_9$ |
| 13 | —$COCH_3$ | —$CONHCH_2CH_2SO_3Na$ | —$C_2H_5$ | —$C_2H_5$ |
| 14 | —$COCH_3$ | 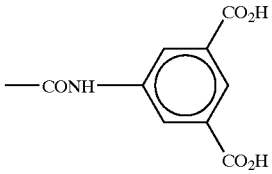 | —$(CH_2)_5$— | |

-continued
| | | | | |
|---|---|---|---|---|
| 15 | —CONH—$CO_2H$ | —CONH—$CO_2H$ | $-(CH_2)_4-$ | |
| 16 | $—CONHCH_2CH_2SO_3Na$ | $—CONHCH_2CH_2SO_3Na$ | $nC_3H_7$ | $nC_3H_7$ |
| 17 | $—COCH_3$ | $—CO_2C_2H_5$ | $—CH_2CH_2SO_3Na$ | $—CH_2CH_2SO_3Na$ |
| 18 | $—CO_2C_2H_5$ | $—CO_2C_2H_5$ | 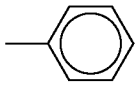 | $—CH_2CH_2SO_3Na$ |
19
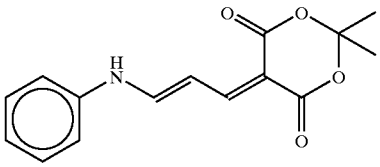
20
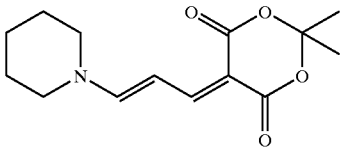
21
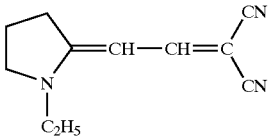
22
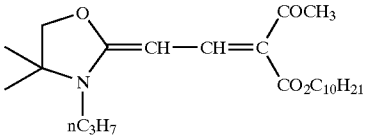
23
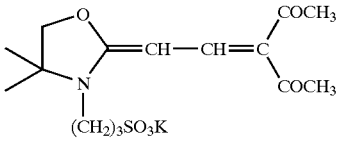
24
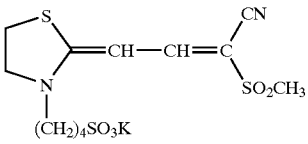
25
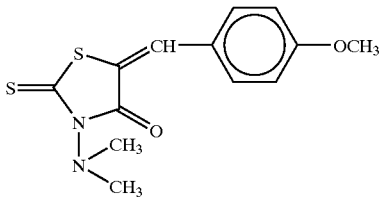
26
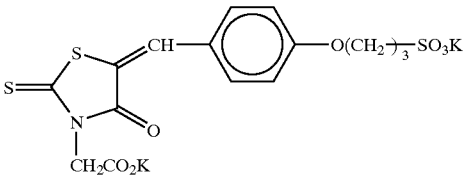

-continued
27
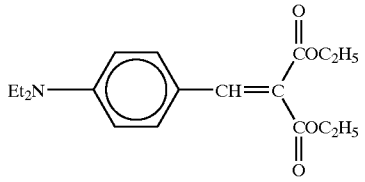
28
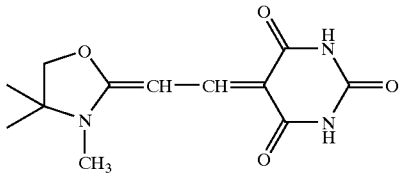
29
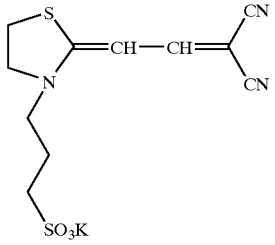
30
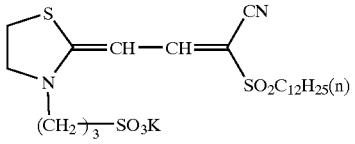
31
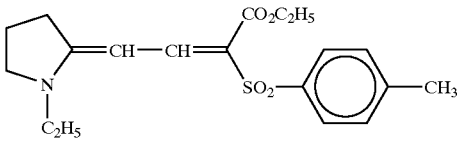
32
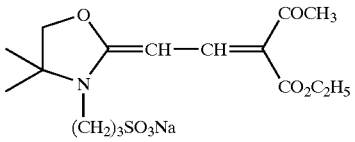
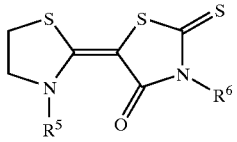
| No | $R^5$ | $R^6$ |
|---|---|---|
| 33 | $—C_2H_5$ | $—CH_2CO_2H$ |
| 34 | $-nC_6H_{13}$ | 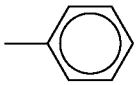 |
| 35 | 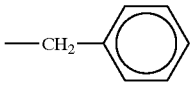 | $-nC_{12}H_{25}$ |
| 36 | $-(CH_2)_3-SO_3K$ | —H |

-continued
| | | |
|---|---|---|
| 37 | $-(CH_2)_4-SO_3H \cdot N(C_2H_5)_3$ | $-CH_2CO_2H$ |
| 38 | $-(CH_2)_3-SO_3Na$ | 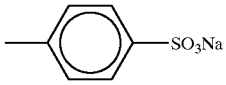 |
| 39 | $-nC_3H_7$ | $-(CH_2)-SO_3K$ |
40
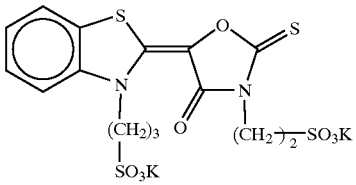
41
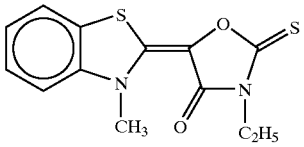
42
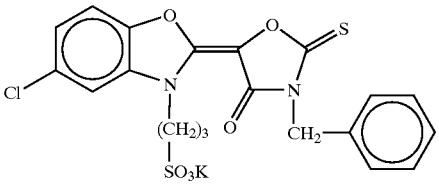
43
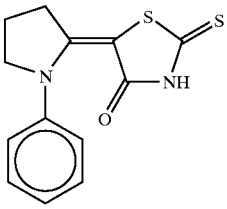
44
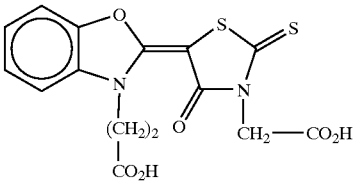
45
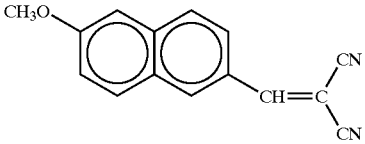
46
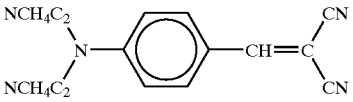
47
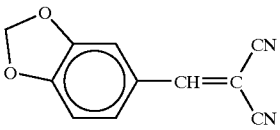

-continued
48
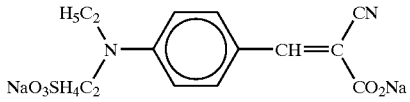
49
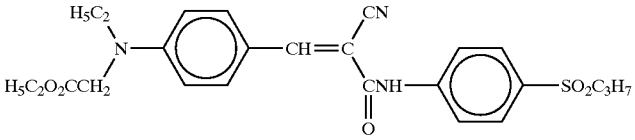
50
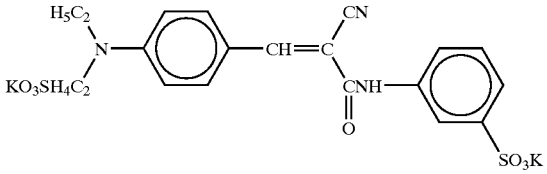
51
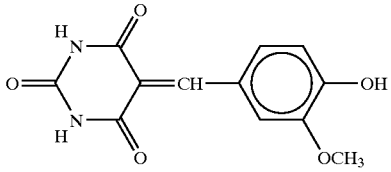
52
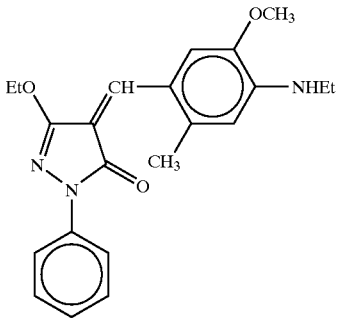
53
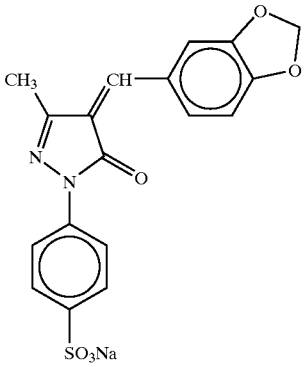
54
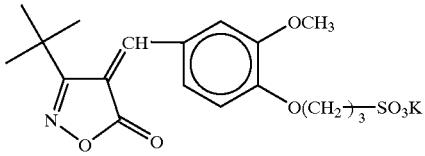

-continued
55
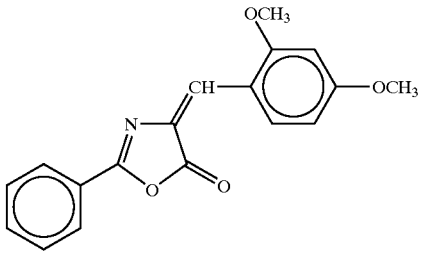
56
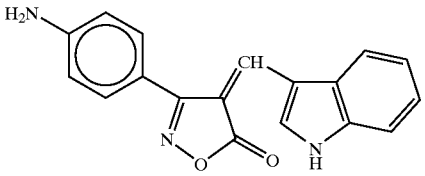
57
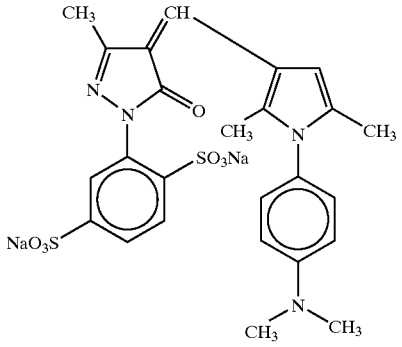
58
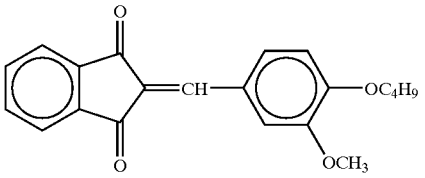
59
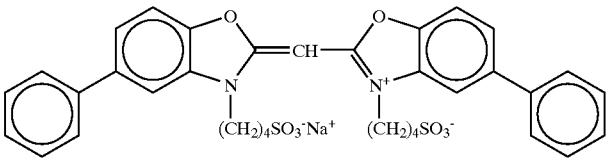
60
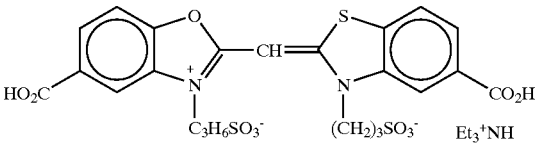
61
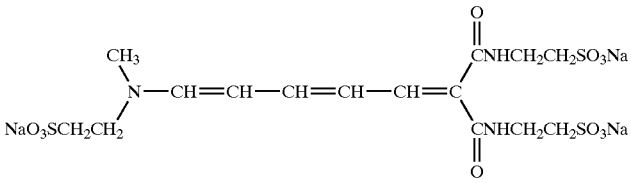

-continued
62
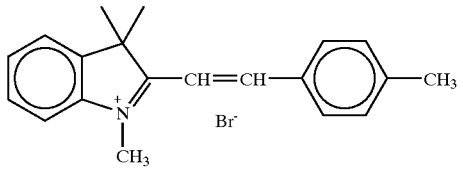
63
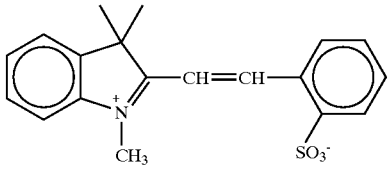
64
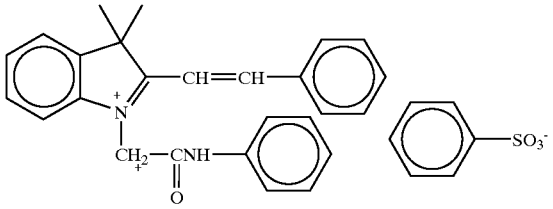
65
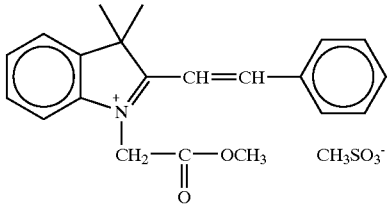
66
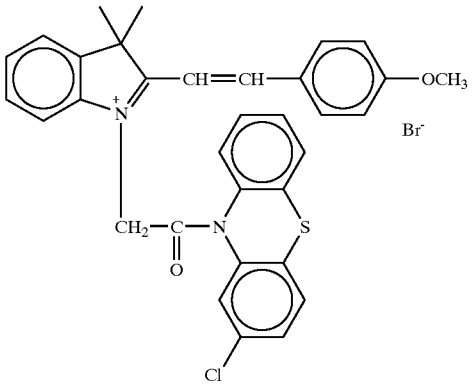
67
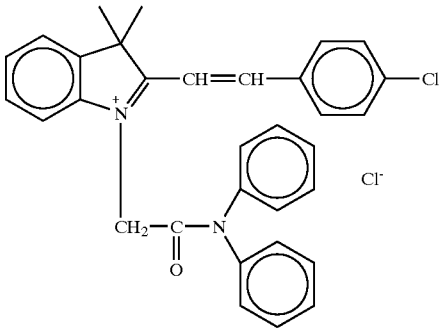

-continued
68
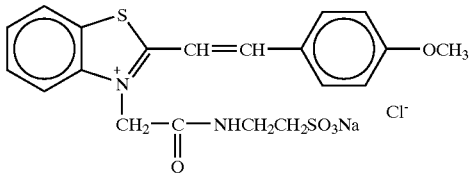
69
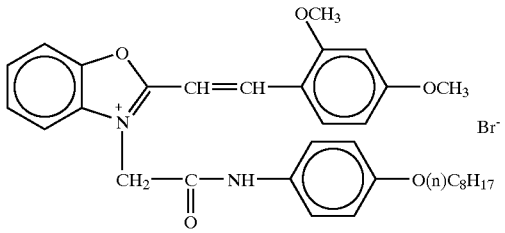
70
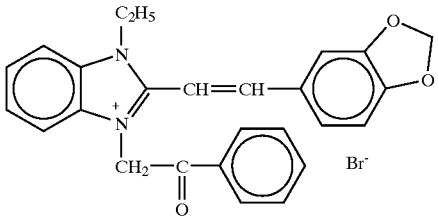
71
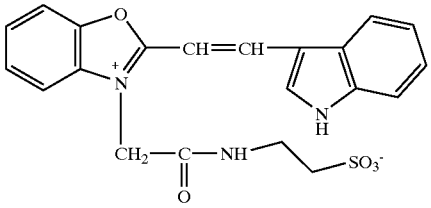
72
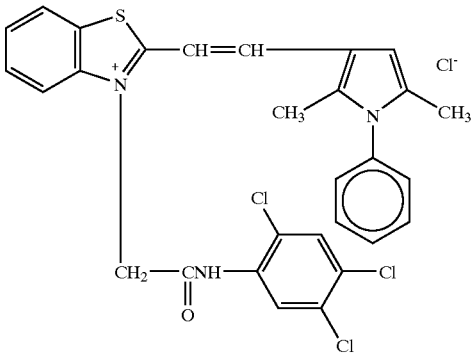
73
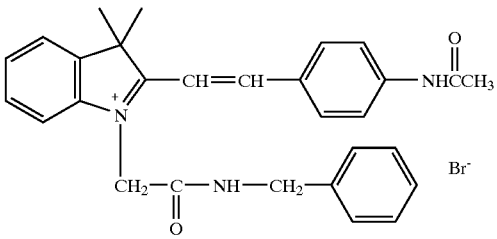

-continued
74
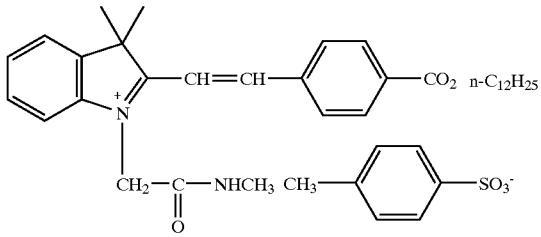
75
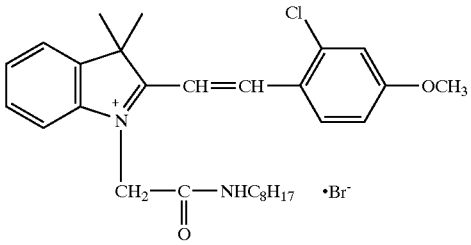
76
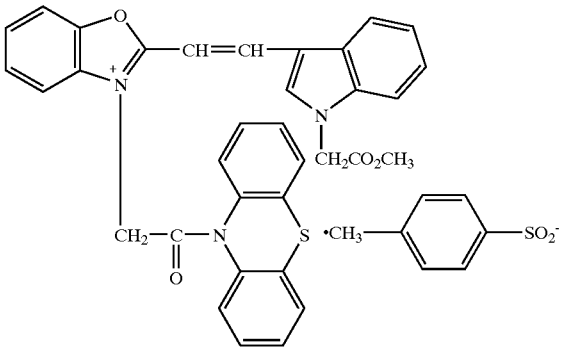
77
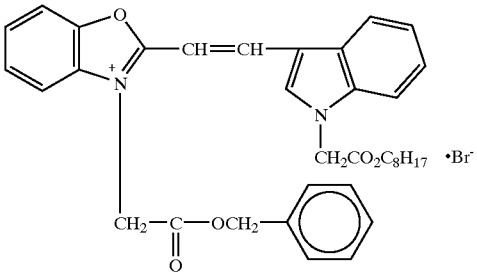
78
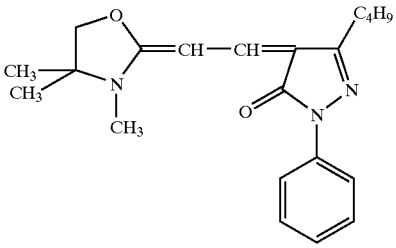

-continued
79
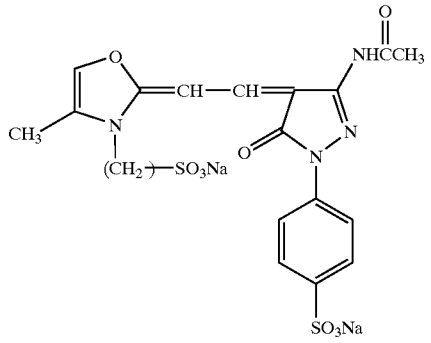
80
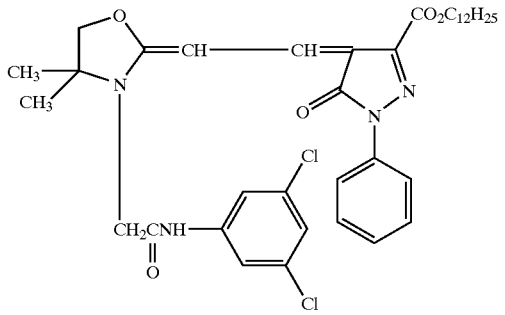
81
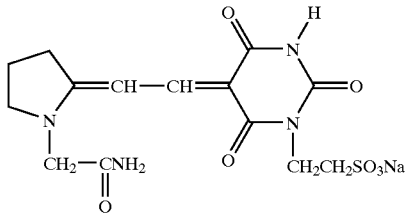
82
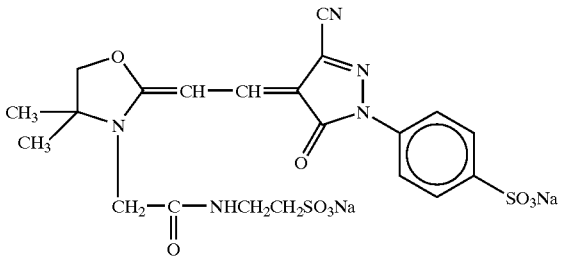
83
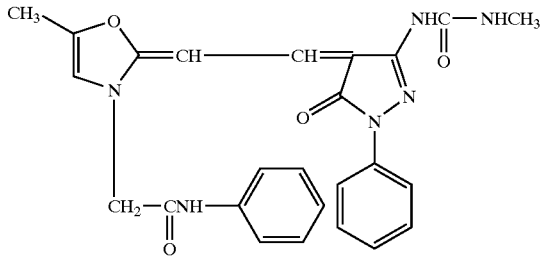

-continued
84
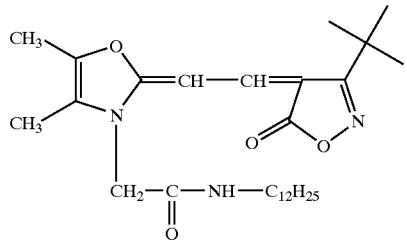
85
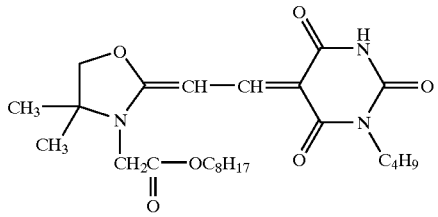
86
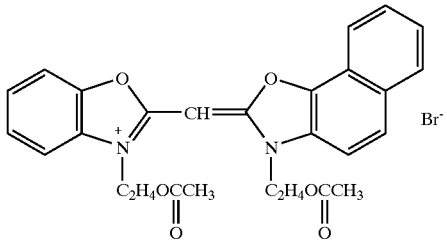
87
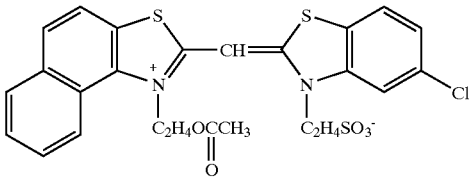
88
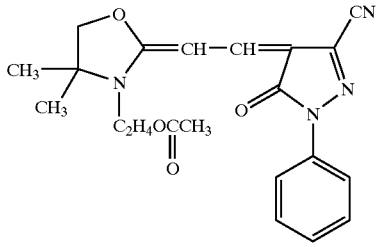
89
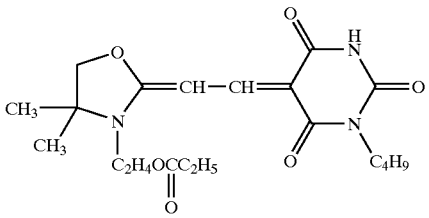
90
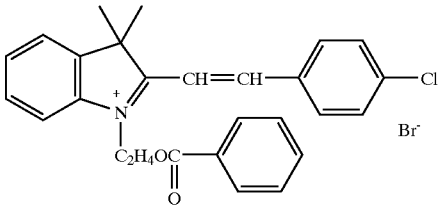

-continued

91

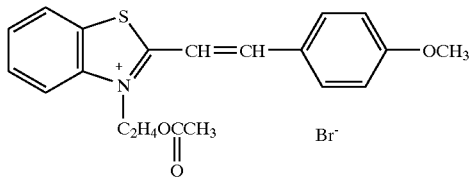

92

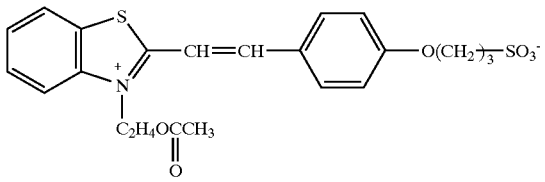

93

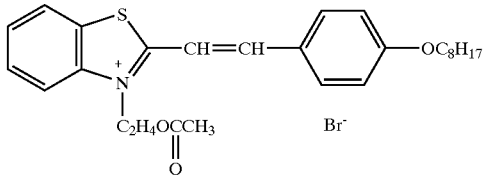

As for synthesis of the dye compounds used in the present invention, general synthesis methods are described in Frances Hamer, "The Cyanine Dyes and Related Compounds", Interscience Publishers, 1964. Specifically, they can be synthesized according to the descriptions of the aforementioned JP-A-11-231457, JP-A-2000-112058, JP-A-2000-86927 and JP-A-2000-86928.

When the aforementioned dye contained in the photothermographic material of the present invention is decolorized during the heat development, the decolorization can be attained by allowing a decolorizing agent to act on the dye with heating. In particular, in the dyes represented by the formulas (1) or (2), an active methylene group in the dyes is deprotonated by an action of a base, and a nucleophilic species generated thereby attacks the methylene chain in the molecule in a nucleophilic manner to form an intramolecularly cyclized compound and thereby attain decolorization. Therefore, a base usable for this reaction may be any base so long as it can deprotonate an active methylene group in the dyes. Although the number of atoms constituting the ring newly formed by the intramolecular cyclization reaction is not particularly limited, it is preferably a 5- to 7-membered ring, more preferably a 5- or 7-membered ring. A substantially colorless compound formed as described above is a stable compound, and it is not converted into the original dye. Therefore, the photothermographic material of the present invention does not suffer from a problem of colorization caused by conversion of a once decolorized dye into the original dye.

The temperature of heating for the decolorization reaction of the dye is preferably 40–200° C., more preferably 80–150° C., still more preferably 100–130° C., most preferably 115–125° C. The heating time is preferably 5–120 seconds, more preferably 10–60 seconds, still more preferably 12–30 seconds, most preferably 14–25 seconds. In addition, heating for the heat development can also be used in the photothermographic material. Further, it is preferable to use a heat-responsive type base precursor (described in detail later) that generates a base upon heating as described later. In such a case, the heating temperature and heating time actually used are determined by also considering temperature and time required for the heat development or temperature and time required for pyrolysis.

The decolorizing agent required for the decolorization reaction is preferably a radical, a nucleophilic agent, a base or a precursor thereof. When a dye represented by the aforementioned formula (1) or (2) is used, it is preferably decolorized by using a base or a base precursor. The base required for the decolorization reaction is a base of a wide sense, and it includes a nucleophilic agent (Lewis base), in addition to a base of a narrow sense. If the base coexists with the dye, the decolorization reaction may somewhat advance even at room temperature. Therefore, it is preferable to physically or chemically isolate the base from the dye and eliminate the isolation state when the decolorization should be attained so as to allow contact (reaction) between the base and the dye. As means for physically isolating the both, there are means of encapsulating at least one of the dye and the base in microcapsules; means of encapsulating at least one of the dye and the base in microparticles made of a heat-fusible material; and means of incorporating the dye and the base into different layers. As such microcapsules as mentioned above, there are those that are disrupted by pressure and those that are disrupted by heating. Since the aforementioned decolorization reaction readily advances with heating, it is convenient to use microcapsules that are disrupted by heating (heat-responsive microcapsules). For the isolation, at least one of the base or the dye is encapsulated into microcapsules. It is also possible to encapsulate the both in separate microcapsules. When outer layers of the microcapsules are opaque, it is preferable to add the dye to the outside of the microcapsules, and encapsulate the base in the microcapsules. Such heat-responsive microcapsules are described in Hiroyuki Moriga, "Nyumon Tokushu-shi no Kagaku (Introduction of Chemistry of Special Paper", 1975, JP-A-1-150575 and so forth.

As the heat-fusible material used for isolating the dye and the base, wax and so forth can be used. The isolation can be attained by incorporating one of the base or the dye (preferably the base) into microparticles of such heat-fusible material. Melting point of the heat-fusible material is preferably between room temperature and the temperature of heating at which the decolorization reaction advances. When separate layers containing the dye and the base are used to attain the isolation of the both, a barrier layer containing a heat-fusible material is preferably provided between the layers.

It is preferable to chemically isolate the dye and the base, since it can be easily attained. As means for chemically isolating the both, it is preferable to use, as the base, a precursor that can generate a base (including releasing a base) by heating. As for the aforementioned base precursor, typical base precursors are base precursors of pyrolysis type, in particular, base precursors of pyrolysis type (decarboxylation type) consisting of a salt of carboxylic acid with a base. When a base precursor of the decarboxylation type is heated, the carboxyl group of the carboxylic acid undergoes decarboxylation reaction to release an organic base. As the carboxylic acid constituting the base precursors of pyrolysis type, sulfonylacetic acid, propiolic acid and so forth can be used, which are readily decarboxylated. Sulfonylacetic acid, propiolic acid and so forth should preferably have an aromatic group capable of promoting decarboxylation (such as an aryl group or an unsaturated heterocyclic group) as a substituent. The base precursors in the form of sulfonylacetic acid salts are described in JP-A-59-168441, and the base precursors in the form of propiolic acid salts are described in JP-A-59-180537. The base components of the base precursors of decarboxylation type are preferably organic bases, more preferably amidines, guanidines or derivatives thereof. The organic bases are preferably diacidic bases, triacidic bases or tetraacidic bases, more preferably diacidic bases. Diacidic bases of amidine and guanidine derivatives are most preferred.

The precursors in the form of diacidic, triacidic or tetraacidic bases of amidine derivatives are described in Japanese Patent Publication (Kokoku, referred to as JP-B hereinafter) No. 7–59545, and the precursors in the form of diacidic, triacidic or tetraacidic bases of guanidine derivatives are described in JP-B-8-10321. The diacidic bases of amidine and guanidine derivatives are composed of (A) two of amidine or guanidine moieties, (B) substituents on the amidine or guanidine moieties, and (C) a divalent bridging group linking the two of amidine or guanidine moieties. Examples of the substituents (B) include an alkyl group (including a cycloalkyl group), an alkenyl groups, an alkynyl groups, an aralkyl group and a heterocyclic residue. Two or more of substituents may bond together to form a nitrogen-containing heterocyclic ring. The bridging group (C) is preferably an alkylene or phenylene group. As examples of the diacidic base precursors of amidine and guanidine derivatives, the base precursors described in JP-A-11-231457, Chemical Formulas 55 to 95 are preferably used in the present invention.

If the dye is decolorized, the optical density can be reduced to 0.1 or less after heat development. Two or more kinds of decolorization dyes may be used in combination in the photothermographic material. Similarly, two or more kinds of base precursors may be used in combination. In the heat decolorization using such a decolorization dye and a base precursor, it is preferable to use together a substance that reduces the melting point of the precursor by more than 3° C. (deg) when mixed with the base precursor as described in JP-A-11–352626 (e.g., diphenylsulfone, 4-chlorophenyl (phenyl)sulfone, 2-naphthyl benzoate etc.) in view of heat decolorization property and so forth.

The photothermographic material of the present invention has a layer containing the aforementioned dye. The layer preferably contains a binder together with the aforementioned dye. As the binder, a hydrophilic polymer (e.g., polyvinyl alcohol, gelatin) is preferably used. The amount of the dye can be determined depending on the intended use of the dye. Generally, in a photothermographic material, it is preferably used in such an amount in that the optical density (absorbance) measured at an objective wavelength should exceed 0.1. The optical density is preferably 0.2–2. The optical densities is more preferably 0.2–0.7. The amount of the dye for obtaining such optical density can be reduced by using aggregates, and the amount is generally about 0.001–0.2 g/m$^2$, preferably 0.001–0.1 g/m$^2$, more preferably 0.001–0.05 g/m$^2$. In addition, in an embodiment of the present invention where the dye is decolorized, the optical density can be reduced to 0.1 or less by the decolorization of the dye. Two or more kinds of dyes may be used together. Similarly, two or more kinds of base precursors may be used together. The amount (mole) of the base precursor used is preferably 1–100 times, more preferably 3–30 times, the amount (mole) of the dye used. The base precursor is preferably contained in one of layers of the photothermographic material in a dispersed state as solid microparticles.

The photothermographic material of the present invention generally has a non-photosensitive layer in addition to the photosensitive layer. Although the dye according to the present invention is added to at least one of photosensitive layers and non-photosensitive layers of the photothermographic material, it is preferably added at least one of non-photosensitive layers. It is more preferably added to both of the non-photosensitive layer and photosensitive layer. Non-photosensitive layers preferred for the addition of the dye include (1) an overcoat layer provided on the photosensitive layer (remoter side with respect to the support), (2) an intermediate layer provided between a plurality of photosensitive layers, (3) an undercoat layer provided between the photosensitive layer and the support, and (4) a back layer provided on the side of the support opposite to the side on which the photosensitive layer is provided.

It is also preferable to incorporate the dye and the decolorizing agent into a non-photosensitive layer so that the non-photosensitive layer should function as a filter layer or antihalation layer. The dye and decolorizing agent are preferably added to the same non-photosensitive layer. However, they may be separately added to two adjacent non-photosensitive layers. Further, a barrier layer may be provided between two of the non-photosensitive layers. The embodiment in which "a layer contains a dye and a decolorizing agent" mentioned in the present specification includes an embodiment where the dye and the decolorizing agent are contained in separate layers, if there are a plurality of layers.

As the method of adding the dye to a non-photosensitive layer, a method of adding solid microparticle dispersion or aggregate dispersion to a coating solution of the non-photosensitive layer is employable. This addition method is similar to the method of adding a dye to a usual photothermographic material.

The photothermographic material of the present invention is preferably exposed with a laser light showing an emission peak at a wavelength of 350 nm to 430 nm, more preferably 380 nm to 420 nm, further preferably 390 nm to 410 nm, at which the dye shows an absorption maximum.

It is important that the photosensitive silver halide used for the present invention should be used as emulsion of a high silver iodide content silver halide containing 10 mol % to 100 mol % of silver iodide in the halogen composition. By using silver halide containing silver iodide at a high content, sharpness is improved. High silver iodide content silver halide having a phase absorbing light at a wavelength of 350 nm to 420 nm by direct transition absorption is particularly preferred. In the wavelength range of 350 nm to 420 nm, which is a light exposure wavelength range preferably used for the present invention, absorption by the direct transition can be realized by the silver halide having a high silver iodide structure of the wurtzite structure of hexagonal system or the zinc blende structure of cubic system.

The average silver iodide content is more preferably 40 mol % to 100 mol %, further preferably 70 mol % to 100 mol %, particularly preferably 90 mol % to 100 mol %. With a higher silver iodide content, the advantage of the present invention is more markedly exerted.

The silver halide of the present invention preferably shows the direct transition absorption originating in the silver iodide crystal structure in the wavelength range of 350 nm to 420 nm. Light absorption by the direct transition of silver halide can be readily confirmed by presence of excitation absorption resulting from the direct transition at a wavelength around 400 nm to 430 nm.

Although such direct transition light absorption type high silver iodide content phase may independently exist, there is also preferably used such a phase existing in a conjugating state with silver halide exhibiting indirect transition absorption in a wavelength region of 350 nm to 420 nm, such as silver bromide emulsion, silver chloride emulsion, silver iodobromide emulsion and mixed crystals thereof.

The total silver iodide content of such conjugated grains is preferably 10 mol % to 100 mol %. The average silver iodide content is more preferably 40 mol % to 100 mol %, further preferably 70 mol % to 100 mol %, particularly preferably 90 mol % to 100 mol %.

The silver halide used for the present invention preferably has a mean grain size of 5 nm to 80 nm. In particular, smaller grains having a grain size of 80 nm or less are preferred for silver halide grains containing a phase exhibiting direct transition absorption, since it becomes easy to secure sensitivity with such a grain size. The grain size of photosensitive silver halide is more preferably 5–60 nm, further preferably 10–50 nm. The term "grain size" used herein means a diameter of a circle having the same area of a projected area of a grain (where silver halide grain is a tabular grain, projected area of the main plane is used).

Methods for the preparation of the photosensitive silver halide are well known in the art, and there can be used, for example, the methods described in Research Disclosure, No. 17029 (June, 1978) and U.S. Pat. No. 3,700,458. More specifically, a method can be used which comprises preparing photosensitive silver halide grains by addition of a silver-supplying compound and a halogen-supplying compound to a solution of gelatin or other polymer, and then mixing the resulting grains with a silver salt of an organic acid. The methods disclosed in JP-A-119374, paragraphs 0217 to 0224, JP-A-11-352627 and JP-A-2000-347335 are also preferred.

Examples of the form of silver halide grains include a cubic form, octahedral form, tabular form, spherical form, rod-like form, potato-like form, hexagonal pyramid form and so forth.

The surface index (Miller index) of outer surfaces of photosensitive silver halide grains is not particularly limited.

Silver halide grains having hexacyano-metal complex on their outermost surfaces are preferably used. Specific examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and so forth. In the present invention, hexacyano-Fe complexes are preferred. Since the hexacyano-metal complex exists in the form of an ion in an aqueous solution, its counter cation is not critical. However, it is preferable to use ions readily mixed with water and suitable for the precipitation operation of silver halide emulsions, for example, alkali metal ions such as sodium ion, potassium ion, rubidium ion, cesium ion and lithium ion, ammonium ions, alkylammonium ions (e.g., tetramethylammonium ions, tetraethylammonium ions, tetrapropylammonium ions, tetra(n-butyl)ammonium ions) and so forth.

The hexacyano-metal complex may be added to silver halide grains in the form of a solution in water or in a mixed solvent of water and an organic solvent miscible with water (for example, alcohols, ethers, glycols, ketones, esters, amides etc.), or in the form of a mixture thereof with gelatin.

The amount of the hexacyano-metal complex is preferably $1\times10^{-5}$ mole to $1\times10^{-2}$ mole, more preferably $1\times10^{-4}$ mole to $1\times10^{-3}$ mole, per mol of silver.

In order to make the hexacyano-metal complex exist on the outermost surfaces of silver halide grains, the hexacyano-metal complex is directly added before completion of the grain formation process, i.e., after the addition of an aqueous silver nitrate solution used for the grain formation and before chemical sensitization process where chalcogen sensitization such as sulfur sensitization, selenium sensitization or tellurium sensitization or noble metal sensitization such as gold sensitization is performed, during washing with water or dispersion operation or before the chemical sensitization. To prevent growth of the silver halide grains, it is desirable that the hexacyano-metal complex is added to the grains immediately after the grains are formed, and the complex is added before the grain formation process is finished.

The addition of the hexacyano-metal complex may be started after 96 weight % of the total of silver nitrate for grain formation has been added. More preferably, it is added after 98 weight of silver nitrate, particularly preferably after 99 weight % of silver nitrate has been added.

If the hexacyano-metal complex is added after addition of aqueous solution of silver nitrate in which the formation of silver halide grains is almost completed, the hexacyano-metal complex can be adsorbed onto the outermost surfaces of the silver halide grains, and most of the complex forms a hardly-soluble salt with silver ions existing on the surfaces of the grains. Such a silver salt of hexacyano-iron (II) is a salt more hardly soluble than AgI, and therefore fine grains formed are prevented from being dissolved again. Thus, it becomes possible to produce fine silver halide grains having a small grain size.

The photosensitive silver halide grains used for the present invention may contain a metal of Group VIII to Group X in the periodic table of elements (including Group I to Group XVIII) or metal complex thereof.

The metal of Group VIII to X of the periodic table or the center metal of the metal complex is preferably rhodium, ruthenium or iridium. The metal complex may be used alone, or two or more complexes of the same or different metals may also be used in combination.

The content of the metal or metal complex is preferably from $1\times10^{-9}$ to $1\times10^{-3}$ mole per mole of silver.

Such heavy metals and metal complexes as well as addition method therefor are described in JP-A-7-225449, JP-A-11-65021, paragraphs 0018 to 0024, and JP-A-11-119374, paragraphs 0227 to 0240.

Further, metal complexes that can be contained in the silver halide grains (e.g., $[Fe(CN)_6]^{4-}$), desalting methods and chemical sensitization methods for silver halide emulsions are described in JP-A-11-84574, paragraphs 0046 to 0050, JP-A-11-65021, paragraphs 0025 to 0031, and JP-A-11-119374, paragraphs 0242 to 0250.

As gelatin contained in the photosensitive silver halide emulsion used for the present invention, various kinds of gelatin may be used. In order to maintain good dispersion state of the photosensitive silver halide emulsion in a coating solution containing a silver salt of an organic acid, low molecular weight gelatin having a molecular weight of 500–60,000 is preferably used. While such low molecular weight gelatin may be used during the grain formation or the dispersion operation after the desalting treatment, it is preferably used during the dispersion operation after the desalting treatment.

Various compounds known as supersensitizers can be used in the present invention in order to improve intrinsic sensitivity. Examples of the supersensitizer used for the present invention include the compounds disclosed in EP587338A, U.S. Pat. Nos. 3,877,943, 4,873,184, JP-A-5-341432, JP-A-11-109547, JP-A-10-111543 and so forth.

Photosensitive silver halide grains used for the present invention are preferably subjected to chemical sensitization by sulfur sensitization, selenium sensitization or tellurium sensitization. Any known compounds can be preferably used for such sulfur, selenium or tellurium sensitization, and for example, the compounds described in JP-A-7-128768 and so forth are usable for that purpose.

Tellurium sensitization is particularly preferred for the present invention, and the compounds described in JP-A-11-65021, paragraph 0030 and the compounds of the formulas (II), (III) and (IV) given in JP-A-5-313284 are more preferred.

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

In the present invention, the amount of the sulfur, selenium or tellurium sensitizer varies depending on the type of the silver halide grains to be used, conditions for chemical ripening etc., but may fall generally in the range of about $10^{-8}$ to $10^{-2}$ mole, preferably about $10^{-7}$ to $10^{-3}$ mole, per mole of the silver halide. Although the conditions for the chemical sensitization are not particularly limited, in general, pH is in the range of 5–8, pAg is in the range of 4–11, and temperature is in the range of 40–95° C.

The silver halide emulsion used for the present invention may be added with a thiosulfonic acid compound according to the method disclosed in EP293917A.

For the photosensitive silver halide grains used in the present invention, a reducing agent is preferably used. Specific examples of preferred compound used in the reduction sensitization include an ascorbic acid and thiourea dioxide as well as stannous chloride, aminoiminomethanesulfinic acid, hydrazine derivatives, borane compounds, silane compounds and polyamine compounds. The reduction sensitizer may be added at any time during the production process of the photosensitive emulsion from the process of crystal growth to immediately before the process of coating. The reduction sensitization may be performed by ripening the grains while keeping the emulsion at a pH of 7 or more or at a pAg of 8.3 or less. It is also preferably to perform the reduction sensitization by introducing a single addition part of silver ion during the formation of grains.

The photosensitive silver halide emulsion used for the present invention preferably contains an FED sensitizer (fragmentable electron donating sensitizer) as a compound that generates two electrons with one photon. As the FED sensitizer, the compounds disclosed in U.S. Pat. Nos. 5,747,235, 5,747,236, 6,054,260, 5,994,051 and Japanese Patent Application No. 2001-86161 are preferred. As the step of adding the FED sensitizer, any step of the photosensitive emulsion production process from the step of crystal growth to the preparation step immediately before application is preferred. Although the amount thereof may vary depending on various conditions, it is about $10^{-7}$ mol, to $10^{-1}$ mol, more preferably $10^{-6}$ mol to $5\times10^{-2}$ mol, per 1 mol of silver halide.

In the present invention, one kind of photosensitive silver halide emulsion may be used or two or more different emulsions (for example, those having different average grain sizes, different halogen compositions, different crystal habits or those subjected to chemical sensitization under different conditions) may be used in combination. By using multiple kinds of photosensitive silver halides having different sensitivities, contrast can be controlled.

Examples of the techniques concerning this respect include those mentioned in JP-A-57-119341, JP-A-53-106125, JP-A-47-3929, JP-A-48-55730, JP-A-46-5187, JP-A-50-73627, JP-A-57-150841 and so forth. Each emulsion preferably has sensitivity difference of 0.2 log E or higher for other emulsions.

The amount of the photosensitive silver halide is preferably 0.03–0.6 g/m$^2$, more preferably 0.07–0.4 g/m$^2$, most preferably 0.05–0.3 g/m$^2$, as the amount of coated silver per 1 m$^2$ of the photothermographic material. The amount of the photosensitive silver halide per mole of the silver salt of an organic acid is preferably 0.01–0.3 mole, more preferably 0.02–0.2 mole, further preferably 0.03–0.15 mole.

As methods and conditions for mixing photosensitive silver halide and a silver salt of an organic acid, which are separately prepared, there are a method of mixing silver halide grains and a silver salt of an organic acid after completion of respective preparations by using a high-speed stirring machine, ball mill, sand mill, colloid mill, vibrating mill, homogenizer or the like, a method of preparing a silver salt of an organic acid by mixing a photosensitive silver halide obtained separately at any time during the preparation of the silver salt of an organic acid and so forth. As described above, the silver halide used for the present invention is preferably prepared in the absence of a silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

Preferred addition time point for the silver halide into a coating solution for image-forming layer resides is a period of from 180 minutes before the coating to immediately before the coating, preferably 60 minutes to 10 seconds before the coating. However, the method and conditions for mixing are not particularly limited so long as the effect of the present invention can be attained satisfactorily. Specific examples of the mixing method include a method in which the mixing is performed in a tank designed so that a desired average residence time therein can be obtained, which residence time is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Although the contrast of the photothermographic material is not particularly limited, the average contrast for the density of 1.5–3.0 is preferably 1.5–10 in order effectively obtain the advantages of the present invention. The average contrast referred to herein means an inclination of a straight line connecting points corresponding to the optical densities of 1.5 and 3.0 on a characteristic curve of the photothermographic material plotted for logarithm of exposure with laser in abscissa and optical density of the photothermographic material exposed with that exposure after heat development in ordinate.

This average contrast is preferably 1.5–10 in order to improve the performance concerning rupture of characters. It is particularly preferably 2.0–7, further preferably 2.5–6.

Further, the average contrast obtained by connecting the points corresponding to optical densities of fog +0.25 and fog +2.0 is preferably 2.0–4.0, more preferably 2.5–3.5.

The silver salt of an organic acid that can be used in the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Such non-photosensitive silver salts of an organic acid are disclosed in JP-A-10-62899, paragraphs 0048 to 0049, EP0803763A1, page 18, line 24 to page 19, line 37, EP0962812A1, JP-A-11-349591, JP-A-2000-7683, JP-A-2000-72711 and so forth. Silver salts of an organic acid, in particular, silver salts of a long chained aliphatic carboxylic acid having 10–30, preferably 15–28 carbon atoms, are preferred. Preferred examples of the silver salt of an aliphatic carboxylic acid include silver lignocerate, silver behenate, silver arachidinate, silver stearate, silver oleate, silver laurate, silver caproate, silver myristate, silver palmitate, silver erucate, mixtures thereof and so forth. In the present invention, there is preferably used silver salt of an organic acid having a silver behenate content of 50 mole % or more, more preferably 85 mole % or more, further preferably 95 mole % or more, among the aforementioned silver salts of an organic acid.

Such non-photosensitive silver salts of an organic acid are disclosed in JP-A-10-62899, paragraphs 0048 to 0049, EP0803763A1, page 18, line 24 to page 19, line 37, EP0962812A1, JP-A-11-349591, JP-A-2000-7683, JP-A-2000-72711 and so forth. Silver salts of an organic acid, in particular, silver salts of a long chained aliphatic carboxylic acid having 10–30, preferably 15–28 carbon atoms, are preferred. Preferred examples of the silver salt of an aliphatic carboxylic acid include silver behenate, silver arachidinate, silver stearate, silver oleate, silver laurate, silver caproate, silver myristate, silver palmitate, mixtures thereof and so forth.

In the present invention, there is preferably used silver salt of an organic acid having a silver behenate content of 50 mole % or more, more preferably 80 mole % or more, further preferably 90 mole % or more, among the aforementioned silver salts of an organic acid.

The shape of the silver salt of an organic acid that can be used for the present invention is not particularly limited, and acicular grains, rod-like grains, tabular grains and scaly grains can be mentioned.

Scaly silver salt of an organic acid is preferred for the present invention. Grains of irregular form such as short acicular form, rectangular parallelepiped form, cubic form and potato-like form having a ratio of long axis and short axis of 5 or less are also preferably used. Such grains of silver salt of an organic acid are characterized by less fog upon heat development compared with long acicular grains having a ratio of long axis and short axis of more than 5.

Scaly silver salt of an organic acid referred to in the present specification is defined as follows.

A silver salt of an organic acid is observed with an electronic microscope, and grain shapes of the silver salt of an organic acid are approximated to rectangular parallelepipeds. The three different edges of each rectangular parallelepiped are represented as a, b and c where a is the shortest, c is the longest, and c and b may be the same. From the shorter edges a and b, x is obtained according to the following equation:

$$x=b/a$$

The values of x are obtained for about 200 grains, and an average of them (x (average)) is obtained. Samples that satisfy the requirement of x (average) $\geqq 1.5$ are defined to be scaly. Scaly grains preferably satisfy $30 \geqq x$ (average) $\geqq 1.5$, more preferably $20 \geqq x$ (average) $\geqq 2.0$. In this connection, acicular (needle-like) grains satisfy $1 \leqq x$ (average) $<1.5$.

In scaly grains, it is understood that a corresponds to the thickness of tabular grain of which main plane is defined by the sides of b and c. The average of a is preferably from 0.01 $\mu$m to 0.23 $\mu$m, more preferably from 0.1 $\mu$m to 0.20 $\mu$m. The average of c/b is preferably from 1 to 6, more preferably from 1.05 to 4, even more preferably from 1.1 to 3, particularly preferably from 1.1 to 2.

The grain size distribution of the organic acid silver salt is preferably monodispersed. The term "monodispersed" as used herein means that the percentage of the value obtained by dividing the standard deviation of the length of the short axis or long axis by the length of the short axis or long axis, respectively, is preferably 100% or less, more preferably 80% or less, further preferably 50% or less. The shape of the organic acid silver salt can be determined from a transmission electron microscope image of the organic acid silver salt dispersion.

Another method for determining the monodispesibility is a method of obtaining a standard deviation of a volume weight average diameter of the organic acid silver salt. The percentage (coefficient of variation) of the value obtained by dividing the standard deviation by the volume weight average diameter is preferably 100% or less, more preferably 80% or less, further preferably 50% or less.

As a measurement method, for example, the grain size (volume weight average diameter) can be determined by irradiating organic acid silver salt dispersed in a solution with a laser ray and determining an autocorrelation function of the fluctuation of the scattered light on the basis of the change in time.

As for methods for production and dispersion of the silver salt of an organic acid used for the present invention, various known methods can be used. For example, one can refer to the methods described in the aforementioned JP-A-10-62899, EP0803763A1, EP0962812A1, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2000-191226, JP-A-2000-213813, JP-A-2000-214155, JP-A-2000-191226 and so forth.

If a photosensitive silver salt coexists at the time of dispersing process of the silver salt of an organic acid, fog may increase and sensitivity may markedly decrease. Therefore, it is preferred that the photosensitive silver salt should not be substantially contained during the dispersion operation.

In the present invention, the amount of the photosensitive silver salt in an aqueous dispersion during the dispersion operation is preferably 1 mol % or less, more preferably 0.1 mole % or less, per mol of the organic silver salt of an organic acid in the dispersion, and more preferably, the photosensitive silver salt is not added intentionally.

In the present invention, the photothermographic material can be prepared by mixing dispersion of silver salt of an organic acid and dispersion of photosensitive silver halide. Although the mixing ratio of the silver salt of an organic acid and photosensitive silver halide can be arbitrarily selected, the ratio of the photosensitive silver salt to the silver salt of an organic acid is preferably in the range of 1–30 mol %, more preferably 2–20 mol %, particularly preferably 3–15 mol %.

For the mixing of them, mixing two or more kinds of aqueous dispersions of the silver salt of an organic acid and two or more kinds of aqueous dispersions of the photosensitive silver salt is preferably used for controlling photographic properties.

The silver salt of an organic acid for use in the present invention may be used in any desired amount. However, it is preferably used in an amount of 0.1–5 g/m$^2$, more preferably 0.3–3 g/m$^2$, particularly preferably 0.5–2 g/m$^2$, in terms of silver amount.

The photothermographic material of the present invention preferably contains a heat developing agent that is a reducing agent for the silver salt of an organic acid. The reducing agent for the silver salt of an organic acid may be any substance (preferably, organic substance) capable of reducing silver ions into metal silver. Examples of the reducing agent are described in JP-A-11-65021, paragraphs 0043 to 0045, EP0803764A1, from page 7, line 34 to page 18, line 12.

In the present invention, preferably used as the reducing agent are the so-called hindered phenol type reducing agents, which have a substituent at the ortho-position of phenolic hydroxyl group, and bisphenol type reducing agents, and it is more preferable to use a compound represented by the following formula (R).

Formula (R)

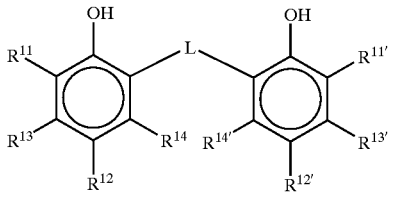

In the aforementioned formula (R), $R^{11}$ and $R^{11'}$ each independently represent an alkyl group having 1–20 carbon atoms. $R^{12}$, $R^{12'}$, $R^{13}$, $R^{13'}$, $R^{14}$ and $R^{14'}$ each independently represent a hydrogen atom or a substituent that can substitute on a benzene ring. L represents a —S— group or a —CHR$^{15}$— group. $R^{15}$ represents a hydrogen atom or an alkyl group having 1–20 carbon atoms.

The formula (R) will be explained in detail.

$R^{11}$ and $R^{11'}$ each independently represent a substituted or unsubstituted alkyl group having 1–20 carbon atoms. Although the substituent of the alkyl group is not particularly limited, preferred examples thereof include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom and so forth. The alkyl group may be linear or branched, and it may also be a cyclic cycloalkyl group.

$R^{12}$, $R^{12'}$, $R^{13}$, $R^{13'}$, $R^{14}$ and $R^{14'}$ each independently represent a hydrogen atom or a substituent that can substitute on a benzene ring. Preferred examples of the substituent that can substitute on a benzene ring include an alkyl group, an aryl group, a halogen atom, an alkoxy group and an acylamino group.

L represents a —S— group or a —CHR$^{15}$— group. $R^{15}$ represents a hydrogen atom or an alkyl group having 1–20 carbon atoms, and the alkyl group may have a substituent. Examples of the unsubstituted alkyl group represented by $R^{15}$ include methyl group, ethyl group, propyl group, butyl group, heptyl group, undecyl group, isopropyl group, 1-ethylpentyl group, 2,4,4-trimethylpentyl group and so forth. Examples of the substituent of the alkyl group are similar to the examples of the substituent of $R^{11}$ and $R^{11'}$.

$R^{11}$ and $R^{11'}$ preferably represent a secondary or tertiary alkyl group having 3–15 carbon atoms, and specific examples thereof include isopropyl group, isobutyl group, t-butyl group, t-amyl group, t-octyl group, cyclohexyl group, cyclopentyl group, 1-methylcyclohexyl group, 1-methylcyclopropyl group and so forth. $R^{11}$ and $R^{11'}$ more preferably represent a tertiary alkyl group having 4–12 carbon atoms, further preferably t-butyl group, t-amyl group or 1-methylcyclohexyl group, most preferably t-butyl group.

$R^{12}$ and $R^{12'}$ preferably represents an alkyl group having 1–20 carbon atoms, and specific examples thereof include methyl group, ethyl group, propyl group, butyl group, isopropyl group, t-butyl group, t-amyl group, cyclohexyl group, 1-methylcyclohexyl group, benzyl group, methoxymethyl group, methoxyethyl group and so forth. $R^{12}$ and $R^{12'}$ more preferably represents methyl group, ethyl group, propyl group, isopropyl group or t-butyl group. $R^{13}$, $R^{13'}$, $R^{14}$ and $R^{14'}$ preferably represent a hydrogen atom, a halogen atom or an alkyl group, more preferably a hydrogen atom.

L is preferably a —CHR$^{15}$— group. $R^{15}$ is preferably a hydrogen atom or an alkyl group having 1–15 carbon atoms, and preferred examples of the alkyl group include methyl group, ethyl group, propyl group, isopropyl group and 2,4,4-trimethylpentyl group. $R^{15}$ is particularly preferably a hydrogen atom, methyl group, ethyl group, propyl group or isopropyl group.

When $R^{15}$ is a hydrogen atom, $R^{12}$and $R^{12'}$ preferably represents an alkyl group having 2–5 carbon atoms, more preferably ethyl group or propyl group, most preferably ethyl group. When $R^{15}$ is a primary or secondary alkyl group having 1–8 carbon atoms, $R^{12}$ and $R^{12'}$ preferably represents methyl group. The primary or secondary alkyl group having 1–8 carbon atoms represented by $R^{15}$ is preferablymethyl group, ethyl group, propyl group or isopropyl group, further preferably methyl group, ethyl group or propyl group.

When $R^{11}$, $R^{11'}$, $R^{12}$ and $R^{12'}$ all represent methyl group, $R^{15}$ preferably represents a secondary alkyl group. In this case, the secondary alkyl group represented by $R^{15}$ is preferably isopropyl group, isobutyl group or 1-ethylpentyl group, more preferably isopropyl group.

The reducing agent represented by the aforementioned formula (R) shows different heat development characteristic, developed silver color tone and so forth depending on a combination of substituents including $R^{11}$, $R^{11'}$, $R^{12}$, $R^{12'}$, $R^{15}$ etc. It is also possible to obtain desired heat development characteristic or developed silver color tone by using two or more kinds of reducing agents in combination.

Specific examples of the reducing agent of the present invention including the compounds represented by the aforementioned formula (R) are shown below. However, the present invention is not limited to these.
(R-1)
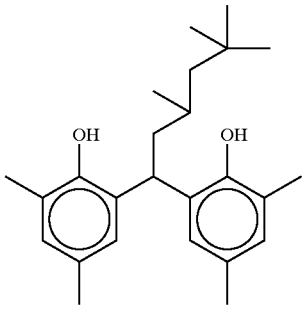
(R-2)
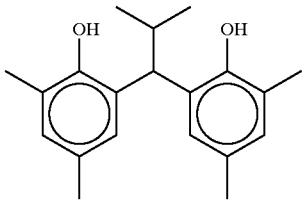
(R-3)
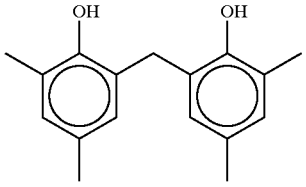
(R-4)
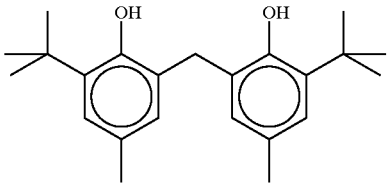
(R-5)
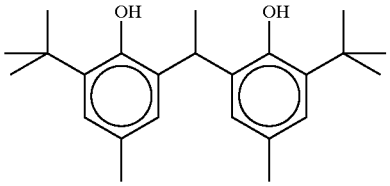
(R-6)
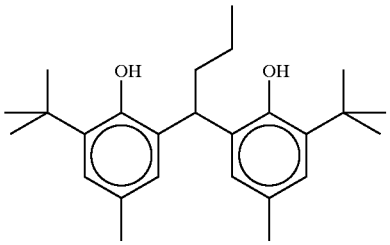
(R-7)
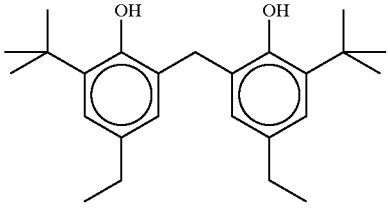
-continued
(R-8)
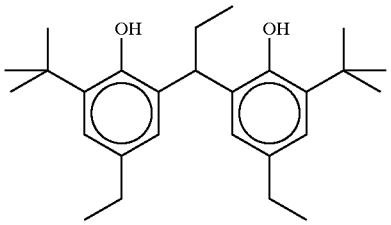
(R-9)
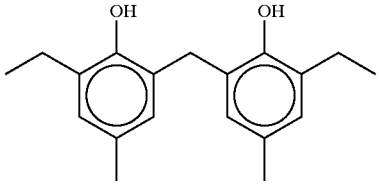
(R-10)
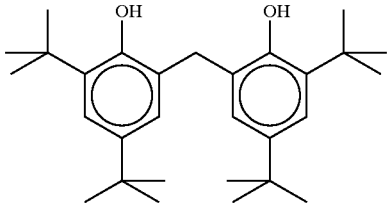
(R-11)
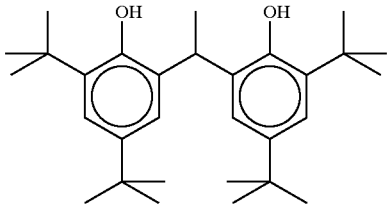
(R-12)
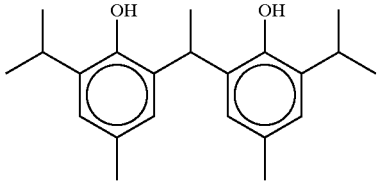
(R-13)
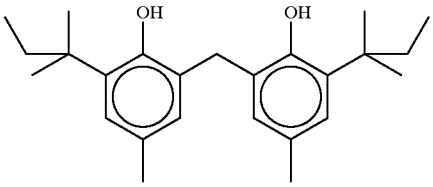
(R-14)
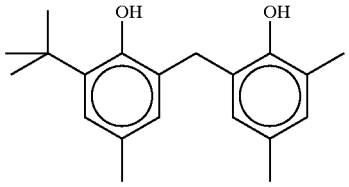

-continued
(R-15)
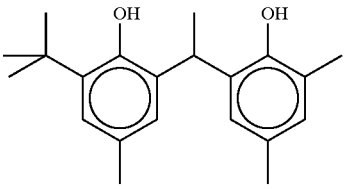
(R-16)
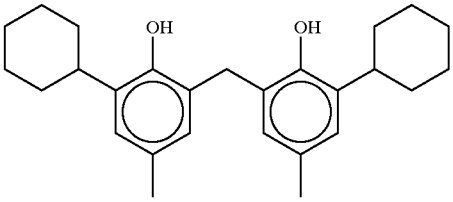
(R-17)
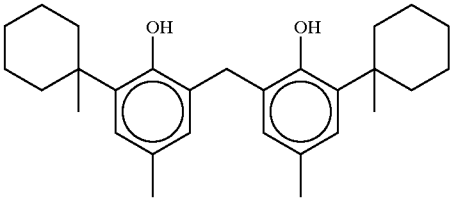
(R-18)
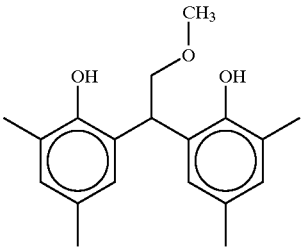
(R-19)
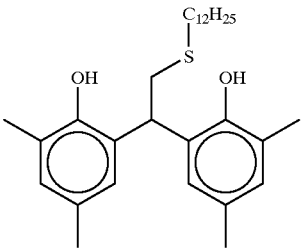
(R-20)
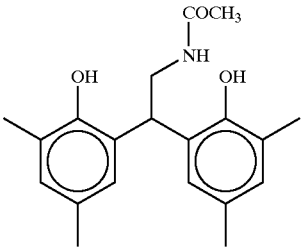
(R-21)
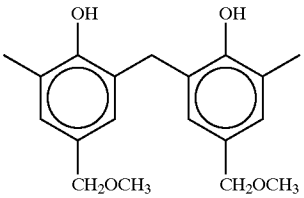
-continued
(R-22)
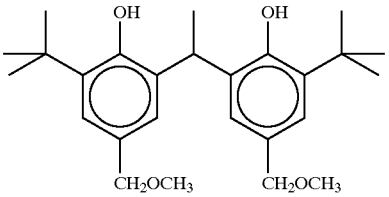
(R-23)
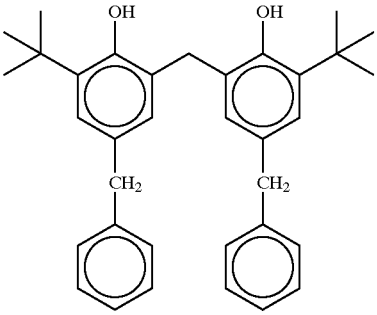
(R-24)
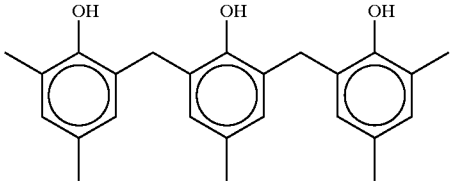
(R-25)
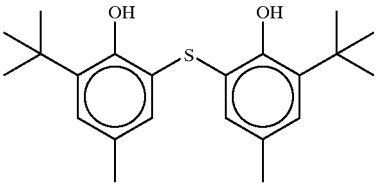
(R-26)
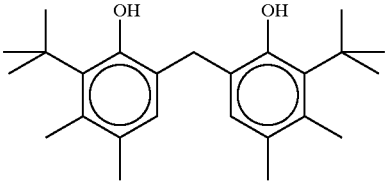
(R-27)
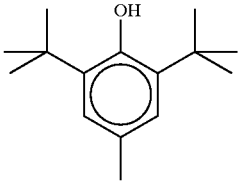
(R-28)
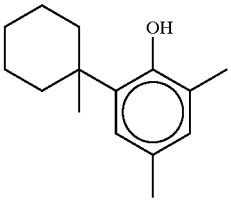

-continued (R-29)

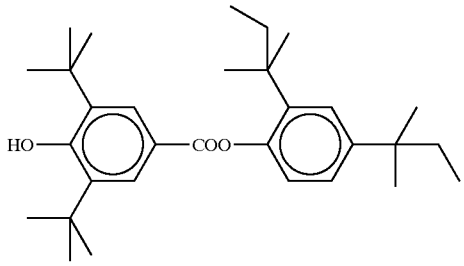

(R-30)

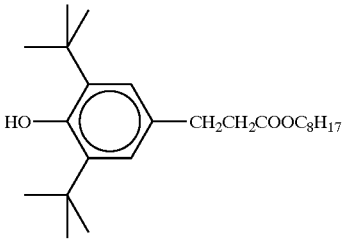

(R-31)

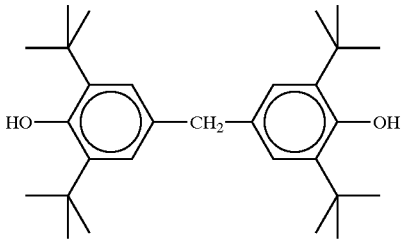

(R-32)

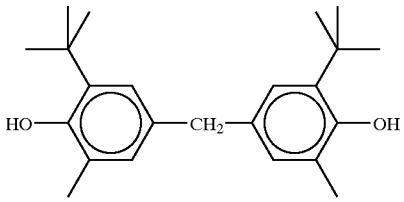

(R-33)

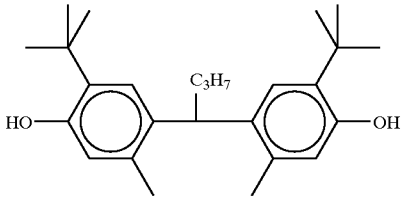

(R-34)

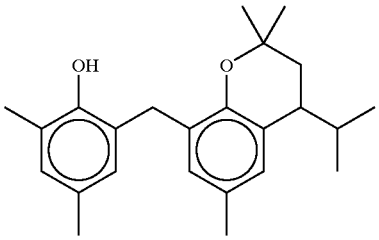

In the present invention, the amount of the reducing agent is preferably 0.1–3.0 g/m$^2$, more preferably 0.2–1.5 g/m$^2$, further preferably 0.3–1.0 g/m$^2$. The amount of the reducing agent is preferably 5–50 mole %, more preferably 8–30 mole %, further preferably 10–20 mole %, per mole of silver on the side having the image-forming layer. The reducing agent is preferably contained in the image-forming layer containing the non-photosensitive silver source.

The reducing agent may be contained in the photothermographic material by adding it to a coating solution in any form such as solution, emulsion dispersion and solid microparticle dispersion and forming a layer with the coating solution.

As well known emulsion dispersion methods, there can be mentioned a method of mechanically preparing an emulsion dispersion by using an oil such as dibutyl phthalate, tricresyl phosphate, glyceryl triacetate and diethyl phthalate and an auxiliary solvent such as ethyl acetate or cyclohexanone for dissolution.

Further, as a method for solid microparticle dispersion, there can be mentioned a method for preparing solid microparticle dispersion by dispersing powder of the reducing agent in a suitable solvent such as water using a ball mill, colloid mill, vibration ball mill, sand mill, jet mill and roller mill, or by means of ultrasonic wave. In this operation, protective colloid (e.g., polyvinyl alcohol), surfactant (e.g., anionic surfactants such as sodium triisopropylnaphthalenesulfonate (mixture of those having three isopropyl groups on different positions)) and so forth may be used. In the aforementioned mills, beads such as zirconia beads are usually used as dispersion media, and Zr or the like eluted from such beads may contaminate the dispersion. Although the concentration of the contaminants depends on the dispersion conditions, it is usually in the range of 1–1000 ppm. Content of Zr of 0.5 mg or less per 1 g of silver in the photosensitive material does not cause any practical problem.

An aqueous dispersion preferably contains a preservative (e.g., benzisothiazolinone sodium salt).

In the photothermographic material of the present invention, the sulfonamidophenol compounds represented by the formula (A) mentioned in JP-A-2000-267222 and JP-A-2000-330234, hindered phenol compounds represented by the formula (II) mentioned in JP-A-2001-92075, hydrazine compounds represented by the formula (I) mentioned in JP-A-10-62895 and JP-A-11-15116 or the formula (1) mentioned in Japanese Patent Application No. 2001-074278 and phenol or naphthol compounds represented by the formula (2) mentioned in Japanese Patent Application No. 2000-76240 are preferably used as a development accelerator.

These development accelerators are used in an amount in the range of 0.1–20 mol %, preferably 0.5–10 mol %, more preferably 1–5 mol %, with respect to the reducing agent. Although they can be introduced into the photothermographic material by a method similar to those used for introducing the reducing agent, they are particularly preferably introduced as a solid dispersion or emulsion dispersion.

When they are added as an emulsion dispersion, they are preferably added as an emulsion dispersion prepared by emulsion dispersion using a high-boiling point solvent that is solid at an ordinary temperature and a low-boiling point auxiliary solvent, or a so-called oilless emulsion dispersion that is not added with a high boiling-point solvent.

A hydrogen bond-forming compound used for the present invention will be explained hereafter.

In the present invention, when a reducing agent having an aromatic hydroxyl group (—OH) is used, in particular, when the reducing agent is any of the aforementioned bisphenols, it is preferable to use together a non-reducing compound having a group that can form a hydrogen bond with such a group.

Examples of the group that can form a hydrogen bond with a hydroxyl group or amino group include a phosphoryl group, a sulfoxido group, a sulfonyl group, a carbonyl group, an amido group, an ester group, a urethane group, a ureido group, a tertiary amino group, a nitrogen-containing aromatic group and so forth.

Particularly preferred examples of the compound are those compounds having a phosphoryl group, a sulfoxido group, an amido group (provided that it does not have >N—H group, but it is blocked as >N—$R^a$ ($R^a$ is a substituent other than H)), a urethane group (provided that it does not have >N—H group, but it is blocked as >N—$R^a$ ($R^a$ is a substituent other than H)) or a ureido group (provided that it does not have >N—H group, but it is blocked as >N—$R^a$ ($R^a$ is a substituent other than H)).

Hydrogen bond-forming compounds particularly preferably used for the present invention are compounds represented by the following formula (D).

Formula (D)

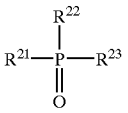

In the formula (D), $R^{21}$, $R^{22}$ and $R^{23}$ each independently represent an alkyl group, an aryl group, an alkoxy group, an aryloxy group, an amino group or a heterocyclic ring group, and these groups may or may not have a substituent. When $R^{21}$, $R^{22}$ and $R^{23}$ have a substituent, it can be selected from a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group and so forth, and they are preferably selected from an alkyl group and an aryl group. Specific examples thereof are methyl group, ethyl group, isopropyl group, tert-butyl group, tert-octyl group, phenyl group, 4-alkoxyphenyl group, 4-acyloxyphenyl group and so forth.

Specific examples of the alkyl group represented by $R^{21}$, $R^{22}$ and $R^{23}$ include methyl group, ethyl group, butyl group, octyl group, dodecyl group, isopropyl group, tert-butyl group, tert-amyl group, tert-octyl group, cyclohexyl group, 1-methylcyclohexyl group, benzyl group, phenethyl group, 2-phenoxypropyl group and so forth. Specific examples of the aryl group include phenyl group, cresyl group, xylyl group, naphthyl group, 4-tert-butylphenyl group, 4-tert-octylphenyl group, 4-anisidyl group, 3,5-dichlorophenyl group and so forth.

Specific examples of the alkoxyl group include methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group and so forth.

Specific examples of the aryloxy group include phenoxy group, cresyloxy group, isopropylphenoxy group, 4-tert-butylphenoxy group, naphthoxy group, biphenyloxy group and so forth. Specific examples of the amino group include dimethylamino group, diethylamino group, dibutylamino group, dioctylamino group, N-methyl-N-hexylamino group, dicyclohexylamino group, diphenylamino group, N-methyl-N-phenylamino group and so forth.

$R^{21}$, $R^{22}$ and $R^{23}$ are preferably selected from an alkyl group, an aryl group, an alkoxy group and an aryloxy group. In view of the effects of the present invention, it is preferred that one or more of $R^{21}$, $R^{22}$ and $R^{23}$ should be selected from an alkyl group and an aryl group, and it is more preferred that two or more of $R^{21}$, $R^{22}$ and $R^{23}$ should be selected from an alkyl group and an aryl group. In view of availability at low cost, it is preferred that $R^{21}$, $R^{22}$ and $R^{23}$ should be the same groups.

Specific examples of the hydrogen bond-forming compound including those of the formula (D) will be shown below. However, the present invention is not limited to these examples.

(D-1)

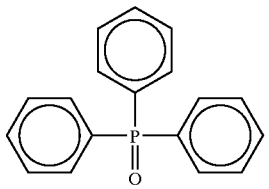

(D-2)

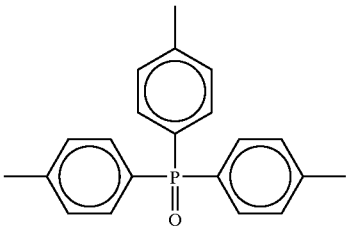

(D-3)

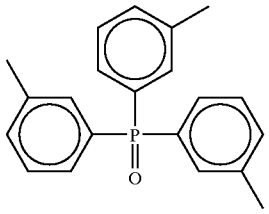

(D-4)

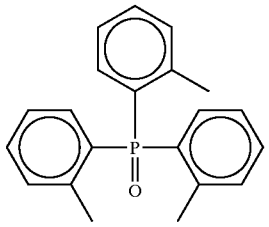

(D-5)

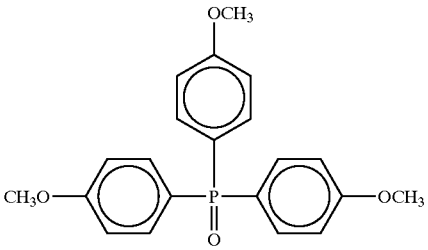

(D-6)

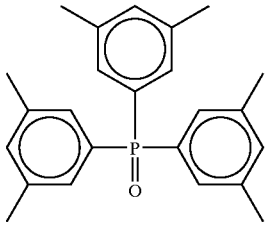

-continued (D-7)

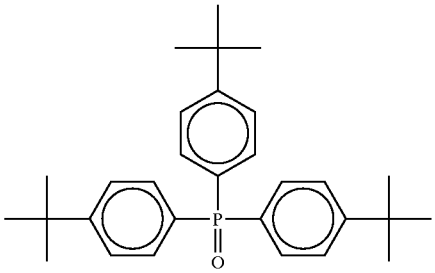

(D-8)

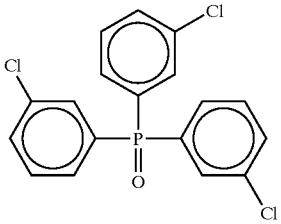

(D-9)

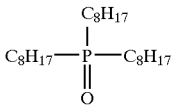

(D-10)

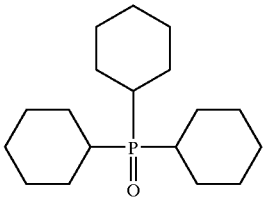

(D-11)

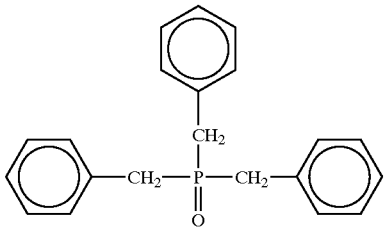

(D-12)

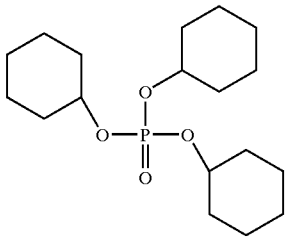

(D-13)

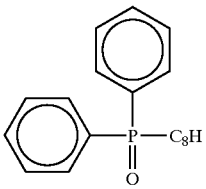

-continued (D-14)

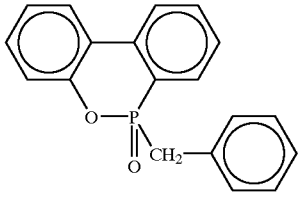

(D-15)

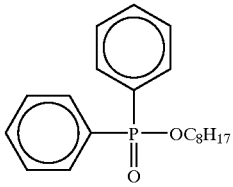

(D-16)

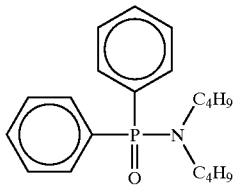

(D-17)

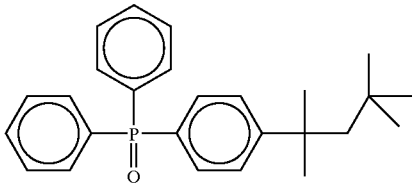

(D-18)

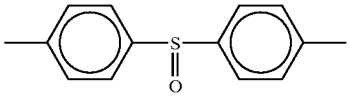

(D-19)

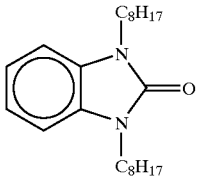

(D-20)

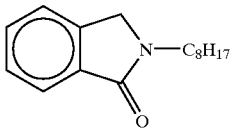

(D-21)

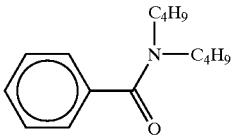

Specific examples of the hydrogen bond-forming compound include, besides those mentioned above, those disclosed in EP1096310A, Japanese Patent Application Nos. 2000-192191 and 2000-194811.

The compound represented by the formula (D) used for the present invention may be added to a coating solution, like the reducing agent, in the form of solution, emulsion dispersion or solid microparticle dispersion for use in the photosensitive material. The hydrogen bond-forming compound forms a complex in a solution with a compound having a phenolic hydroxyl group or an amino group through hydrogen bond, and hence it can be isolated as crystals of such a complex depending on the combination of the reducing agent and the compound represented by the formula (D). Crystal powder isolated in such a manner is particularly preferably used as solid microparticle dispersion in order to obtain stable performance. Further, it is also preferable to mix the reducing agent and the hydrogen bond-forming compound represented by the formula (D) as powders and allow them to form a complex during dispersion operation using a suitable dispersing agent in a sand grinder mill or the like.

The compound represented by the formula (D) is preferably used in an amount of 1–200 mole %, more preferably 10–150 mole %, further preferably 20–100 mole %, with respect to the reducing agent.

The binder used for the present invention will be explained hereafter.

In the present invention, the binder of the layer containing the silver salt of an organic acid may be any polymer. Preferred binders are those that are transparent or translucent, and generally colorless. The binder may consist of, for example, a naturally occurring resin, polymer or copolymer, synthetic resin, polymer or copolymer or other media that can form a film, such as gelatins, rubbers, poly(vinyl alcohols), hydroxyethylcelluloses, cellulose acetates, cellulose acetate butyrates, poly (vinylpyrrolidones), casein, starch, poly(acrylic acids), poly (methyl methacrylates), poly(vinyl chlorides), poly (methacrylic acids), styrene/maleic anhydride copolymers, styrene/acrylonitrile copolymers, styrene/butadiene copolymers, poly(vinyl acetals) (e.g., poly(vinyl formal), poly(vinyl butyral)), poly(esters), poly(urethanes), phenoxy resin, poly(vinylidene chlorides), poly(epoxides), poly (carbonates), poly(vinyl acetates), poly(olefins), cellulose esters and poly(amides). The binder may be formed from its solution in water, organic solvent or emulsion by coating it.

In the present invention, the binder that can be used for the layer containing a silver salt of an organic acid preferably has a grass transition temperature of 10–80° C. (also referred to as "high Tg binder" hereinafter), more preferably 15–70° C., further preferably 20–65° C.

In the present specification, Tg is calculated in accordance with the following equation.

$$1/Tg=\Sigma(Xi/Tgi)$$

In this case, the polymer is considered to be a copolymer composed of n of monomer components (n is an integer satisfying 1=n). Xi represents a weight ratio of the i-th monomer ($\Sigma Xi=1$, i is an integer satisfying 1=i=n), and Tgi is a glass transition temperature (absolute temperature) of a homopolymer composed of the i-th monomer. Σ means to calculate the sum of i=1 to n. As the value of glass transition temperature of a homopolymer composed of each monomer (Tgi), used was a value mentioned in Polymer Handbook (3rd Edition) (J. Brandrup, E. H. Immergut (Wiley-Interscience, 1989)).

Two or more kinds of polymers serving as the binder may be used in combination as required. Further, one having a glass transition temperature of 20° C. or higher and one having a glass transition temperature of lower than 20° C. may be used in combination. When a blend of two or more kinds of polymers having different glass transition temperatures is used, it is preferred that its weight average Tg should fall within the aforementioned range.

In the present invention, the layer containing a silver salt of an organic acid is preferably a coated layer formed by coating a coating solution in which 30% of the solvent consists of water and drying it.

In the present invention, if the layer containing the silver salt of an organic acid is formed by coating a coating solution in which 30% of the solvent consists of water and drying it, a binder of the layer containing the silver salt of an organic acid soluble or dispersible in an aqueous solvent (water solvent), in particular, a coating solution containing a polymer latex having an equilibrated moisture content of 2 weight % or less at 25° C. and relative humidity of 60%, improves the performance. In the most preferred embodiment, the polymer latex is prepared to have an ion conductivity of 2.5 mS/cm or less. An example of method for preparing such polymer latex includes a method of synthesizing a polymer and then purifying the polymer by using a functional membrane for separation.

The aqueous solvent in which the polymer binder is soluble or dispersible is water or water mixed with 70% by weight or less of a water-miscible organic solvent.

Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and so forth.

The term "aqueous solvent" used herein also encompasses systems in which a polymer is not thermodynamically dissolved but is present in a so-called dispersed state.

The definition "equilibrated moisture content at 25° C. and relative humidity of 60%" used herein can be represented by the following equation, in which $W_1$ indicates the weight of a polymer at humidity-conditioned equilibrium in an atmosphere of 25° C. and relative humidity of 60%, and $W_0$ indicates the absolute dry weight of the polymer at 25° C.

$$\text{Equilibrated moisture content at 25° C. and relative humidity of 60\%}=[(W_1-W_0)/W_0]\times 100 \text{ (weight \%)}$$

As for details of the definition of moisture content and methods for measurement, for example, Lecture of Polymer Engineering, 14, Test Methods for Polymer Materials (Polymer Society of Japan, Chijin Shokan) can be referred to.

The equilibrated moisture content at 25° C. and relative humidity of 60% of the binder polymer used for the present invention is preferably 2% by weight or less, more preferably from 0.01–1.5% by weight, most preferably from 0.02–1% by weight.

In the present invention, polymers dispersible in aqueous solvents are particularly preferred. Examples of the dispersed state include, for example, latex in which fine solid particles of polymer are dispersed and a system in which a polymer is dispersed in a molecular state or as micelles. Particles dispersed as latex are more preferred.

Dispersed particles preferably have a mean particle size of around 1–50000 nm, more preferably around 5–1000 nm, further preferably 10–500 nm, particularly preferably 50–200 nm. Particle size distribution of the dispersed particles is not particularly limited, and either those having a broad particle size distribution or those having monodispersed particle size distribution may be used. A method of mixing two or more kinds of dispersion having monodispersed particle distribution and using the mixture is also a preferred method in view of control of physical properties of coating solution.

In the present invention, preferred examples of polymer dispersible in an aqueous solvent include hydrophobic polymers such as acrylic polymers, polyesters, rubbers (e.g., SBR resins), polyurethanes, polyvinyl chlorides, polyvinyl acetates, polyvinylidene chlorides and polyolefins. The polymers may be linear, branched or crosslinked. They may be so-called homopolymers in which a single kind of monomer is polymerized, or copolymers in which two or more different kinds of monomers are polymerized. The copolymers may be random copolymers or block copolymers.

The polymers may have a number average molecular weight of 5,000 to 1,000,000, preferably 10,000 to 200,000. Polymers having a too small molecular weight fail to give sufficient mechanical strength of an emulsion layer, and those having a too large molecular weight yield bad film forming property, and both of which are not preferred. Crosslinked polymer latex is particularly preferably used.

Specific examples of the preferred polymer latex are mentioned below. However, the present invention is not limited to these. They are expressed with the constituent monomers. The parenthesized numerals indicate the contents in terms of weight %. The molecular weights are number average molecular weights. When multifunctional monomers are used, a crosslinked structure is formed and thus the concept of molecular weight cannot be applied. Therefore, for such a polymer, indication of "crosslinked" is appended and molecular weight is omitted. Tg indicates glass transition temperature.

P-1: Latex of -MMA(70)-EA(27)-MAA(3)–(molecular weight: 37000, Tg: 61° C.)

P-2: Latex of -MMA(70)-2EHA(20)-St(5)-AA(5)—(molecular weight: 40000, Tg: 59° C.)

P-3: Latex of -St(50)-Bu(47)-MMA(3)—(crosslinked, Tg: −17° C.)

P-4: Latex of -St(68)-Bu(29)-AA(3)—(crosslinked, Tg: 17° C.)

P-5: Latex of -St(71)-Bu(26)-AA(3)—(crosslinked, Tg: 24° C.)

P-6: Latex of -St(70)-Bu(27)-IA(3)—(crosslinked)

P-7: Latex of -St(75)-Bu(24)-AA(1)—(crosslinked, Tg: 29° C.)

P-8: Latex of -St(60)-Bu(35)-DVB(3)-MAA(2)—(crosslinked)

P-9: Latex of -St(70)-Bu(25)-DVB(2)-AA(3)—(crosslinked)

P-10: Latex of -VC(50)-MMA(20)-EA(20)-AN(5)-AA(5)—(molecular weight: 80000)

P-11: Latex of -VDC(85)-MMA(5)-EA(5)-MAA(5)—(molecular weight: 67000)

P-12: Latex of -Et(90)-MAA(10)—(molecular weight: 12000)

P-13: Latex of -St(70)-2EHA(27)-AA(3)—(molecular weight: 130000, Tg: 43° C.)

P-14: Latex of -MMA(63)-EA(35)-AA(2)—(molecular weight: 33000, Tg: 47° C.)

P-15: Latex of -St(70.5)-Bu(26.5)-AA(3)—(crosslinked, Tg: 23° C.)

P-16: Latex of -St(69.5)-Bu(28.5)-AA(3)—(crosslinked, Tg: 20.5° C.)

Abbreviations used in the above structures represents following monomers:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are also commercially available, and those mentioned below can be used, for example. Examples of acrylic polymers are CEBIAN A-4635, 46583, 4601 (all from Daicel Chemical Industries), Nipol Lx811, 814, 821, 820, 857 (all from Nippon Zeon) etc.; examples of polyesters are FINETEX ES650, 611, 675, 850 (all from Dai-Nippon Ink & Chemicals), WD-size, WMS (both from Eastman Chemical) etc.; examples of polyurethanes are HYDRAN AP10, 20, 30, 40 (all from Dai-Nippon Ink & Chemicals) etc.; examples of rubbers are LACSTAR 7310K, 3307B, 4700H, 7132C (all from Dai-Nippon Ink & Chemicals), Nipol LX416, 410, 438C, 2507 (all from Nippon Zeon) etc.; examples of polyvinyl chlorides are G351, G576 (both from Nippon Zeon) etc.; examples of polyvinylidene chlorides are L502, L513 (both from Asahi Chemical Industry) etc.; examples of polyolefins are CHEMIPEARL S120, SA100 (both from Mitsui Petrochemical) etc.

These polymer latexes may be used each alone, or two or more kinds of them may be blended as required.

As the polymer latex used in the present invention, styrene/butadiene copolymer latex is particularly preferred. In the styrene/butadiene copolymer, the weight ratio of styrene monomer units and butadiene monomer units is preferably 40:60 to 95:5. The ratio of the styrene monomer units and the butadiene monomer units preferably account for from 60–99 weight % of the copolymer. The polymer latex preferably contains 1–6 weight %, more preferably 2–5 weight %, of acrylic acid or methacrylic acid with respect to the sum of the styrene and butadiene. Further, polymer latex containing acrylic acid is also preferred.

Examples of styrene/butadiene copolymer latexes preferably used for the present invention include the aforementioned P-3 to P-8 and P-15, commercially available products, LACSTAR-3307B, 7132C, Nipol Lx416 and so forth.

Such styrene/butadiene copolymer latex preferably has Tg of 10° C. to 30° C., more preferably 17° C. to 25° C.

The layer containing the non-photosensitive silver source (preferably a silver salt of an organic acid) of the photothermographic material of the present invention may optionally be added with a hydrophilic polymer such as gelatin, polyvinyl alcohol, methylcellulose, hydroxypropylcellulose and carboxymethylcellulose. The amount of the hydrophilic polymer is preferably 30% by weight or less, more preferably 20% by weight or less, of the total binder in the layer containing silver salt of an organic acid.

In the present invention, the layer containing silver salt of an organic acid (i.e., the image-forming layer) is preferably formed by using polymer latex. The amount of the binder in the layer containing a silver salt of an organic acid may be 1/10 to 10/1, more preferably 1/3 to 5/1, further preferably 1/1 to 3/1, as indicated by a weight ratio of total binder/silver salt of an organic acid.

In the photothermographic material of the present invention, the layer containing the silver salt of an organic acid may also serve as a photosensitive layer (emulsion layer) containing a photosensitive silver halide as a photosensitive silver salt. In that case, the weight ratio of total binder/silver halide is preferably 400-5, more preferably 200-10.

The total amount of the binder in the image-forming layer of the photothermographic material of the present invention is preferably 0.2–30 g/m$^2$, more preferably 1–15 g/m$^2$, further preferably 2–10 g/m$^2$. The image-forming layer may optionally be added with a crosslinking agent for crosslinking, a surfactant for improving coating property of a coating solution and so forth.

In the present invention, the solvent for the coating solution for the layer containing silver salt of an organic acid (for simplicity, a solvent as well as a dispersion medium are herein referred to as a "solvent") is preferably an aqueous solvent containing at least 30% by weight of water. As components other than water, any water-miscible organic solvents may be used such as, for example, methyl alcohol, ethyl alcohol, isopropyl alcohol, methylcellosolve, ethylcellosolve, dimethylformamide, ethyl acetate and so forth. The water content of the solvent for the coating solution is preferably at least 50% by weight, more preferably at least 70% by weight. Preferred examples of the solvent composition include, besides water, water/methyl alcohol=90/10, water/methyl alcohol=70/30, water/methyl alcohol/di-methylformamide=80/15/5, water/methyl alcohol/ethylcellosolve=80/10/5, water/methyl alcohol/isopropyl alcohol=85/10/5 and so forth (numerals indicate weight %).

As antifoggants, stabilizers and stabilizer precursors that can be used for the present invention, there can be mentioned, for example, those mentioned in JP-A-10-62899, paragraph 0070 and EP0803764A1, from page 20, line 57 to page 21, line 7 as well as the compounds described in JP-A-9-281637, JP-A-9-329864, U.S. Pat. No. 6,083,681 and EP1048975. Antifoggants preferably used for the present invention are organic halogenated compounds. Examples thereof include, for example, those disclosed in JP-A-11-65021, paragraphs 0111 to 0112. Particularly preferred are the organic halogenated compounds represented by the formula (P) mentioned in JP-A-2000-284399, the organic polyhalogenated compounds represented by the formula (II) mentioned in JP-A-10-339934, the organic polyhalogenated compounds described in JP-A-2001-31644 and JP-A-2001-33911.

Organic polyhalogenated compounds preferably used for the present invention will be specifically explained hereafter. In the present invention, it is preferable to use organic polyhalogenated compounds represented by the following formula (H).

$$Q—(Y)_n—C(Z^{11})(Z^{12})—X \qquad \text{Formula (H)}$$

In the aforementioned formula (H), Q represents an alkyl group, an aryl group or a heterocyclic ring group, Y represents a divalent bridging group, n represents 0 or 1, $Z^{11}$ and $Z^{12}$ represent a halogen atom, and X represents a hydrogen atom or an electron-withdrawing group.

In the aforementioned formula (H), Q preferably represents a phenyl group substituted with an electron-withdrawing group having a positive value of Hammett's substituent constant sp. As for the Hammett's substituent constant, Journal of Medicinal Chemistry, 1973, Vol. 16, No.11, 1207–1216 and so forth can be referred to.

Examples of such an electron-withdrawing group include, for example, a halogen atom (e.g., fluorine atom with $\sigma_p$ of 0.06, chlorine atom with $\sigma_p$ of 0.23, bromine atom with $\sigma_p$ of 0.23, iodine atom with ($\sigma_p$ of 0.18), a trihalomethyl group (e.g., tribromomethyl with $\sigma_p$ of 0.29, trichloromethyl with $\sigma_p$ of 0.33, trifluoromethyl with $\sigma_p$ of 0.54), a cyano group with $\sigma_p$ of 0.66, a nitro group with $\sigma_p$ of 0.78, an aliphatic, aryl or heterocyclylsulfonyl group (e.g., methanesulfonyl with $\sigma_p$ of 0.72), an aliphatic, aryl or heterocyclylacyl group (e.g., acetyl with $\sigma_p$ of 0.50, benzoyl with $\sigma_p$ of 0.43), an alkynyl group (e.g., C≡CH with $\sigma_p$ of 0.23), an aliphatic, aryl or heterocyclyloxycarbonyl group (e.g., methoxycarbonyl with $\sigma_p$ of 0.45), phenoxycarbonyl with $\sigma_p$ of 0.44), carbamoyl group with $\sigma_p$ of 0.36, sulfamoyl group with $\sigma_p$ of 0.57, a sulfoxide group, a heterocyclic group, a phosphoryl group and so forth. The $\sigma_p$ value is preferably in the range of 0.2–2.0, more preferably in the range of 0.4–1.0.

Particularly preferred electron-withdrawing groups are a carbamoyl group, an alkoxycarbonyl group, an alkylsulfonyl group and an alkylphosphoryl group, and a carbamoyl group is especially preferred.

X preferably represents an electron-withdrawing group, more preferably a halogen atom; an aliphatic, aryl or heterocyclylsulfonyl group; an aliphatic, aryl or heterocyclylacyl group; an aliphatic, aryl or heterocyclyloxycarbonyl group; a carbamoyl group; or a sulfamoyl group, further preferably a halogen atom. As the halogen atom, a chlorine atom, bromine atom and iodine atom are preferred, a chlorine atom and bromine atom are further preferred, and a bromine atom is particularly preferred. Y preferably represents —C(=O)—, —SO— or —$SO_2$—, more preferably —C(=O)— or —$SO_2$—, particularly preferably —$SO_2$—. n represents 0 or 1, preferably 1.

Specific examples of the organic polyhalogenated compounds represented by the aforementioned formula (H) are shown below.

(H-1)

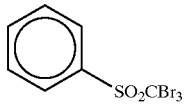

(H-2)

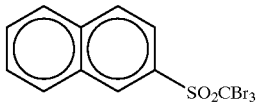

(H-3)

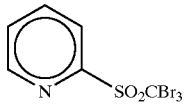

(H-4)

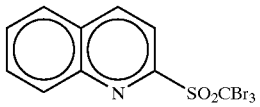

(H-5)

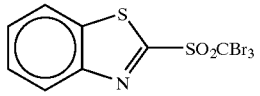

(H-6)

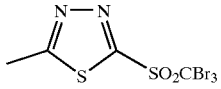

(H-7)

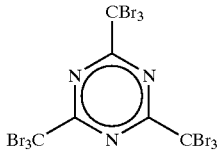

-continued
(H-8)
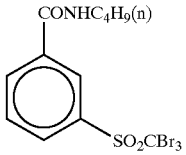
(H-9)
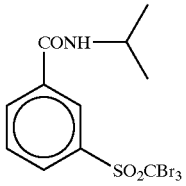
(H-10)
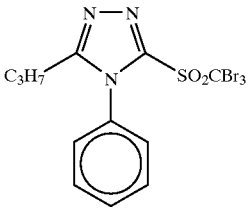
(H-11)
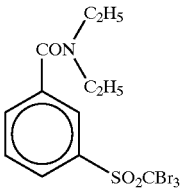
(H-12)
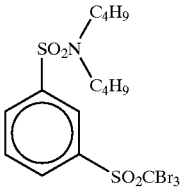
(H-13)
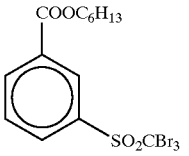
(H-14)
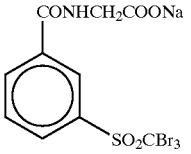
(H-15)
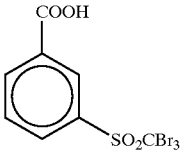
-continued
(H-16)
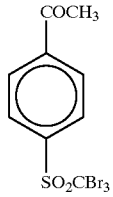
(H-17)
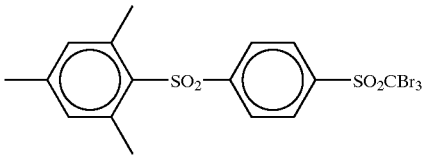
(H-18)
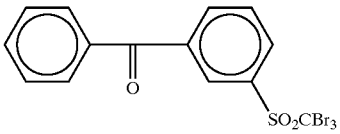
(H-19)
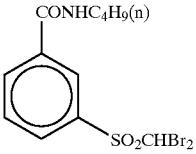
(H-20)
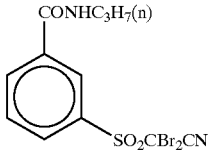
(H-21)
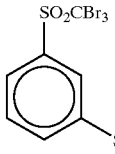
(H-22)
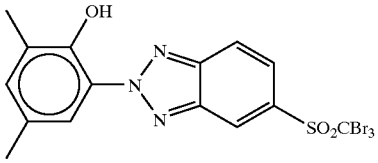
(H-23)
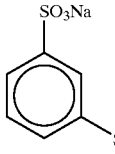
(H-24)
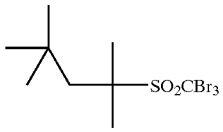
The compound represented by the aforementioned formula (H) is preferably used in an amount of $10^{-4}$ to 0.5 mole, more preferably $10^{-3}$ to 0.1 mole, further preferably $5\times10^{-3}$ to 0.05 mole, per one mole of the non-photosensitive silver source contained in the image-forming layer.

As the method for introducing an antifoggant into the photothermographic material of the present invention, the aforementioned method for introducing the reducing agent can be mentioned. The organic polyhaogenated compound is also preferably added in the form of solid microparticle dispersion.

Other examples of the antifoggant include the mercury(II) salts described in JP-A-11-65021, paragraph 0113, the benzoic acids described in the same, paragraph 0114, the salicylic acid derivatives described in JP-A-2000-206642, the formalin scavenger compounds represented by the formula (S) mentioned in JP-A-2000-221634, the triazine compounds mentioned in JP-A-11-352624, claim 9, the compounds represented by the formula (III) mentioned in JP-A-6-11791, 4-hydroxy-6-methyl-1,3,3a,7-tetrazaindene and so forth.

The photothermographic material of the present invention may contain an azolium salt for the purpose of prevention of fog. Examples of the azolium salt include, for example, the compounds of the formula (XI) disclosed in JP-A-59-193447, the compounds disclosed in JP-B-55-12581 and the compounds of the formula (II) disclosed in JP-A-60-153039. The azolium salt may be present in any site of the photothermographic material, but is preferably in a layer on the side of the material on which a photosensitive layer is present. More preferably, it is added to the layer containing a silver salt of an organic acid.

Regarding the time at which the azolium salt is added to the material, it may be added to the coating solution at any stage of preparing the solution. In case where it is to be present in the layer containing silver salt of an organic acid, the azolium salt may be added during any of the steps from the preparation of the silver salt of an organic acid to the preparation of the coating solution. Preferably, it is added to the coating solution after the step of preparing the silver salt of an organic acid and immediately before coating. The azolium salt to be added may be in any form of powder, solution, microparticle dispersion etc. It may be added as a mixture with other additives such as sensitizing dye, reducing agent, toning agent etc., for example, in the form of their solution.

The amount of the azolium salt to be added in the present invention is not specifically defined, but preferably $1\times10^{-6}$ mol to 2 mol, more preferably $1\times10^{-3}$ mol to 0.5 mol, per mol of silver.

The photothermographic material of the present invention may optionally contain a mercapto compound, disulfide compound or thione compound to control development by accelerating or suppressing the development, or increase efficiency in spectral sensitization, or to improve storability before and after development. Examples thereof include, for example, those compounds described in JP-A-10-62899, paragraphs 0067 to 0069, compounds represented by the formula (I) and specific examples thereof mentioned in JP-A-10-186572, paragraphs 0033 to 0052, and those described in EP0803764A1, page 20, lines 36 to 56. Among them, the mercapto-substituted heteroaromatic compounds described in JP-A-9-297367, JP-A-9-304875, JP-A-2001-100358 and so forth are preferred.

A toning agent is preferably added to the photothermographic material of the present invention. Examples of the toning agent are described in JP-A-10-62899, paragraphs 0054 to 0055, EP0803764A1, page 21, lines 23 to 48 and JP-A-2000-356317 and Japanese Patent Application No. 2000-187298. In particular, preferred are phthalazinones (phthalazinone, phthalazinone derivatives and metal salts thereof, e.g., 4-(1-naphthyl)phthalazinone, 6-chlorophthalazinone, 5,7-dimethyloxyphthalazinone or 2,3-dihydro-1,4-phthalazinedione); combinations of phthalazinone with a phthalic acid derivative (e.g., phthalic acid, 4-methylphthalic acid, 4-nitrophthalic acid, diammonium phthalate, sodium phthalate, potassium phthalate, tetrachlorophthalic acid anhydride); phthalazines (phthalazine, phthalazine derivatives and metal salts thereof, e.g., 4-(1-naphthyl) phthalazine, 6-isopropyl-phthalazine, 6-tert-butylphthalazine, 6-chlorophthalazine, 5,7-dimethoxyphthalazine, 2,3-dihydrophthalazine); and combinations of a phthalazine or derivative thereof and a phthalic acid or derivative thereof, and combinations of a phthalazine or derivative thereof and a phthalic acid or derivative thereof are particularly preferred. Particularly preferred among these is a combination of 6-isopropylphthalazine and phthalic acid or 4-methylphthalic acid.

Plasticizers and lubricants that can be used for the photosensitive layer of the photothermographic material of the present invention are described in JP-A-11-65021, paragraph 0117. Ultrahigh contrast agents for forming ultrahigh contrast images and addition methods and amounts therefor are described in the same, paragraph 0118, JP-A-11-223898, paragraphs 0136 to 0193, JP-A-2000-284399, compounds of the formula (H), formulas (1) to (3), formulas (A) and (B) and those mentioned in Japanese Patent Application No. 11-91652 as compounds of the formulas (III) to (V) (specific compounds: Chemical Formulas 21 to 24); and contrast promoters are described in JP-A-11-65021, paragraph 0102, and JP-A-11-223898, paragraphs 0194 to 0195.

When formic acid or a formic acid salt is used as a strongly fogging substance, it is preferably used on the side having the image-forming layer containing a photosensitive silver halide in an amount of 5 mmol or less, more preferably 1 mmol or less, per 1 mole of silver.

When an ultrahigh contrast agent is used in the photothermographic material of the present invention, an acid formed by hydration of diphosphorus pentoxide or a salt thereof is preferably used together with the ultrahigh contrast agent.

Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth.

Particularly preferably used acids formed by hydration of diphosphorus pentoxide or salts thereof are orthophosphoric acid (salt) and hexametaphosphoric acid (salt).

Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof may be used in a desired amount (coating amount per 1 $m^2$ of the photothermographic material) depending on the desired performance including sensitivity and fog. However, it can be used in an amount of preferably 0.1–500 $mg/m^2$, more preferably 0.5–100 $mg/m^2$.

The photothermographic material of the present invention may be provided with a surface protective layer, for example, to prevent adhesion of dusts to the image-forming layer. The surface protective layer may consist of a single layer or a plurality of layers. The surface protective layer is described in, for example, JP-A-11-65021, paragraphs 0119 to 0120 and Japanese Patent Application No. 2000-171936.

While gelatin is preferred as the binder in the surface protective layer used for the present invention, polyvinyl alcohol (PVA) is also preferably used or used together with gelatin. As the gelatin, for example, inert gelatin (e.g., Nitta Gelatin 750), phthalized gelatin (e.g., Nitta Gelatin 801) and so forth can be used.

Preferred examples of PVA include, for example, those described in JP-A-2000-171936, paragraphs 0009 to 0020, and completely saponified PVA, PVA-105, partially saponified PVA, PVA-205 and PVA-335, denatured polyvinyl alcohol, MP-203 (all from Kuraray Co., Ltd.) and so forth can be mentioned. The application amount of the polyvinyl alcohol (per $m^2$ of the support) for protective layers is preferably 0.3–4.0 $g/m^2$, more preferably 0.3–2.0 $g/m^2$ (per one layer).

When the photothermographic material of the present invention is used for, in particular, printing use in which dimensional change is critical, polymer latex is preferably used also in a protective layer or a back layer.

Such latex is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer and so forth.

As for the binder of the surface protective layer, there may be used the combination of polymer latex disclosed in Japanese Patent Application No. 11-6872, and techniques disclosed in JP-A-2000-267226, paragraphs 0021 to 0025, Japanese Patent Application No. 11-6872, paragraphs 0027 to 0028, and JP-A-2000-19678, paragraphs 0023 to 0041.

The ratio of the polymer latex in the surface protective layer with respect to the total binder is preferably 10–90 weight %, particularly preferably 20–80 weight %.

Coated amount of the total binder (including water-soluble polymer and latex polymer) in the surface protective layer (for one layer) is preferably 0.3–5.0 $g/m^2$, more preferably 0.3–2.0 $g/m^2$ (per $m^2$ of the support).

The temperature for preparation of the coating solution for the image-forming layer of the present invention may preferably be 30–65° C., more preferably 35–60° C., most preferably 35–55° C. The temperature of the coating solution immediately after the addition of the polymer latex may preferably be kept at 30–65° C.

The photothermographic material of the present invention is preferably a so-called single-sided photothermographic material comprising at least one image-forming layer containing a silver halide emulsion on one side of support, and a back layer on the other side.

In the present invention, the photothermographic material preferably contains a matting agent for improving the transferability of the material. Matting agents are described in JP-A-11-65021, paragraphs 0126 to 0127. The matting agent is preferably added in an amount of 1–400 $mg/m^2$, more preferably 5–300 $mg/m^2$, as the amount per 1 $m^2$ of the photothermographic material.

In the present invention, the matting agent may have a regular shape or irregular shape, but it preferably has a regular shape, and a spherical shape is preferably used. The matting agent preferably has a mean particle size of 0.5–10 $\mu$m, more preferably 1.0–8.0 $\mu$m, further preferably 2.0–6.0 $\mu$m. The variation coefficient of size distribution is preferably 50% or less, more preferably 40% or less, further preferably 30% or less. The variation coefficient used herein means a value represented as (standard deviation of particle size)/(average of particle size)×100. It is also preferable to use together two kinds of matting agents having a small variation coefficient and a ratio of mean particle sizes larger than 3.

While the matting degree of the surface of the emulsion layer is not particularly limited so long as the material is free from stardust defects, Beck's smoothness of the surface is preferably 30–2000 seconds, more preferably 40–1500 seconds. Beck's smoothness can be easily determined according to Japanese Industrial Standard (JIS) P8119, "Test Method for Smoothness of Paper and Paperboard by Beck Test Device" and TAPPI Standard Method T479.

In the present invention, the matting degree of the back layer is preferably 10–1200 seconds, more preferably 20–800 seconds, further preferably 40–500 seconds, in terms of the Beck's smoothness.

In the present invention, the matting agent is preferably incorporated into the outermost surface layer or a layer which functions as the outermost surface layer of the photothermographic material, or alternatively, in a layer close to the outer surface or a layer which acts as a so-called protective layer.

The back layers that are applicable to the photothermographic material are described in JP-A-11-65021, paragraphs 0128 to 0130.

The photothermographic material of the present invention preferably has a film surface pH of 7.0 or less, more preferably 6.6 or less, before heat development. While the lower limit is not particularly defined, it is normally around 3. The most preferred pH range is 4–6.2.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development.

Further, a combination of a nonvolatile base such as sodium hydroxide, potassium hydroxide and lithium hydroxide and ammonia is also preferably used. A method for measuring the film surface pH is described in JP-A-2000-2843, paragraph 0123.

In the photothermographic material of the present invention, a hardening agent may be added to the photosensitive layer, protective layer, back layer and other layers. Examples of the hardening agent are described in T. H. James, "THE THEORY OF THE PHOTOGRAPHICOCESS, FOURTH EDITION", Macmillan Publishing Co., Inc., 1977, pp. 77–87. There may be preferably used chromium alum, 2,4-dichloro-6-hydroxy-s-triazine sodium salt, N,N-ethylenebis-(vinylsulfonacetamide), N,N-propylenebis (vinylsulfonacetamide), as well as the polyvalent metal ions described on page 78 of the same, polyisocyanates described in U.S. Pat. No. 4,281,060 and JP-A-6-208193; epoxy compounds described in U.S. Pat. No. 4,791,042; vinylsulfone compounds described in JP-A-62-89048 and so forth.

The hardening agent is added to a coating solution as a solution. Preferred addition time of the solution to the coating solution of the protective layer resides in a period of from 180 minutes before the coating to immediately before the coating, preferably 60 minutes to 10 seconds before the coating. The method and conditions for mixing are not particularly limited so long as the effect of the present invention can be sufficiently attained.

Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Surfactants that can be used in the present invention are described in JP-A-11-65021, paragraph 0132; usable solvents are described in the same, paragraph 0133; usable supports are described in the same, paragraph 0134; usable antistatic and electroconductive layers are described in the same, paragraph 0135; usable methods for forming color images are described in the same, paragraph 0136; and lubricants are described in JP-A-11-84573, paragraphs 0061 to 0064 and Japanese Patent Application No. 11-106881, paragraphs 0049 to 0062.

The photothermographic material of the present invention preferably has an electroconductive layer containing a metal oxide. As a conductive material contained in the electroconductive layer, a metal oxide of which conductivity is increased by introducing oxygen defects or heterogenous metal atoms into the metal oxide is preferably used.

Preferred examples of the metal oxide include ZnO, $TiO_2$ and $SnO_2$, and addition of Al or In to $ZnO_2$, addition of Sb, Nb, P, a halogen element etc. to $SnO_2$ and addition of Nb, Ta etc. to $TiO_2$ are preferred. $SnO_2$ added with Sb is particularly preferred.

The amount of heteroatoms is preferably in the range of 0.01–30 mol %, more preferably 0.1–10 mol %. Although the metal oxide may have any shape such as spherical form, acicular form and tabular form, acicular grains having a long axis/short axis ratio of 2.0 or more, preferably 3.0–50, are preferred in view of impartation of electroconductivity.

The amount of the metal oxide is preferably in the range of 1–1000 mg/m$^2$, more preferably 10–500 mg/m$^2$, further preferably 20–200 mg/m$^2$ Although the electroconductive layer according to the present invention may be disposed on either the emulsion layer side or the back side, it is preferably disposed between a support and a back layer. Specific examples of the electroconductive layer used for the present invention are described in JP-A-7-295146 and JP-A-11-223901.

In the present invention, it is preferable to use a fluorine-containing surfactant. Specific examples of the fluorine-containing surfactant include the compounds described in JP-A-10-197985, JP-A-2000-19680, JP-A-2000-214554 and so forth. The polymer fluorine-containing surfactants described in JP-A-9-281636 can also preferably be used. In the present invention, the fluorine-containing surfactants disclosed in Japanese Patent Application No. 2000-206560 are particularly preferably used.

Preferably used as a transparent support is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development should be eliminated. When the photothermographic material is for medical use, the transparent support may be colored with blue dyes (e.g., with Dye-1 described in Examples of JP-A-8-240877), or may be colorless.

For the support, techniques for undercoating described in JP-A-11-84574 (utilizing water-soluble polyester), JP-A-10-186565 (utilizing styrene/butadiene copolymer), JP-A-2000-39684 and Japanese Patent Application No. 11-106881, paragraphs 0063 to 0080 (utilizing vinylidene chloride copolymer) and so forth are preferably used.

As for antistatic layers and undercoating, techniques disclosed in JP-A-56-143430, JP-A-56-143431, JP-A-58-62646, JP-A-56-120519, JP-A-11-84573, paragraphs 0040 to 0051, U.S. Pat. No. 5,575,957 and JP-A-11-223898, paragraphs 0078 to 0084 can also be used.

The photothermographic material is preferably a monosheet type material (the monosheet type material uses no additional sheet such as an image receiving material, and can form images directly on the photothermographic material itself).

The photothermographic material may further contain an antioxidant, stabilizer, plasticizer, ultraviolet absorber or coating aid. Such additives may be added to any of photosensitive layers or non-photosensitive layers. For these additives, WO98/36322, EP803764A1, JP-A-10-186567, JP-A-10-18568 and so forth can be referred to.

In the preparation of the photothermographic material of the present invention, coating solutions for forming the layers may be coated by any methods. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and so forth. Preferred examples include extrusion coating and slide coating described in Stephen F. Kistler, Petert M. Schweizer, "LIQUID FILM COATING", published by CHAPMAN & HALL Co., Ltd., 1997, pp.399–536, and the slide coating is most preferably used. An example of the shape of a slide coater used for the slide coating is shown in FIG. 11*b*, 1, on page 427 of the aforementioned reference. If desired, two or more layers may be formed at the same time, for example, according to the methods described from page 399 to page 536 of the aforementioned reference, or the methods described in U.S. Pat. No. 2,761,791 and British Patent No. 837,095.

The coating solution for a layer containing a silver salt of an organic acid used in the present invention is preferably a so-called thixotropic flow. As for this technique, JP-A-11-52509 can be referred to.

A coating solution for a layer containing a silver salt of an organic acid used in the present invention preferably has a viscosity of 400–100,000 maP·s, more preferably 500–20,000 maP·s, at a shear rate of 0.1 sec$^{-1}$. The viscosity is preferably 1–200 maP·s, more preferably 5–80 maP·s, at a shear rate of 1000 sec$^{-1}$.

Other techniques that can be used for the photothermographic material of the present invention are also described in EP803764A1, EP883022A1, WO98/36322, JP-A-56-62648, JP-A-58-62744, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-

207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536, JP-A-11-133537, JP-A-11-133538, JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

In order to suppress fluctuation of photographic performance during storage before use (storage in unexposed state) or improve curling or deformation due to rolling, the photothermographic material of the present invention is preferably packaged with a packaging material showing a low oxygen permeability and/or low moisture permeability.

The oxygen permeability is preferably 50 mL/atm·m$^2$·day or less, more preferably 10 mL/atm·m$^2$·day or less, further preferably 1.0 mL/atm·m$^2$·day or less, at 25° C. The moisture permeability is preferably 10 g/atm·m$^2$·day or less, more preferably 5 g/atm·m$^2$·day or less, further preferably 1 g/atm·m$^2$·day or less.

Specific examples of such a packaging material showing a low oxygen permeability and/or low moisture permeability include the packaging materials disclosed in JP-A-8-254793 and JP-A-2000-206653.

Although the development method for the photothermographic material of the invention is not particularly limited, a photothermographic material exposed imagewise is usually developed by heating. The temperature for the development is preferably 80–250° C., more preferably 100–140° C., further preferably 110–130° C. The development time is preferably 1–60 seconds, more preferably 3–30 seconds, further preferably 5–25 seconds, particularly preferably 7–15 seconds.

For the heat development, although either a drum heater or a plate heater may be used, preferred is a plate heater system. For heat development by the plate heater system, the method described in JP-A-11-133572 is preferred. The plate heater system described in this reference is a heat development apparatus wherein a photothermographic material on which a latent image is formed is brought into contact with heating means in a heat development section to obtain a visible image. In this apparatus, the heating means comprises a plate heater, and a plurality of presser rollers are disposed facing to one surface of the plate heater. Heat development of the photothermographic material is attained by passing the material between the presser rollers and the plate heater. The plate heater is preferably sectioned into 2 to 6 stages, and the temperature of the top stage is preferably kept lower by 1–10° C. or so than that of the others.

For example, four plate heaters are used, of which temperature can be independently controlled, and temperature of the heaters are controlled to be 112° C., 119° C., 121° C. and 120° C., respectively. Such a method is also described in JP-A-54-30032, and such a plate heater system can remove moisture and organic solvent contained in the photothermographic material out of the material, and prevent deformation of the support of the photothermographic material due to rapid heating of the material.

As described above, the photothermographic material of the present invention is preferably exposed with a laser light of a wavelength of 350 nm to 430 nm, more preferably 380 nm to 420 nm, further preferably 390 nm to 410 nm.

The photothermographic material of the present invention is preferably exposed with a high illuminance light of 1 mW/mm$^2$ or more for a short period of time. If it is exposed with such a high illuminance light, sufficient sensitivity can be obtained even in the photothermographic material of the present invention containing a high iodine content silver halide emulsion and a non-photosensitive silver salt of an organic acid. That is, compared with low illuminance light exposure, higher sensitivity can be obtained by the high illuminance light exposure according to the present invention.

The illuminance is more preferably 2–50 mW/mm$^2$, further preferably 10–50 mW/mm$^2$.

Although any light source may be used so long as it satisfies the aforementioned conditions, light exposure is preferably performed with a laser light. Preferred is a laser emitting blue to purple light. Examples of a high output semiconductor laser emitting blue to purple light include NLHV 3000E semiconductor laser of Nichia Corporation. One exhibiting an output of 35 mW at a wavelength of 405 nm is disclosed. By using such a laser light, a high illuminance light of 390 nm to 430 nm, which is the particularly preferred wavelength for the present invention, can be obtained.

As an example of a laser imager for medical use provided with a light exposure section and a heat development section, Fuji Medical Dry Laser Imager FM-DP L can be mentioned.

FM-DP L is explained in Fuji Medical Review, No. 8, pages 39–55, and the techniques described therein can of course be used in laser imagers for the photothermographic material of the present invention. Further, the photothermographic material of the present invention can be used as a photothermographic material for laser imagers in "AD network", which was proposed by Fuji Medical System as a network system that conforms to the DICOM standard.

The photothermographic material forms a monochromatic image based on silver image, and is preferably used as a photothermographic material for use in medical diagnosis, industrial photography, printing and COM.

EXAMPLES

The present invention will be specifically explained with reference to the following examples. However, the present invention is not limited to the following examples.

Example 1

Preparation Example of PET Support

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, then melted at 300° C., added with 0.04 weight % of Dye BB having the structure mentioned below, then extruded from a T-die and rapidly cooled to form an unstretched film having such a thickness that the film should have a thickness of 175 $\mu$m after thermal fixation.

Dye BB

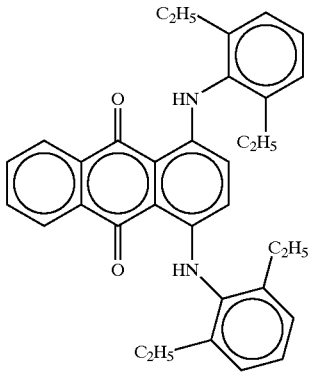

This film was stretched along the longitudinal direction by 3.3 times using rollers of different peripheral speeds, and then stretched along the transverse direction by 4.5 times using a tenter. The temperatures of these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 $\mu$m was obtained.

Surface Corona Discharge Treatment

By using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

Preparation Example of Support Having Undercoat Layers (1) Preparation Examples of Coating Solutions for Undercoat Layers

| | |
|---|---|
| Formulation 1 (for undercoat layer on photosensitive layer side) | |
| Pesresin A-515GB (Takamatsu Yushi K. K., 30 weight % solution) | 59 g |
| Polyethylene glycol monononylphenyl ether (mean ethylene oxide number = 8.5, 10 weight % solution) | 5.4 g |
| MP-1000 (Soken Kagaku K. K. polymer microparticles, mean particle size: 0.4 $\mu$m) | 0.91 g |
| Distilled water | 935 mL |
| Formulation 2 (for 1st layer on back surface) | |
| Styrene/butadiene copolymer latex (solid content: 40 weight %, weight ratio of styrene/butadiene = 68/32) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 mL |
| Distilled water | 854 mL |
| Formulation 3 (for 2nd layer on back surface side) | |
| $SnO_2$/SbO (weight ratio: 9/1, mean particle size: 0.038 $\mu$m, 17 weight % dispersion) | 84 g |
| Gelatin (10% aqueous solution) | 89.2 g |

-continued

| | |
|---|---|
| Metorose TC-5 (Shin-Etsu Chemical Co., Ltd., 2% aqueous solution) | 8.6 g |
| MP-1000 (Soken Kagaku K. K.) | 0.01 g |
| 1 weight % Aqueous solution of sodium dodecylbenzenesulfonate | 10 mL |
| NaOH (1 weight %) | 6 mL |
| Proxel (ICI Co.) | 1 mL |
| Distilled water | 805 mL |

Preparation of Undercoated Support

After applying the aforementioned corona discharging treatment to both surfaces of the aforementioned biaxially stretched polyethylene terephthalate support having a thickness of 175 $\mu$m, one surface (photosensitive layer side) thereof was coated with the undercoating solution of Formulation 1 by a wire bar in a wet coating amount of 6.6 ml/m$^2$ (per one surface) and dried at 180° C. for 5 minutes. Then, the back surface thereof was coated with the undercoating solution of Formulation 2 by a wire bar in a wet coating amount of 5.7 ml/m$^2$ and dried at 180° C. for 5 minutes. The back surface thus coated was further coated with the undercoating solution of Formulation 3 by a wire bar in a wet coating amount of 7.7 ml/m$^2$ and dried at 180° C. for 6 minutes to prepare an undercoated support.

Preparation of Coating Solutions for Back Layer

Preparation of Coating Solution for Antihalation Layer

In an amount of 30 g of gelatin, 24.5 g of polyacrylamide, 2.4 g of monodispersed polymethyl methacrylate microparticles (mean particle size: 8 $\mu$m, standard deviation of particle size: 0.4), 0.03 g of benzoisothiazolinone, 0.22 g of sodium polyethylenesulfonate, 0.1 g of Blue dye compound 1, a yellow dye compound mentioned in Table 1 in such an amount that absorbance of the back layer at 405 nm mentioned in Table 1 should be obtained and 844 ml of water were mixed to prepare a coating solution for antihalation layer.

It was confirmed that the sample using Dye compound No.59 according to the present invention showed sharp absorbance with absorption maximum at 410 nm and a half width of 50 nm or less and thus the dye was in an aggregated state.

Preparation of Coating Solution for Back Surface Protective Layer

In a vessel kept at 40° C., 40 g of gelatin, 0.2 g of sodium polystyrenesulfonate, 2.4 g of N,N-ethylenebis (vinylsulfonacetamide), 0.5 g of sodium di(2-ethylhexyl) sulfosuccinate, 0.03 g of benzisothisazolinone, 37 mg of Fluorine-containing surfactant F-1 (N-perfluorooctylsulfonyl-N-propylalanine potassium salt), 150 mg of Fluorine-containing surfactant F-2 (polyethylene glycol mono(N-perfluorooctylsulfonyl-N-propyl-2-aminoethyl) ether [average polymerization degree of ethylene oxide=15], 64 mg of Fluorine-containing surfactant F-3, 32 mg of Fluorine-containing surfactant F-4, 10 mg of Fluorine-containing surfactant F-7, 5 mg of Fluorine-containing surfactant F-8, 8.8 g of acrylic acid/ethyl acrylate copolymer (copolymerization ratio: 5/95), 0.6 g of Aerosol OT (American Cyanamid), 1.8 g as liquid paraffin of liquid paraffin emulsion and 950 mL of water were mixed to form a coating solution for back surface protective layer.

Preparation of Silver Halide Emulsion

Preparation of Silver Halide Emulsion 1

In a stainless steel reaction vessel, 1420 ml of distilled water was added with 4.3 ml of 1 weight % potassium iodide solution, 3.5 ml of 0.5 mol/L sulfuric acid and 36.7 g of phthalized gelatin and maintained at 40° C. with stirring.

Separately, Solution A was prepared by adding distilled water to 22.22 g of silver nitrate to dilute it to a volume of 195.6 ml, and Solution B was prepared by diluting 21.8 g of potassium iodide with distilled water to a volume of 218 ml. To the aforementioned mixture in the stainless steel reaction vessel, the whole volumes of Solution A and Solution B were added over 12 minutes at constant flow rates. Then, the mixture was added with 10 mL of 3.5 weight % aqueous hydrogen peroxide solution, and further added with 10.8 mL of 10 weight % aqueous solution of benzimidazole.

Further, Solution C was prepared by adding distilled water to 51.86 g of silver nitrate to dilute it to a volume of 317.5 mL, and Solution D was prepared by diluting 60 g of potassium iodide with distilled water to a volume of 600 mL. The whole volume of Solution C was added to the mixture over 90 minutes at a constant flow rate. Solution D was added by the controlled double jet method while pAg was maintained at 8.1. Hexachloroiridic(III) acid potassium salt in an amount of $1\times10^{-4}$ mole per mole of silver was added at one time 10 minutes after the addition of Solutions C and D was started. Further, an aqueous solution of potassium iron (II) hexacyanide in an amount of $3\times10^{-4}$ mole per mole of silver was added at one time 5 seconds after the addition of Solution C was completed. Then, the mixture was adjusted to pH 3.8 by using 0.5 mol/L sulfuric acid, and the stirring was stopped. Thereafter, the mixture was subjected to precipitation, desalting and washing with water, adjusted to pH 5.9 with sodium hydroxide at a concentration of 1 mol/L and added with silver nitrate to prepare silver halide emulsion having pAg of 6.0.

The aforementioned silver halide dispersion was added with 5 mL of a 0.34 weight % methanol solution of 1,2-benzisothiazol-in-3-one with stirring at 38° C., the mixture was warmed to 47° C., and 20 minutes after the warming, added with $7.6\times10^{-5}$ mole of sodium benzenethiosulfonate per mole of silver as a methanol solution. After further 5 minutes, the mixture was added with Tellurium sensitizer B as a methanol solution in an amount of $2.9\times10^{-4}$ mole per mole of silver, followed by ripening for 91 minutes.

The mixture was added with 1.3 mL of 0.8 weight % methanol solution of N,N'-dihydroxy-N'-diethylmelamine, and 4 minutes later, added with $4.8\times10^{-3}$ mole per mole of silver of 5-methyl-2-mercapto-benzimidazole and $5.4\times10^{-3}$ mole per mole of silver of 1-phenyl-2-heptyl-5-mercapto-1,3,4-triazole as a methanol solution to prepare Silver halide emulsion 1.

The grains in the prepared silver halide emulsion were pure silver iodide grains having a mean diameter of 0.040 μm of projected area as circle and a variation coefficient of 18% for diameter as circle. The grain size and others were obtained from averages for 1000 grains by using an electron microscope.

Preparation of Mixed emulsion A for Coating Solution

Silver halide emulsion 1 was dissolved, added with benzothiazolium iodide in an amount of $7\times10^{-3}$ mole per mole of silver as a 1 weight % aqueous solution and further added with water so that the silver halide content per 1 kg of mixed emulsion for coating should become 38.2 g to form Mixed emulsion A for coating solution.

Preparation of Aliphatic Acid Silver Salt Dispersion

Preparation of Recrystallized Behenic Acid

In an amount of 100 kg of behenic acid (Edenor C22–85R, trade name, Henkel Co.) was mixed with 1200 kg of isopropyl alcohol, dissolved at 50° C., filtered through a filter of 10 μm and cooled to 30° C. for recrystallization. The cooling rate for the recrystallization-was controlled to be 3° C./hour. The obtained crystals were filtered by centrifugation, washed with 100 kg of flowing isopropyl alcohol and dried. The obtained crystals were esterified and subjected to GC-FID measurement. As a result, it was found that 96 weight % of behenic acid, 2 weight % lignoceric acid and 2 weight % of arachidic acid were contained.

Preparation of Dispersion of Silver Salt of Aliphatic Acid

In an amount of 88 kg of the recrystallized behenic acid, 422 L of distilled water, 49.2 L of 5 mol/L aqueous solution of NaOH and 120 L of tert-butyl alcohol were mixed and allowed to react at 75° C. for one hour with stirring to obtain Sodium behenate solution B. Separately, 206.2 L of an aqueous solution containing 40.4 kg of silver nitrate (pH 4.0) was prepared and kept at 10° C. A mixture of 635 L of distilled water and 30 L of tert-butyl alcohol contained in a reaction vessel kept at 30° C. was added with the whole volume of Sodium behenate solution B mentioned above and the whole volume of the aqueous silver nitrate solution with sufficient stirring at constant flow rates over the periods of 93 minutes and 15 seconds and 90 minutes, respectively. In this operation, they were added in such a manner that only the aqueous silver nitrate solution should be added for 11 minutes after starting the addition of the aqueous silver nitrate solution. Then, the addition of Sodium behenate solution B was started so that only Sodium behenate solution B should be added for 14 minutes and 15 seconds after finishing the addition of the aqueous silver nitrate solution. In this operation, the outside temperature was controlled so that the temperature in the reaction vessel should become 30° C. and the liquid temperature should be constant. The piping of the addition system for Sodium behenate solution B was warmed by circulating warmed water outside a double pipe, and temperature was controlled such that the liquid temperature at the outlet orifice of the addition nozzle should become 75° C. The piping of the addition system for the aqueous silver nitrate solution was maintained by circulating cold water outside a double pipe. The addition position of Sodium behenate solution B and the addition position of the aqueous silver nitrate solution were arranged symmetrically with respect to the stirring axis as the center, and the positions are controlled to be at heights for not contacting with the reaction mixture.

After finishing the addition of Sodium behenate solution B, the mixture was left with stirring for 20 minutes at the same temperature and then the temperature was increased to 35° C. over 30 minutes, followed by ripening for 210 minutes. After completion of the ripening, the solid content was immediately separated by centrifugal filtration and washed with water until electric conductivity of the filtrate became 30 μS/cm. Thus, a silver salt of an organic acid was obtained. The obtained solid content was stored as a wet cake without being dried.

When the shape of the obtained silver behenate grains was evaluated by an electron microscopic photography, the grains were crystals having a=0.21 μm, b=0.4 μm and c=0.4 μm in mean values, mean aspect ratio of 2.1, mean diameter of 0.51 μm as spheres, and variation coefficient of 11% for diameter as spheres (a, b and c have the meanings defined above).

To the wet cake corresponding to 260 kg of the dry solid content was added with 19.3 kg of polyvinyl alcohol (PVA-217, trade name) and water to make the total amount 1000 kg, and the mixture was made into slurry by dissolver fins and further pre-dispersed by a pipeline mixer (PM-10, Mizuho Kogyo).

Then, the pre-dispersed stock dispersion was treated three times by using a dispersing machine (Microfluidizer M-610, trade name of Microfluidex International Corporation, using Z interaction chamber) with a pressure controlled to be 1150 kg/cm$^2$ to obtain silver behenate dispersion. As for the cooling operation, a dispersion temperature of 18° C. was achieved by providing coiled heat exchangers fixed before and after the interaction chamber and controlling the temperature of refrigerant.

Preparation of Dispersion of Reducing Agent

Preparation of Dispersion of Reducing Agent 2

In an amount of 10 kg of Reducing agent 2 (6,6'-di-tert-butyl-4,4'-dimethyl-2,2'-butylidenediphenol) and 16 kg of 10 weight % aqueous solution of denatured polyvinyl alcohol (Poval MP203, Kuraray Co., Ltd.) were added with 10 kg of water, and mixed sufficiently to form slurry.

The slurry was fed by a diaphragm pump to a bead mill of horizontal type (UVM-2, Imex Co., Ltd.) containing zirconia beads having a mean diameter of 0.5 mm, and dispersed for 3 hours and 30 minutes. Then, the dispersion was added with 0.2 g of benzothiazolinone sodium salt and water so that the concentration of the reducing agent should become 25 weight % to obtain a dispersion of Reducing agent 2.

The reducing agent particles contained in the dispersion of reducing agent obtained as described above had a median diameter of 0.40 μm and the maximum particle size of 1.5 μm or less. The obtained dispersion was filtered through a polypropylene filter having a pore size of 3.0 μm to remove contaminants such as dusts and stored.

Preparation of Dispersion of Hydrogen Bond-Forming Compound 1

In an amount of 10 kg of Hydrogen bond-forming compound 1 (tri(4-tert-butylphenyl)phosphine oxide) and 16 kg of 10 weight % aqueous solution of denatured polyvinyl alcohol (Poval MP203, Kuraray Co., Ltd.) were added with 10 kg of water, and mixed sufficiently to form slurry.

The slurry was fed by a diaphragm pump to a bead mill of horizontal type (UVM-2, Imex Co., Ltd.) containing zirconia beads having a mean diameter of 0.5 mm, and dispersed for 3 hours and 30 minutes. Then, the dispersion was added with 0.2 g of benzothiazolinone sodium salt and water so that the concentration of the hydrogen bond-forming compound should become 25 weight % to obtain a dispersion of Hydrogen bond-forming compound 1.

The hydrogen bond-forming compound particles contained in the dispersion of the hydrogen bond-forming compound obtained as described above had a median diameter of 0.35 μm and the maximum particle size of 1.5 μm or less. The obtained dispersion of the hydrogen bond-forming compound was filtered through a polypropylene filter having a pore size of 3.0 μm to remove contaminants such as dusts and stored.

Preparation of Dispersion of Development Accelerator 1

In an amount of 10 kg of Development accelerator 1 and 20 kg of a 10 weight % aqueous solution of denatured polyvinyl alcohol (Poval MP203, Kuraray Co., Ltd.) were added with 10 kg of water, and mixed sufficiently to form slurry.

The slurry was fed by a diaphragm pump to a bead mill of horizontal type (UVM-2, Imex Co., Ltd.) containing zirconia beads having a mean diameter of 0.5 mm, and dispersed for 3 hours and 30 minutes. Then, the dispersion was added with 0.2 g of benzothiazolinone sodium salt and water so that the concentration of the development accelerator should become 20 weight % to obtain a dispersion of Development accelerator 1.

The development accelerator particles contained in the dispersion of development accelerator obtained as described above had a median diameter of 0.4 μm and the maximum particle size of 1.6 μm or less. The obtained dispersion of development accelerator was filtered through a polypropylene filter having a pore size of 3.0 μm to remove contaminants such as dusts and stored.

Solid dispersions of Development accelerators 2, 3 and Toning agent 1 were also obtained as 20 weight % dispersions in the same manner as the method used for obtaining the dispersion of Development accelerator 1

Preparation of Dispersions of Polyhalogenated Compounds

Preparation of Dispersion of Organic Polyhalogenated Compound 1

In an amount of 10 kg of Organic polyhalogenated compound 1 (tribromomethanesulfonylbenzene), 10 kg of 20 weight % aqueous solution of denatured polyvinyl alcohol (Poval MP203, Kuraray Co., Ltd.), 0.4 kg of 20 weight % aqueous solution of sodium triisopropylnaphthalenesulfonate and 14 kg of water were mixed sufficiently to form slurry.

The slurry was fed by a diaphragm pump to a bead mill of horizontal type (UVM-2, Imex Co., Ltd.) containing zirconia beads having a mean particle size of 0.5 mm, and dispersed for 5 hours. Then, the dispersion was added with 0.2 g of benzisothiazolinone sodium salt and water so that the concentration of the organic polyhalogenated compound should become 26 weight % to obtain dispersion of Organic polyhalogenated compound 1.

The organic polyhalogenated compound particles contained in the organic polyhalogenated compound dispersion obtained as described above had a median particle diameter of 0.41 μm and the maximum particle diameter of 2.0 μm or less. The obtained organic polyhalogenated compound dispersion was filtered through a polypropylene filter having a pore size of 10.0 μm to remove contaminant such as dusts and stored.

Preparation of Dispersion of Organic Polyhalogenated Compound 2

In an amount of 10 kg of Organic polyhalogenated compound 2 (N-butyl-3-tribromomethanesulfonylbenzamide), 20 kg of 10 weight % aqueous solution of denatured polyvinyl alcohol (Poval MP203, Kuraray Co., Ltd.) and 0.4 kg of 20 weight % aqueous solution of sodium triisopropylnaphthalenesulfonate were mixed sufficiently to form slurry.

The slurry was fed by a diaphragm pump to a bead mill of horizontal type (UVM-2, Imex Co., Ltd.) containing zirconia beads having a mean particle size of 0.5 mm, and dispersed for 5 hours. Then, the dispersion was added with 0.2 g of benzisothiazolinone sodium salt and water so that the concentration of the organic polyhalogenated compound should become 30 weight %. This dispersion was warmed to 40° C. for 5 hours to obtain dispersion of Organic polyhalogenated compound 2.

The organic polyhalogenated compound particles contained in the organic polyhalogenated compound dispersion obtained as described above had a median particle size of 0.40 μm and the maximum particle size of 1.3 μm or less. The obtained organic polyhalogenated compound dispersion was filtered through a polypropylene filter having a pore size of 3.0 μm to remove contaminant such as dusts and stored.

Preparation of Solution of Phthalazine Compound 1

In an amount of 8 kg of denatured polyvinyl alcohol MP-203 (Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of Phthalazine compound 1 (6-isopropylphthalazine) to obtain 5 weight % solution of Phthalazine compound 1.

Preparation of Aqueous Solutions of Mercapto Compounds

Preparation of Aqueous Solution of Mercapto Compound 1

In an amount of 7 g of Mercapto compound 1 (1-(3-sulfophenyl)-5-mercaptotetrazole sodium salt) was dissolved in 993 g of water to obtain 0.7 weight % aqueous solution.

Preparation of Aqueous Solution of Mercapto Compound 2

In an amount of 20 g of Mercapto compound 2 (1-(3-methylureido)-5-mercaptotetrazole sodium salt) was dissolved in 980 g of water to obtain 2.0 weight % aqueous solution.

Preparation of SBR Latex Solution

SBR latex having Tg of 22° C. was prepared as follows.

By using ammonium persulfate as a polymerization initiator and an anionic surfactant as an emulsifier, 70.0 weight % of styrene, 27.0 weight % of butadiene and 3.0 weight % of acrylic acid were emulsion-polymerized and aged at 80° C. for 8 hours. Then, the reaction mixture was cooled to 40° C., adjusted to pH 7.0 with aqueous ammonia and added with Sandet BL (manufactured by SANYO CHEMICAL INDUSTRIES, LTD.) to a concentration of 0.22 weight %. Further, the mixture was adjusted to pH 8.3 with addition of 5% sodium hydroxide and further adjusted to pH 8.4 with aqueous ammonia.

The ratio of $Na^+$ ions and $NH_4^+$ ions used in this case was 1:2.3 (molar ratio). Further, this mixture was added with 0.15 mL of 7% aqueous solution of benzoisothiazolinone sodium salt per 1 kg of the mixture to prepare SBR latex solution. SBR latex: latex of —St(70.0)—Bu(27.0)—AA(3.0)—(Tg: 22° C., mean particle size: 0.1 μm, concentration: 43 weight %, equilibrated moisture content at 25° C. and relative humidity of 60%: 0.6 weight %, ion conductivity: 4.2 mS/cm (measured for the latex stock solution (43 weight %) at 25° C. by using a conductometer, CM-30S, manufactured by Toa Electronics, Ltd.), pH 8.4)

SBR latex having a different Tg can be prepared in the same manner by suitably changing ratios of styrene and butadiene.

Preparation of Dispersion of Pigment 1

A slurry was prepared by adding 250 g of water to 64 g of C.I. Pigment Blue 60 and 6.4 g of Demor N (trade name, Kao Corporation) and then mixing the resultant sufficiently. The mixture and zirconia beads having a mean diameter of 0.5 mm were fed to a vessel, and dispersed by a dispersion mixer (¼G sand grinder mill, Imex Co., Ltd.) for 25 hours to obtain dispersion of Pigment 1. The pigment particles contained in the resultant dispersion have an average particle size of 0.21 μm.

Preparation of Coating Solution 1 for Emulsion Layer (Photosensitive Layer)

A coating solution for emulsion layer was prepared by adding successively 1000 g of the organic acid silver salt dispersion, 276 mL of water, 32.8 g of the dispersion of Pigment 1, 3.2 g of the dispersion of Organic polyhalogenated compound 1, 8.7 g of the dispersion of Organic polyhalogenated compound 2, 173 g of the solution of Phthalazine compound 1, 1082 g of the SBR latex solution (Tg: 22° C.), 155 g of the dispersion of Reducing agent 2, 55 g of the dispersion of Hydrogen bond-forming compound 1, 2 g of the dispersion of Development accelerator 1, 3 g of the dispersion of Development accelerator 2, 2 g of the dispersion of Toning agent 1 and 6 mL of the aqueous solution of Mercapto compound 2, which were obtained above, adding Mixed emulsion A of silver halide immediately before coating and mixing them sufficiently, fed as it was to a coating die and coated.

The viscosity of the coating solution for emulsion layer was measured by a B-type viscometer manufactured by Tokyo Keiki K. K. and found to be 40 [maP·s] at 40° C. (Rotor No. 1, 60 rpm).

The viscosity of the coating solution was measured at 25° C. by an RFS fluid spectrometer produced by Rheometric Far East Co., Ltd., and found to be 530, 144, 96, 51 and 28 [maP·s] at shear rates of 0.1, 1, 10, 100 and 1000 [1/second], respectively.

The zirconium content in the coating solution was 0.25 mg per 1 g of silver.

Preparation of Coating Solution for Intermediate Layer of Emulsion Layer Side

In an amount of 1000 g of polyvinyl alcohol, PVA-205 (Kuraray Co., Ltd.), 272 g of dispersion of pigment 1, and 4200 mL of 19 weight % solution of methyl methacrylate/styrene/butyl acrylate/hydroxyethyl methacrylate/acrylic acid copolymer (copolymerization ratio (by weight): 64/9/20/5/2) latex were added with 27 mL of 5 weight % aqueous solution of Aerosol OT (American Cyanamid), 135 mL of 20 weight % aqueous solution of phthalic acid diammonium salt and water in such an amount giving a total amount of 10000 g and adjusted to pH 7.5 with NaOH to form a coating solution for intermediate layer. This coating solution was fed to a coating die in such an amount that gave a coating amount of 9.1 mL/$m^2$.

The viscosity of the coating solution measured by a B-type viscometer at 40° C. (Rotor No. 1, 60 rpm) was 58 [mpa·s].

Preparation of Coating Solution for 1st Protective Layer of Emulsion Layer Side

In an amount of 64 g of inert gelatin was dissolved in water, and added with 80 g of 27.5 weight % latex solution of methyl methacrylate/styrene/butyl acrylate/hydroxyethyl methacrylate/acrylic acid copolymer (copolymerization ratio (by weight): 64/9/20/5/2), 23 mL of 10 weight % methanol solution of phthalic acid, 23 mL of 10 weight % aqueous solution of 4-methylphthalic acid, 28 mL of 0.5 mol/L sulfuric acid, 5 mL of 5 weight % aqueous solution of Aerosol OT (American Cyanamid), 0.5 g of phenoxyethanol, 0.1 g of benzoisothiazolinone and water in such an amount that gave a total amount of 750 g to form a coating solution. The coating solution was mixed with 26 mL of 4 weight % chromium alum by a static mixer immediately before coating, and fed to a coating die in such an amount that gave a coating amount of 18.6 mL/$m^2$.

The viscosity of the coating solution measured by a B-type viscometer (Rotor No. 1, 60 rpm) at 40° C. was 20 [maP·s].

Preparation of Coating Solution for 2nd Protective Layer of Emulsion Layer Side

In an amount of 80 g of inert gelatin was dissolved in water, added with 102 g of 27.5 weight % latex solution of methyl methacrylate/styrene/butyl acrylate/hydroxyethyl methacrylate/acrylic acid copolymer (copolymerization ratio (by weight): 64/9/20/5/2), 3.2 mL of 5 weight % solution of Fluorine-containing surfactant F-1 (N-perfluorooctylsulfonyl-N-propylalanine potassium salt), 32 mL of 2 weight % aqueous solution of Fluorine-containing surfactant F-2 (polyethylene glycol mono(N-perfluorooctylsulfonyl-N-propyl-2-aminoethyl) ether [average polymerization degree of ethylene oxide=15], 3 mL of 5 weight % solution of Fluorine-containing surfactant F-5, 10 mL of 2 weight % solution of Fluorine-containing surfactant F-6, 23 mL of 5 weight % aqueous solution of Aerosol OT (American Cyanamid), 4 g of polymethyl methacrylate microparticles (mean particle size: 0.7 μm), 21 g of polymethyl methacrylate microparticles (mean particle size: 4.5 μm), 1.6 g of 4-methylphthalic acid, 4.8 g of phthalic acid, 44 mL of 0.5 mol/L sulfuric acid, 10 mg of benzoisothiazolinone and water in such an amount that gave a total amount of 650 g, and further mixed with 445 mL of an aqueous solution containing 4 weight % of chromium alum and 0. 67 weight % of phthalic acid by a static mixer immediately before coating to form a coating solution for surface protective layer, which was fed to a coating die in such an amount that gave a coating amount of 8.3 mL/m$^2$.

Viscosity of the coating solution measured by a B-type viscometer (Rotor No. 1, 60 rpm) at 40° C. was 19 [maP·s].

Preparation of Photothermographic Material 1

The back surface side of the aforementioned undercoated support was simultaneously applied with the coating solution for antihalation layer and the coating solution for back surface protective layer as stacked layers so that the coated gelatin amounts in the layers should become 0.4 g/m$^2$ and 1.7 g/m$^2$, respectively, and the coated layers were dried to form a back layer.

On the undercoated surface on the side opposite to the back surface side, an emulsion layer, intermediate layer, first protective layer and second protective layer were simultaneously coated in this order as stacked layers by the slide bead coating method to prepare a sample of photothermographic material. In the preparation, temperature was adjusted to 31° C. for the emulsion layer and the intermediate layer, 36° C. for the first protective layer and 37° C. for the second protective layer.

The coating amounts (g/m$^2$) of the compounds in the emulsion layer were as follows.

| | |
|---|---|
| Silver behenate | 5.55 |
| Polyhalogenated compound 1 | 0.02 |
| Polyhalogenated compound 2 | 0.06 |
| Phthalazine compound 1 | 0.19 |
| SBR Latex | 9.67 |
| Reducing agent 2 | 0.81 |
| Hydrogen bond-forming compound 1 | 0.30 |
| Development accelerator 1 | 0.010 |
| Development accelerator 2 | 0.015 |
| Toning agent 1 | 0.010 |
| Mercapto compound 2 | 0.002 |
| Silver halide (as Ag) | 0.091 |

The conditions for coating and drying were as follows.

The coating was performed at a speed of 160 m/min, the clearance between the end of the coating die and the support was set to be 0.10–0.30 mm, and pressure of the decompression chamber was set to be lower than the atmospheric pressure by 196–882 Pa. The support was destaticized with an ionic wind before the coating.

The coating solutions were cooled with a wind at a dry bulb temperatures of 10–20° C. in a subsequent chilling zone, then transported without contact, and dried with a dry wind at a dry bulb temperatures of 23–45° C. and a wet bulb temperature of 15–21° C. in a coiled type drying apparatus of non-contact type.

After the drying, the coated support was conditioned for moisture content at 25° C. and relative humidity of 40–60% and heated so that the film surface temperature should become 70–90° C. After the heating, the film surface was cooled to 25° C.

Matting degree of the produced photothermographic material was 550 seconds for the emulsion layer side and 130 seconds for the back surface as Beck's smoothness. Further, pH of film surface was measured and found to be 6.0 for the photosensitive layer side.

Chemical structures of the compounds used in the examples of the present specification are shown below.

Tellurium sensitizer B

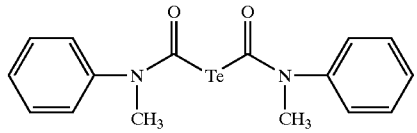

Blue dye compound 1

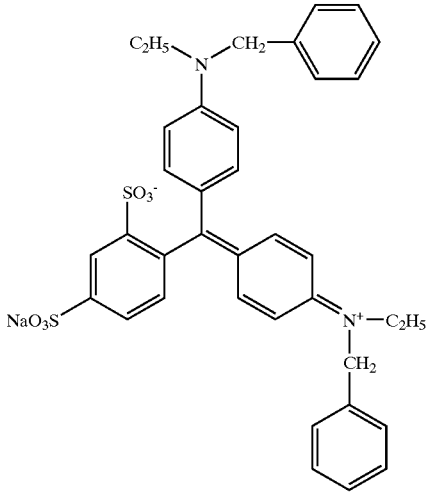

Yellow dye compound 1

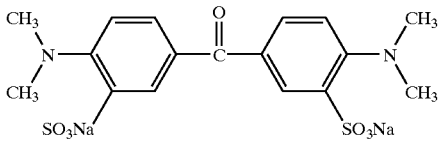

Reducing agent 2

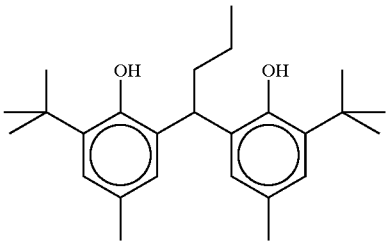

Hydrogen bond-forming compound 1

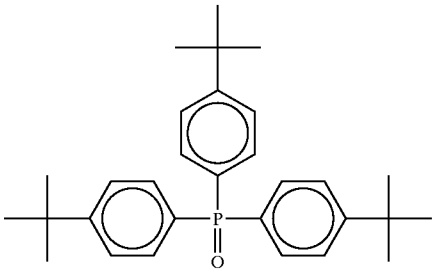

Polyhalogenated compound 1

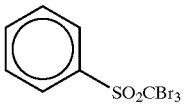

-continued

Polyhalogenated compound 2

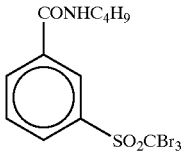

Mercapto compound 1

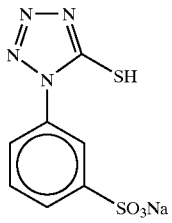

Mercapto compound 2

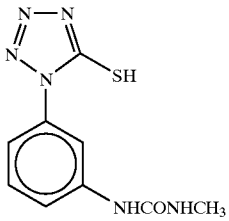

Phthalazine compound 1

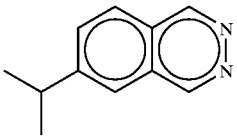

Development accelerator 1

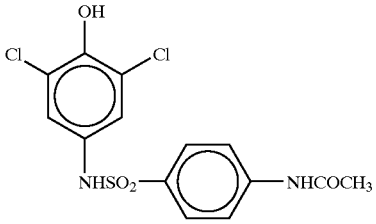

Development accelerator 2

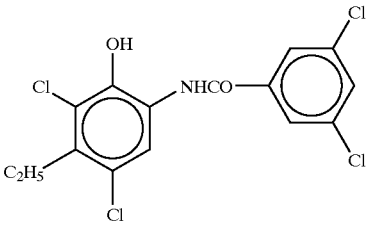

Development accelerator 3

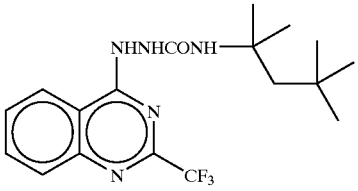

-continued

Toning agent 1

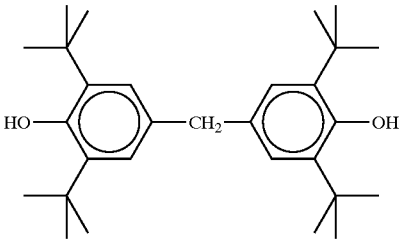

(F-1)

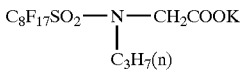

(F-2)

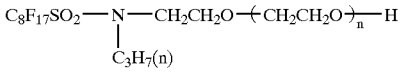

n = 15 (average)

(F-3)

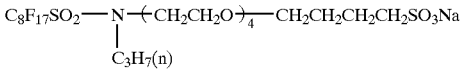

(F-4)

$C_8H_{17}SO_3K$ (F-5)

$CF_3(CF_2)_nCH_2CH_2SCH_2CH_2COOLi$

Mixture of compounds where n = 5–11

(F-6)

$CF_3(CF_2)_nCH_2CH_2O(CH_2CH_2O)_mH$

Mixture of compounds where n = 5–11 and m = 5–15

(F-7)

$CF_3(CF_2)_nCH_2CH_2SO_3Na$

Mixture of compounds where n = 5–11

(F-8)

$C_6H_{13}CH_2CH_2SO_3Li$

Preparation for Evaluation of Photographic Performance

The obtained samples were cut into the half size, packaged with the following packaging material in an environment at a temperature of 25° C. and a relative humidity of 50%, and stored at an ordinary temperature for 2 weeks.

Packaging Material

PET (10 μm)/PE (12 μm)/aluminum foil (9 μm)/Ny (15 μm)/polyethylene containing 3% of carbon (50 μm)

Oxygen permeability: 0.02 mL/atm·$m^2$·25° C.·day

Moisture permeability: 0.10 g/atm·$m^2$·25° C.·day

Example 2

Silver halide emulsions 2, 3 and 4 each having a uniform silver halide composition shown in Table 1 were prepared in the same manner as in Example 1 by changing the halogen composition of the added emulsion. Grain size of the silver halide grains was controlled to be 0.040 μm as a diameter of projected area as circle by changing the temperature during the grain formation. Addition amounts of Silver halide emulsions 1 to 4 and the antihalation dye in BC layer were changed so as to obtain optical densities mentioned in Table 1 to prepare Photothermographic materials 2 to 11.

Photothermographic materials 1 to 11 obtained in Examples 1 and 2 were evaluated as follows.

Light Exposure of Photothermographic Material

Each of the photothermographic materials was exposed as follows.

A semiconductor laser NLHV 3000E produced by Nichia Corporation was mounted on the light exposure section of Fuji Medical Dry Imager FM-DPL produced by Fuji Photo Film Co., Ltd., and the beam diameter was narrowed to about 80 $\mu$m. The photothermographic material was exposed for $10^{-6}$ second with an illuminance of the laser light at the photothermographic material surface of 0 and by varying the illuminance in the range of 1 mW/mm$^2$ to 1000 mW/mm$^2$. The emission wavelength of the laser light was 405 nm.

Development of Photothermographic Material

Each exposed photothermographic material was subjected to heat development as follows.

The heat development was performed in the heat development section of Fuji Medical Dry Imager FM-DPL, in which temperatures of four of panel heaters were adjusted to 112° C., 121° C., 121° C. and 121° C., with such increasing the film transportation speed that the total heat development time should become 14 seconds.

Evaluation of Color Tone

Color tone in a portion showing minimum optical density was evaluated by visual inspection and represented according to the following criteria.

A: Favorable high clear feeling was obtained.

B: Color tone was slightly yellowish, but acceptable as commercial product.

C: Unfavorable strong yellowish color tone remained.

Evaluation of Sharpness

Each photothermographic material was exposed in the same manner as the aforementioned exposure, but exposed in a square wave pattern, and subjected to heat development in a similar manner. Sharpness was represented by variable density difference of square wave pattern with a spatial frequency of 2.5 lines/mm standardized based on variable density difference of 0.01 line/mm. The obtained results of sharpness were represented with a relative value based on the sharpness of Photothermographic material 1, which was taken as 100.

The results are shown in Table 1.

Evaluation of Print Out Performance

Each developed photothermographic material was placed and left for 3 days in a room at 30° C. and 70% RH under irradiation with a fluorescent lamp at 1000 luxes. Print out was represented with difference of fog density obtained immediately after the development and fog density obtained after leaving the material under the aforementioned conditions for 3 days. It is more preferred that a smaller increase of fog should be observed even after leaving under such conditions.

The obtained results are shown in Table 1.

TABLE 1

| | | Silver | Antihalation dye in BC layer | | | | | | |
|---|---|---|---|---|---|---|---|---|---|
| Photo-thermographic material | Silver halide emulsion | iodide content (mol %) | Compound No. | Optical density at 405 nm | Absorption maximum wavelength | Evaluation of color tone | Sharpness | Print out | Note |
| 1 | 1 | 100 | No. 59 | 0.50 | 404 nm | A~B | 100 | 0.00 | Invention |
| 2 | 1 | 100 | No. 59 | 0.30 | 404 nm | A | 97 | 0.00 | Invention |
| 3 | 1 | 100 | No. 59 | 0.10 | 404 nm | A | 92 | 0.00 | Invention |
| 4 | 1 | 100 | None | 0.00 | — | A | 80 | 0.00 | Comparative |
| 5 | 2 | 90 | No. 59 | 0.30 | 404 nm | A | 95 | 0.01 | Invention |
| 6 | 3 | 40 | No. 59 | 0.30 | 404 nm | A | 90 | 0.05 | Invention |
| 7 | 4 | 0 | None | 0.00 | — | A | 70 | 0.60 | Comparative |
| 8 | 4 | 0 | No. 59 | 0.30 | 404 nm | A | 75 | 0.60 | Comparative |
| 9 | 4 | 0 | No. 59 | 0.50 | 404 nm | A~B | 77 | 0.60 | Comparative |
| 10 | 4 | 0 | No. 59 | 0.80 | 404 nm | B | 80 | 0.60 | Comparative |
| 11 | 4 | 0 | No. 59 | 2.00 | 404 nm | C | 80 | 0.60 | Comparative |

As clearly seen from the results shown in Table 1, the photothermographic materials according to the present invention showed high sharpness and superior color tone in the portions of minimum optical density. Further, they favorably showed superior print out performance.

Example 3

Photothermographic material 12 was produced in the same manner as in Example 1 except that the yellow dye according to the present invention was also added to the coating solution for photosensitive layer. Photothermographic materials 12 to 14 were prepared in the same manner by changing coating amounts of the dye and silver iodide content in the silver halide. The photothermographic materials were evaluated in the same manner as described above, and the results are shown in Table 2.

Further, sensitivity was measured as follows.

Sensitivity

Density of the obtained image was measured by using a densitometer and plotted against logarithm of light exposure to prepare a characteristic curve. Optical density of unexposed area was considered fog, and sensitivity was represented with reciprocal of light exposure giving an optical density of 3.0. The results of sensitivity were represented with relative values based on the sensitivity of Photothermographic material 2, which was taken as 100.

TABLE 2

| Photo-theromo-graphic material | Silver halide emulsion | Silver iodide content (mol %) | Antihalation dye in BC layer: Com-pound No. | Antihalation dye in BC layer: Optical density at 405 nm provided by dye for BC layer side | Antihalation dye in BC layer: Ab-sorption maximum wave-length | Addition of dye to photosensitive layer: Com-pound No. | Addition of dye to photosensitive layer: Optical absorbance at 405 nm provided by dye for photosensitive layer side | Sensitivity | Evaluation of color tone | Sharp-ness | Print out | Note |
|---|---|---|---|---|---|---|---|---|---|---|---|---|
| 2 | 1 | 100 | No. 59 | 0.30 | 404 nm | None | 0.00 | 100 | A | 100 | 0.00 | Invention |
| 12 | 1 | 100 | No. 59 | 0.30 | 404 nm | No. 36 | 0.20 | 75 | A | 105 | 0.00 | Invention |
| 8 | 4 | 0 | No. 59 | 0.30 | 404 nm | None | 0.00 | 90 | A | 77 | 0.60 | Comparative |
| 13 | 4 | 0 | No. 59 | 0.30 | 404 nm | No. 36 | 0.10 | 70 | A | 85 | 0.60 | Comparative |
| 14 | 4 | 0 | No. 59 | 0.30 | 404 nm | No. 36 | 0.30 | 45 | A~B | 95 | 0.60 | Comparative |

As clearly seen from the results shown in Table 2, the photothermographic materials having the characteristics of the present invention showed superior relationship between sensitivity and sharpness.

Example 4

Pure silver iodide emulsion 5 (Silver halide emulsion 5) having a mean grain size of 70 nm and variation coefficient of 8% was prepared in the same manner as the preparation of Silver halide emulsion 1 in Example 1 except that the temperature during the grain formation was increased. Silver halide emulsion 6 having a mean grain size of 28 nm and variation coefficient of 12% was prepared in the same manner by changing the temperature.

In the present invention, different silver halide emulsions can be mixed in an arbitrary ratio as described above.

Example 5

Photothermographic materials were prepared in the same manner as in Example 1, except that the BC antihalation dye was changed to those mentioned in Table 3. The results of evaluation of the materials performed in the same manner as described above are shown in Table 3. As clearly seen from the results shown in Table 3, the photothermographic materials having the characteristics of the present invention showed superior relationship between sensitivity and sharpness.

TABLE 3

| Photo-thermographic material | Silver halide emulsion | Silver iodide content (mol %) | Antihalation dye in BC layer: Compound No. | Antihalation dye in BC layer: Optical density at 405 nm | Antihalation dye in BC layer: Absorption maximum wavelength (film) | Evaluation of color tone | Sharpness | Print out | Note |
|---|---|---|---|---|---|---|---|---|---|
| 15 | 1 | 100 | 11 | 0.30 | 391 nm | A | 98 | 0.00 | Invention |
| 16 | 1 | 100 | 24 | 0.30 | 388 nm | A | 97 | 0.00 | Invention |
| 17 | 1 | 100 | 61 | 0.30 | 410 nm | A | 98 | 0.00 | Invention |
| 18 | 1 | 100 | 60 | 0.30 | 408 nm | A | 97 | 0.00 | Invention |
| 19 | 1 | 100 | 57 | 0.30 | 391 nm | A~B | 95 | 0.00 | Invention |
| 20 | 1 | 100 | 66 | 0.30 | 430 nm | A | 96 | 0.00 | Invention |
| 21 | 1 | 100 | 67 | 0.30 | 422 nm | A | 96 | 0.00 | Invention |
| 22 | 1 | 100 | 72 | 0.30 | 432 nm | A | 98 | 0.00 | Invention |
| 23 | 1 | 100 | 76 | 0.30 | 423 nm | A | 97 | 0.00 | Invention |
| 24 | 1 | 100 | 83 | 0.30 | 410 nm | A | 97 | 0.00 | Invention |
| 25 | 1 | 100 | 88 | 0.30 | 429 nm | A~B | 94 | 0.00 | Invention |

Photothermographic material 15 was prepared in the same manner as the preparation of Photothermographic material 1 except that Silver halide emulsions 1, 5 and 6 mixed in a ratio of 60:15:25 were used instead of Silver halide emulsion 1.

The obtained photothermographic material was evaluated in the same manner as described above. As a result, favorable results were obtained. The mean gradation of the photothermographic material was 2.7.

Photothermographic material 16 was prepared in a similar manner by using Silver halide emulsions 1 and 5 mixed in a ratio of 85:15. The photothermographic material was evaluated in the same manner as in Example 3. As a result, favorable results were obtained.

As for Photothermographic materials 20 to 25, each dye was made into solid microparticle dispersion as described below and added together with a base precursor that was similarly made into solid microparticle dispersion.

Preparation of Coating Solutions for Back Surface

Preparation of Base Precursor Solid Microparticle Dispersion (a)

In an amount of 1.5 kg of Base precursor compound 1, 225 g of Demor N (trade name, Kao Corporation), 937.5 g of diphenylsulfone and 15 g of p-hydroxybenzoic acid butyl ester (trade name: Mekkins, Ueno Fine Chemicals Industry) were added with distilled water to a total weight of 5.0 kg and mixed, and the mixture was dispersed in a bead mill of horizontal type (UVM-2, Imex Co., Ltd.). As for the dispersion conditions, the mixture was fed by a diaphragm pump to UVM-2 containing zirconia beads having a mean diameter of 0.5 mm, and dispersion was continued at an internal pressure of 50 hPa or higher until the desired mean particle size was obtained.

The dispersion was dispersed until a ratio of absorbance at 450 nm and absorbance at 650 nm (D450/D650) of the dispersion obtained by spectrophotometric measurement of absorbance reached 2.2 or more. The obtained dispersion was diluted with distilled water so as to obtain a base precursor concentration of 20 weight % and filtered through a filter (mean pore size: 3 μm, made of polypropylene) to remove dusts before practical use.

Preparation of Dye Solid Microparticle Dispersion

In an amount of 6.0 kg of Dye compound 66, 3.0 kg of sodium p-dodecylbenzenesulfonate, 0.6 kg of Demor SNB (trade name, Kao Corporation) and 0.15 kg of antifoaming agent (Safinol 104E, trade name, Nisshin Kagaku Co.) were mixed with distilled water to obtain a total liquid amount of 60 kg. The mixture was dispersed in a bead mill of horizontal type (UVM-2, Imex Co., Ltd.) using zirconia beads having a mean diameter of 0.5 mm.

The dispersion operation was continued until a ratio of absorbance at 650 nm and absorbance at 750 nm (D650/D750) of the dispersion obtained by spectrophotometric measurement of absorbance reached 5.0 or more. The obtained dispersion was diluted with distilled water so as to obtain a cyanine dye concentration of 6 weight %, filtered through a filter (mean pore size: 1 μm) to remove dusts and used.

In the same manner, solid microparticle dispersions of Dye compounds 67, 72, 76, 83 and 88 were prepared.

Preparation of Coating Solution for Antihalation Layer

In an amount of 30 g of gelatin, 24.5 g of polyacrylamide, 2.2 g of 1 mol/L sodium hydroxide, 2.4 g of monodispersed-polymethyl methacrylate microparticles (average particle diameter: 8 μm, standard deviation of particle size: 0.4 μm), 0.08 g of benzoisothiazolinone, 74.2 g of Base precursor solid microparticle dispersion (a) mentioned above, 0.6 g of sodium polystylenesulfonate, 0.21 g of Blue color dye compound 1, each dye solid microparticle dispersion mentioned above in an amount giving each optical density mentioned in Table 3, 8.3 g of acrylic acid/ethyl acrylate copolymer latex (copolymerization ratio: 5/95) and water were mixed to a total volume of 818 ml to prepare a coating solution for antihalation layer.

Preparation of Coating Solution for Back Surface Protective Layer

In a vessel kept at 40° C., 40 g of gelatin, 1.5 g as liquid paraffin of liquid paraffin emulsion, 35 mg of benzisothiazolinone, 6.8 g of 1 mol/L sodium hydroxide, 0.5 g of sodium di(2-ethylhexyl) sulfosuccinate, 0.27 g of sodium polystyrenesulfonate, 37 mg of Fluorine-containing surfactant F-1 (N-perfluorooctylsulfonyl-N-propylalanine potassium salt), 150 mg of Fluorine-containing surfactant F-2 (polyethylene glycol mono(N-perfluorooctylsulfonyl-N-propyl-2-aminoethyl) ether [average polymerization degree of ethylene oxide=15], 64 mg of Fluorine-containing surfactant F-3, 32 mg of Fluorine-containing surfactant F-4, 6.0 g of acrylic acid/ethyl acrylate copolymer (copolymerization ratio: 5/95) and 2.0 g of N,N-ethylenebis (vinylsulfonacetamide) were mixed and made into a volume of 1 L with water to form a coating solution for back surface protective layer.

Example 6

Photothermographic materials were prepared in the same manner as that for the photothermographic materials of Examples, 1 to 5, except that Dye BB added to the PET support was not used. As a result of similar evaluation, it was found that the photothermographic materials of the present invention had favorable performance.

Example 7

The photothermographic materials of Example 1 were evaluated in a similar manner except that a laser light having an emission wavelength of 395 nm was used. Favorable results were similarly obtained for the photothermographic materials of the present invention.

Example 8

Photothermographic material 8–1 was prepared in the same manner as used for the preparation of the photothermographic material of Example 1 except that the procedures were modified as follows.

Preparation of Coating Solution for Antihalation Layer

To water kept at 40° C., 32.7 g of lime-treated gelatin, 0.77 g of monodispersed polymethyl methacrylate microparticles (average particle diameter: 8 μm, standard deviation of particle size: 0.4 μm), 0.03 g of benzoisothiazolinone, 1.9 g of Yellow dye compound 1, 0.22 g of sodium polyethylenesulfonate, 5.0 g of acrylic acid/ethyl acrylate copolymer (copolymerization ratio: 5/95) and 1.7 g of N,N-ethylenebis(vinylsulfonacetamide) were mixed and adjusted to pH 6.0 with 1 mol/L NaOH to prepare a coating solution for antihalation layer in a completed volume of 818 mL.

Preparation of Coating Solution for Back Surface Protective Layer

In water kept at 40° C., 66.5 g of lime-treated gelatin, 5.4 g as liquid paraffin of liquid paraffin emulsion, 0.09 g of benzisothiazolinone, 0.5 g of sodium di (2-ethylhexyl) sulfosuccinate, 105 mg of Fluorine-containing surfactant F-1 (N-perfluorooctylsulfonyl-N-propylalanine potassium salt), 420 mg of Fluorine-containing surfactant F-2 (polyethylene glycol mono (N-perfluorooctylsulfonyl-N-propyl-2-aminoethyl) ether [average polymerization degree of ethylene oxide=15], 180 mg of Fluorine-containing surfactant F-3, 90 mg of Fluorine-containing surfactant F-4, 28 mg of Fluorine-containing surfactant F-7, 14 mg of Fluorine-containing surfactant F-8, 0.23 g of sodium polyethylenesulfonate and 10.0 g of acrylic acid/ethyl acrylate copolymer (copolymerization ratio: 5/95) were mixed and adjusted to pH 6.0 with 1 mol/L NaOH to prepare a coating solution for back surface protective layer in a completed volume of 1000 mL.

Preparation of Silver Halide Emulsion 2

In the preparation of Silver halide emulsion 1 in Example 1, after 5-methyl-2-mercaptobenzimidazole and 1-phenyl-2-heptyl-5-mercapto-1,3,4-triazole were added, $8.5\times10^{-3}$ mole per mole of silver of 1-(3-methylureido)-5-mercaptotetrazole sodium salt was further added as an aqueous solution to prepare Silver halide emulsion 2.

Preparation of Mixed Emulsion A for Coating Solution

Mixed emulsion A for coating solution was prepared in the same manner as in Example 1 except that Silver halide emulsion 2 was used instead of Silver halide emulsion 1.

Preparation of Aliphatic Acid Silver Salt Dispersion

Aliphatic acid silver salt dispersion was prepared in the same manner as in Example 1 except that silver behenate was prepared as follows.

In an amount of 87.6 kg of behenic acid (Edenor C22–85R, produced by Henkel Co.), 423 L of distilled water, 49.2 L of 5 mol/L aqueous solution of NaOH and 120 L of tert-butyl alcohol were mixed and allowed to react with stirring at 75° C. for one hour to obtain a solution of sodium behenate. Separately, 206.2 L of an aqueous solution containing 40.4 kg of silver nitrate (pH 4.0) was prepared and kept at 10° C. A mixture of 635 L of distilled water and 30

L of tert-butyl alcohol contained in a reaction vessel kept at 30° C. was added with the whole amount of the aforementioned sodium behenate solution and the whole amount of the aqueous silver nitrate solution with stirring at constant flow rates over the periods of 93 minutes and 15 seconds, and 90 minutes, respectively.

When the shape of the silver behenate grains obtained above was evaluated by an electron microscopic photography, the grains were scaly crystals having a=0.14 μm, b=0.4 μm and c=0.6 μm in mean values, mean aspect ratio of 5.2, mean diameter of 0.52 μm as spheres and variation coefficient of 15% for diameter as spheres.

Preparation of Dispersion of Development Accelerator 3

Dispersion of Development accelerator 3 was obtained in the same manner as the preparation of dispersion of Development accelerator 1 except that Development accelerator 3 was used instead of Development accelerator 1.

The development accelerator particles contained in the dispersion of development accelerator obtained as described above had a median diameter of 0.48 μm and the maximum particle size of 1.4 μm or less.

Preparation of Coating Solution 2 for Emulsion Layer (Photosensitive Layer)

A coating solution for emulsion layer was prepared by adding successively 1000 g of the aliphatic acid silver salt dispersion, 276 mL of water, 3.2 g of the dispersion of Organic polyhalogenated compound 1, 8.7 g of the dispersion of Organic polyhalogenated compound 2, 173 g of the solution of Phthalazine compound 1, 1082 g of the SBR latex solution (Tg: 20° C.), 155 g of the dispersion of Reducing agent 2, 55 g of the dispersion of Hydrogen bond-forming compound 1, 1 g of the dispersion of Development accelerator 3, 2 g of the dispersion of Development accelerator 1, 3 g of the dispersion of Development accelerator 2, 2 g of the dispersion of Toning agent 1 and 6 mL of the aqueous solution of Mercapto compound 2, which were obtained above, adding 117 g of Mixed emulsion A of silver halide immediately before coating and mixing them sufficiently, fed as it was to a coating die and coated.

Coating of Back Layer

The back surface side of the aforementioned undercoated support was simultaneously applied with the coating solution for antihalation layer and the coating solution for back surface protective layer as stacked layers so that the coated gelatin amounts in the layers should become 170 g/m$^2$ and 0.79 g/m$^2$, respectively, and the coated layers were dried to form a back layer.

The coated amounts (g/m$^2$) of the following compounds in the emulsion layer were changed from those used in Example 1 to those mentioned below.

| | |
|---|---|
| Development accelerator 3 | 0.004 |
| Development accelerator 1 | 0.010 |
| Development accelerator 2 | 0.015 |

Preparation of Photothermographic Materials 8-2 to 8-9

The absorption at 405 nm for the back layer of Photothermographic material 8-1 prepared by the aforementioned procedure was 0.20.

Photothermographic materials 8-2 to 8-9 were newly prepared in the same manner as used for Photothermographic material 8-1 except that the exemplary dye compounds mentioned in Table 4 were added in the indicated amounts instead of Yellow dye compound 1 added to the antihalation layer. As for the addition of the dyes, water-soluble dyes were added as aqueous solutions of dyes, and water-insoluble dyes were added as solid microparticle dispersions prepared in a bead mill of horizontal type (UVM-2, Imex Co., Ltd.) containing zirconia beads having a mean diameter of 0.5 mm.

The obtained photothermographic materials were evaluated as follows.

Absorption of Back Surface of Photothermographic Material

The layers on the emulsion layer side were delaminated, and absorption of the back surface side was measured by using a spectrophotometer.

In the measurement, the support used was used as a reference to obtain the absorption of the layers of back surface side. As for the absorption spectrum of the back surface, absorption maximum wavelength, absorption at 405 nm and a value calculated by dividing absorption at 405 nm with absorption at 425 nm (405/425 ratio) are shown in Table 4.

Light Exposure of Photothermographic Material

Each of the obtained photothermographic materials was exposed as follows.

A semiconductor laser NLHV 3000E produced by Nichia Corporation was mounted on the light exposure section of Fuji Medical Dry Imager FM-DPL produced by Fuji Photo Film Co., Ltd., and the beam diameter was narrowed to about 100 μm. The photothermographic material was exposed for $10^{-6}$ second with an illuminance of the laser light at the photothermographic material surface of 0 and by varying the illuminance in the range of 1 mW/mm$^2$ to 1000 mW/mm$^2$. The emission wavelength of the laser light was 405 nm.

Development of Photothermographic Material

Each exposed photothermographic material was subjected to heat development as follows.

The heat development was performed in the heat development section of Fuji Medical Dry Imager FM-DPL, in which temperatures of four of panel heaters were adjusted to 112° C., 115° C., 115° C. and 115° C., with increasing the film transportation speed so that the total heat development time should become 14 seconds.

Evaluation of Dmin Portion of Photothermographic Material

Density of the obtained image was measured by using a densitometer and plotted against logarithm of exposure to prepare a characteristic curve. Optical density of unexposed area was defined as Dmin, and transmission density of Dmin portion was measured for each photothermographic material by using a density measurement apparatus X-Rite 310 produced by X-Rite Co. Yellow color density obtained for each photothermographic material of which back surface layers were delaminated was taken as 0, and an average of yellow color densities obtained for 10 measurement points of each photothermographic material was calculated. The results are shown in the column of Dmin-Y in Table 4 as relative values based on the average obtained for Photothermographic material 8-1, which was taken as 100. Evaluation of color tone was performed in the same manner as in Example 2.

Evaluation of Sharpness

Each photothermographic material was exposed in the same manner as the aforementioned light exposure, but exposed in a square wave pattern, and subjected to heat development in a similar manner. Sharpness was represented by variable density difference of square wave pattern with a spatial frequency of 1 line/mm standardized based on variable density difference of 0.01 line/mm. The obtained results of sharpness were represented with relative values based on the sharpness of Photothermographic material 1, which was taken as 100.

The results are shown in Table 4.

TABLE 4

| Photo-thermographic material | Back surface Compound | Optical density at 405 nm | Absorption maximum wavelength (nm) | 405/425 Optical density ratio | Evaluation of color tone | Dmin-Y | Sharpness |
|---|---|---|---|---|---|---|---|
| 8-1 | Yellow color dye 1 | 0.20 | 365 | 4.5 | B | 100 | 100 |
| 8-2 | Dye 32 | 0.20 | 398 | 16 | A | 8 | 102 |
| 8-3 | Dye 32 | 0.40 | 398 | 16 | A | 15 | 125 |
| 8-4 | Dye 32 | 0.60 | 398 | 16 | A | 26 | 133 |
| 8-5 | Dye 37 | 0.40 | 396 | 17 | A | 10 | 121 |
| 8-6 | Dye 30 | 0.40 | 386 | 60 | A | 2 | 115 |
| 8-7 | Dye 7 | 0.40 | 396 | 10 | A | 31 | 127 |
| 8-8 | Dye 23 | 0.40 | 388 | 15 | A | 19 | 124 |
| 8-9 | Dye 40 | 0.40 | 405 | 11 | A | 22 | 126 |

As clearly seen from the results shown in Table 4, among Photothermographic materials 8-1 to 8-9 all according to the present invention, Photothermographic materials 8-2 to 8-9 favorably showed superior results in the evaluation of color tone and less yellowish color represented by Dmin-Y. Photothermographic materials 8-3 to 8-9 showed more preferred results, since the antihalation dyes on the back surface showed high absorption at 405 nm, and sharpness was also improved.

What is claimed is:

1. A photothermographic material comprising a support, a photosensitive layer containing a silver halide having a silver iodide content of 10 mol % or more and a reducing agent and one or more non-photosensitive layers provided on the support, wherein at least one of non-photosensitive layers contains a dye showing an absorption maximum in a wavelength range of 350 nm to 430 nm.

2. The photothermographic material according to claim 1, wherein the silver iodide content of the silver halide is 40 mol % or more.

3. The photothermographic material according to claim 1, wherein the silver iodide content of the silver halide is 70 mol % or more.

4. The photothermographic material according to claim 1, wherein the silver iodide content of the silver halide is 90 mol % or more.

5. The photothermographic material according to claim 1, wherein said dye showing an absorption maximum is in a wavelength range of 380 nm to 420 nm.

6. The photothermographic material according to claim 1, wherein said dye showing an absorption maximum is in a wavelength range of 380 nm to 410 nm.

7. The photothermographic material according to claim 1, wherein the dye is in a state of solid microparticle dispersion.

8. The photothermographic material according to claim 1, wherein the dye is in an aggregated state.

9. The photothermographic material according to claim 1, wherein the dye has a ionic hydrophilic group.

10. The photothermographic material according to claim 1, wherein the dye is represented by the following formula (1):

Formula (1)

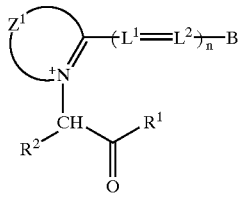

wherein $R^1$ represents a hydrogen atom, an aliphatic group, an aromatic group, —$NR^{21}R^{26}$, —$OR^{21}$ or —$SR^{21}$, where $R^{21}$ and $R^{26}$ each independently represents a hydrogen atom, an aliphatic group or an aromatic group, or $R^{21}$ and $R^{26}$ bond to each other to form a nitrogen-containing heterocyclic ring;

$R^2$ represents a hydrogen atom, an aliphatic group or an aromatic group, and $R^1$ and $R^2$ may bond to each other to form a 5- or 6-membered ring;

$L^1$ and $L^2$ each independently represents a substituted or unsubstituted methine, and substituents of the methine optionally bond to each other to form an unsaturated aliphatic ring or unsaturated heterocyclic ring;

$Z^1$ represents a group required to complete a 5- or 6-membered nitrogen-containing heterocyclic ring, an aromatic ring optionally condenses to the nitrogen-containing heterocyclic ring, and the nitrogen-containing heterocyclic ring and a condensed ring thereof optionally having a substituent;

B represents an aromatic group, an unsaturated heterocyclic ring group or a group of the following formula (3):

Formula (3)

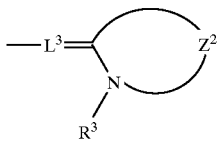

wherein, in the formula (3), $L^3$ represents a substituted or unsubstituted methine, optionally bonding to $L^2$ to form an unsaturated aliphatic ring or an unsaturated heterocyclic ring;

$R^3$ represents an aliphatic group or an aromatic group;

$Z^2$ represents a group required to complete a 5- or 6-membered nitrogen-containing heterocyclic ring, an aromatic ring optionally condensing to the nitrogen-containing heterocyclic ring, and the nitrogen-containing heterocyclic ring and a condensed ring thereof may have a substituent; and n represents 1, 2 or 3.

11. The photothermographic material according to claim 1, wherein the dye is represented by the following formula (2):

Formula (2)

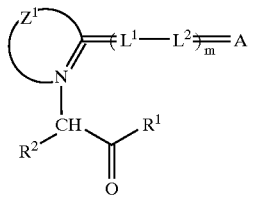

wherein $R^1$ represents a hydrogen atom, an aliphatic group, an aromatic group, —$NR^{21}R^{26}$, —$OR^{21}$, or —$SR^{21}$, where $R^{21}$ and $R^{26}$ each independently represents a hydrogen atom, an aliphatic group or an aromatic group, or $R^{21}$ and $R^{26}$ bond to each other to form a nitrogen-containing heterocyclic ring;

$R^2$ represents a hydrogen atom, an aliphatic group or an aromatic group, and $R^1$ and $R^2$ optionally bond to each other to form a 5- or 6-membered ring;

$L^1$ and $L^2$ each independently represents a substituted or unsubstituted methine, and substituents of the methine optionally bond to each other to form an unsaturated aliphatic ring or unsaturated heterocyclic ring;

$Z^1$ represents a group required to complete a 5- or 6-membered nitrogen-containing heterocyclic ring, an aromatic ring optionally condensing to the nitrogen-containing heterocyclic ring, and the nitrogen-containing heterocyclic ring and a condensed ring thereof may have a substituent;

A represents an acidic nucleus; and m represents 1, 2 or 3.

12. The photothermographic material according to claim 1, wherein the dye is represented by the following formula (4);

Formula (4)

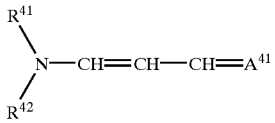

wherein $R^{41}$ and $R^{42}$ each independently represents a hydrogen atom, an aliphatic group, an aromatic group or a nonmetallic atom group required to form a 5- or 6-membered ring when $R^{41}$ and $R^{42}$ bond to each other; either $R^{41}$ or $R^{42}$ optionally bonding to a methine group adjacent to the nitrogen atom to form a 5- or 6-membered ring; and $A^{41}$ represents an acidic nucleus.

13. The photothermographic material according to claim 1, wherein the dye is represented by the following formula (5):

Formula (5)

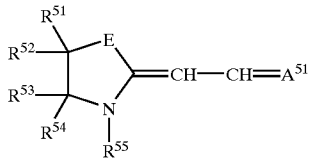

wherein $R^{51}$ to $R^{55}$ each independently represents a hydrogen atom, an aliphatic group or an aromatic group, and $R^{51}$ and $R^{54}$ together optionally form a double bond; when $R^{51}$ and $R^{54}$ together form a double bond, $R^{52}$ and $R^{53}$ optionally bond to each other to form a benzene ring or a naphthalene ring; $R^{55}$ represents an aliphatic group or an aromatic group;

E represents an oxygen atom, a sulfur atom, an ethylene group, >N—$R^{56}$ or >C($R^{57}$) ($R^{58}$), wherein $R^{56}$ represents an aliphatic group or an aromatic group, and $R^{57}$ and $R^{58}$ each independently represents a hydrogen atom or an aliphatic group; and $A^{51}$ represents an acidic nucleus.

14. The photothermographic material according to claim 1, wherein the dye is represented by the following formula (6):

Formula (6)

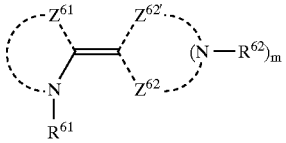

wherein $R^{61}$ represents a hydrogen atom, an aliphatic group or an aromatic group;

$R^{62}$ represents a hydrogen atom, an aliphatic group or an aromatic group;

$Z^{61}$ represents a group required to form a nitrogen-containing heterocyclic ring;

$Z^{62}$ and $Z^{62}$ represent a group required to form a heterocyclic ring or a non-cyclic acidic end group together with $(N—R^{62})_m$;

a ring optionally condensing to or $Z^{61}$ or $Z^{62}$ and $Z^{62}$; and m represents 0 or 1.

15. The photothermographic material according to claim 1, wherein the dye is contained in an amount of 0.001–0.2 $g/m^2$.

16. The photothermographic material according to claim 1; wherein the dye is contained in an amount of 0.001–0.1 $g/m^2$.

17. The photothermographic material according to claim 1, wherein the dye is contained in an amount of 0.001–0.05 $g/m^2$.

18. The photothermographic material according to claim 1, which further contains a decolorizing agent in at least one of the photosensitive layer and the non-photosensitive layer.

19. The photothermographic material according to claim 1, which is a monosheet type material.

20. An image formation method, which comprises:

exposing a photothermographic material with a laser light having an emission peak at 350 nm to 430 nm, and developing the exposed photothermographic material with heat to record an image;

wherein the photothermographic material comprises a support, a photosensitive layer containing a silver halide having a silver iodide content of 10 mol % or more and a reducing agent and a non-photosensitive layer provided on the support, and at least one of the photosensitive layer and the non-photosensitive layer contains a dye showing an absorption maximum in a wavelength range of 350 nm to 430 nm.

21. The photothermographic material according to claim 1, wherein the photosensitive layer contains a dye showing an absorption maximum in a wavelength range of 350 nm to 430 nm.

22. The photothermographic material according to claim 1, wherein the non-photosensitive layer containing the dye showing an absorption maximum in a wavelength range of 350 nm to 430 nm is one of the following layers (1) to (4)

(1) an overcoat layer provided on the photosensitive layer, (2) an intermediate layer provided between a plurality of photosensitive layers, (3) an undercoat layer provided between the photosensitive layer and the support, and (4) a back layer provided on the side of the support opposite to the side on which the photosensitive layer is provided.

23. The photothermographic material according to claim 1, wherein the non-photosensitive layer containing the dye showing an absorption maximum in a wavelength range of 350 nm to 430 nm is provided on the side of the support opposite to the side on which the photosensitive layer is provided.

* * * * *